US012655718B2

(12) United States Patent
Klinke Da Silveira et al.

(10) Patent No.: US 12,655,718 B2
(45) Date of Patent: Jun. 16, 2026

(54) SAFETY VALVE WITH ELECTRICAL ACTUATOR

(71) Applicant: SCHLUMBERGER TECHNOLOGY CORPORATION, Sugar Land, TX (US)

(72) Inventors: Helvecio Carlos Klinke Da Silveira, Taubate (BR); Cassius Alexander Elston, Shreveport, LA (US); Felipe Bauli Graziano, Taubate (BR); Vinicius Romano, Taubate (BR); Carlos Alexandre Vieira, Taubate (BR); Lucas Antonio Perrucci, Taubate (BR); Eduardo Scussiato, Taubate (BR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/112,375

(22) PCT Filed: Sep. 15, 2023

(86) PCT No.: PCT/US2023/032873
§ 371 (c)(1),
(2) Date: Mar. 17, 2025

(87) PCT Pub. No.: WO2024/059266
PCT Pub. Date: Mar. 21, 2024

(65) Prior Publication Data

US 2026/0103955 A1 Apr. 16, 2026

Related U.S. Application Data

(60) Provisional application No. 63/375,798, filed on Sep. 15, 2022.

(51) Int. Cl.
*E21B 34/06* (2006.01)

(52) U.S. Cl.
CPC ..... *E21B 34/066* (2013.01); *E21B 2200/05* (2020.05)

(58) Field of Classification Search
CPC ..... E21B 34/066; E21B 2200/05
See application file for complete search history.

(56) References Cited

U.S. PATENT DOCUMENTS 5,070,944 A 12/1991 Hopper
6,433,991 B1 8/2002 Deaton
(Continued)

FOREIGN PATENT DOCUMENTS

WO 2019089487 A1 5/2019
WO 2022000062 A1 1/2022

OTHER PUBLICATIONS

International Search Report and Written Opinion of International Patent Application No. PCT/US2023/032873 dated on Jan. 5, 2024, 12 pages.

*Primary Examiner* — D. Andrews
(74) *Attorney, Agent, or Firm* — Kyle R. Miiller

(57) ABSTRACT

A downhole valve assembly includes a safety valve and an actuator that opens and/or closes the valve. The actuator can be an electro-hydraulic actuator (EHA), an electro mechanical actuator (EMA), or an electro hydraulic pump (EHP). The downhole safety valve can also include an electric magnet. The electric magnet can act as or control a magnetic decoupling mechanism to control closure of the safety valve.

10 Claims, 53 Drawing Sheets

(56) References Cited

U.S. PATENT DOCUMENTS

| | | | | |
|---|---|---|---|---|
| 10,174,589 | B2 * | 1/2019 | Vick, Jr. | F16K 31/1221 |
| 11,905,790 | B2 | 2/2024 | Chouzenoux | |
| 12,359,534 | B2 | 7/2025 | Chouzenoux | |
| 2019/0203564 | A1 | 7/2019 | Henschel, Jr. | |
| 2020/0370394 | A1 | 11/2020 | Cai et al. | |
| 2021/0324708 | A1 | 10/2021 | Gomes | |
| 2025/0305388 | A1 * | 10/2025 | El Mallawany | F16K 31/0644 |
| 2025/0361788 | A1 * | 11/2025 | Fripp | E21B 34/066 |

* cited by examiner

SAFETY VALVE WITH ELECTRICAL ACTUATOR

CROSS-REFERENCE TO RELATED APPLICATIONS

The present application is a National Stage Entry of International Application No. PCT/US2023/032873, filed Sep. 15, 2023, which claims priority benefit of U.S. Provisional Application No. 63/375,798, filed Sep. 15, 2022, the entirety of which is incorporated by reference herein and should be part of this specification.

BACKGROUND

Field

The present disclosure generally relates to safety valves, and more particularly to safety valves having electrical actuators and fully electric safety valves.

Description of the Related Art

Valves typically are used in a well for such purposes as fluid flow control, formation isolation, and safety functions. A common downhole valve is a hydraulically-operated valve, which is known for its reliable performance. However, hydraulically-operated valves have limitations.

For example, the use of a hydraulically-operated valve is depth-limited due to the high hydrostatic pressure acting against the valve at large depths, which may diminish the effective hydraulic pressure that is available to operate the valve. Furthermore, for deep applications, the viscous control fluid in a long hydraulic line may cause unacceptably long operating times for certain applications. In addition, a long hydraulic line and the associated connections provide little or no mechanism to determine, at the surface of the well, what is the true state of the valve. For example, if the valve is a safety valve, there may be no way to determine the on-off position of the valve, the pressure across the valve and the true operating pressure at the valve's operator at the installed depth.

SUMMARY

In some configurations, an electro-mechanical coupling includes an actuator comprising an extendable and retractable piston; a base member; an electric magnet; a magnet; and a mechanical advantage mechanism configured to enhance a holding force of the electric magnet with the magnet when the electric magnet is activated. One of the electric magnet and the magnet is operably coupled to the piston, and the other of the electric magnet and the magnet is selectively operably couplable to the base member. Activation of the electric magnet is configured to operably couple the electric magnet and the magnet such that axial movement of the piston causes axial movement of the base member, and wherein subsequent deactivation of the electric magnet is configured to operably de-couple the electric magnet and the magnet to allow movement of the base member relative to the actuator.

The actuator can be an electro-mechanical actuator. The mechanical advantage mechanism can include a latch mechanism. The latch mechanism can include an outer collet, an inner collet disposed at least partially within the outer collet, and a spring. When the electric magnet is activated the outer collet is locked relative to the inner collet against force of the spring, and when the electric magnet is deactivated the spring unlocks the outer and inner collets.

The mechanical advantage mechanism can include a double latch mechanism. The double latch mechanism can include an outer collet; an inner collet disposed at least partially within the outer collet; an inner rod disposed at least partially within the inner collet; an outer spring disposed about the inner collet; at least one inner spring disposed about the inner rod; and at least one ball disposed on an outer diameter of the inner rod. When the electric magnet is activated the outer collet is locked relative to the inner collet against force of the spring, and when the electric magnet is deactivated the double latch mechanism unlocks in a two stage release. The at least one inner spring and the at least one ball can act as or in a first stage of the two stage release. The outer spring can act as or in a second stage of the two stage release.

The electro-mechanical coupling can be included in an electric safety valve. When included in an electric safety valve, the base member can be operably coupled to a flow tube of the safety valve.

In some configurations, an electric safety valve can include a return spring; an internal tubing sleeve; an actuator comprising an extendable and retractable piston; and an electro-mechanical coupling configured to selectively operably connect the piston and the internal tubing sleeve.

The electro-mechanical coupling can include an electric magnet operably coupled to the piston; a magnet selectively operably couplable to the internal tubing sleeve; and a latch mechanism configured to provide a mechanical advantage to enhance a holding force of the electric magnet with the magnet when the electric magnet is activated. The latch mechanism can include an inner collet, an outer collet, and a latch spring. The electric magnet can be configured to have enough holding force to compress the latch spring, but insufficient holding force to compress the return spring without the mechanical advantage of the latch mechanism.

In some configurations, a method of operating an electric downhole safety valve, the safety valve including a flapper, an internal tubing sleeve, a return spring, an actuator comprising a piston, an electric magnet, a magnet, and an electro-mechanical coupling configured to selectively operably connect the piston and the internal tubing sleeve, wherein one of the electric magnet and the magnet is operably coupled to the piston, and the other of the electric magnet and the magnet is selectively operably coupled to the internal tubing sleeve, includes: extending the piston so the electric magnet contacts the magnet; activating the electric magnet; locking the electro-mechanical coupling; retracting the piston, thereby shifting the internal tubing sleeve from a closed position to an open position; compressing the return spring; and opening the flapper.

The method can further include deactivating the electric magnet and unlocking the electro-mechanical coupling, allowing the return spring to expand, thereby shifting the internal tubing sleeve to the closed position, and allowing the flapper to close.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1A:
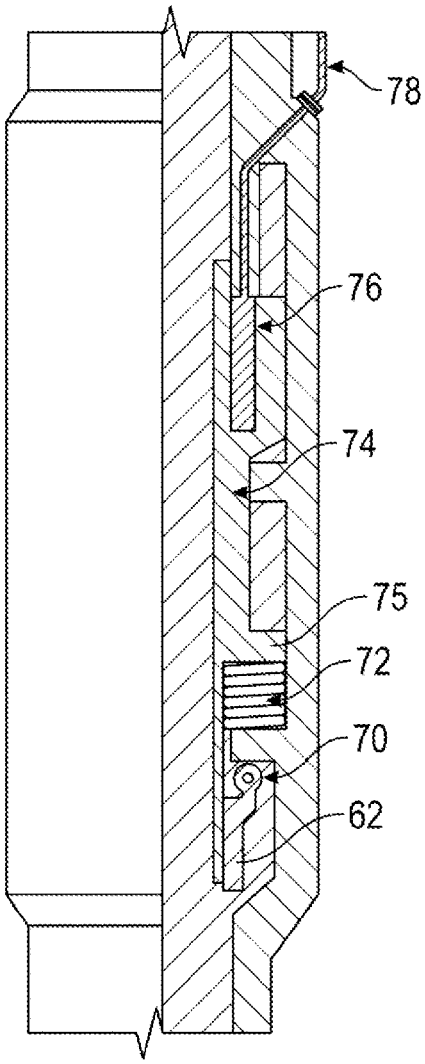
FIG. 1A illustrates an example conventional downhole safety valve in an open position.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Well completions often include various valves, such as safety valves and flow control valves. Downhole or subsurface safety valves are often deployed in a well, for example, in an upper part of a well completion, to provide a barrier against uncontrolled flow below the valve. The valve must be able to operate in a failsafe mode to close and stop well production in case of an emergency. Typically such valves have been hydraulically operated. However, hydraulically operated valves have limitations. For example, the use of a hydraulically-operated valve is depth-limited due to the high hydrostatic pressure acting against the valve at large depths, which may diminish the effective hydraulic pressure that is available to operate the valve. Furthermore, for deep applications, the viscous control fluid in a long hydraulic line may cause unacceptably long operating times for certain applications. In addition, a long hydraulic line and the associated connections provide little or no mechanism to determine, at the surface of the well, what is the true state of the valve. For example, if the valve is a safety valve, there may be no way to determine the on-off position of the valve, the pressure across the valve and the true operating pressure at the valve's operator at the installed depth.

Compared to hydraulic completion systems, electric completion systems can provide reduced capital expenditures, reduced operating expenditures, and reduced health, safety, and environmental problems. Electric completions can advantageously allow for the use of sensors and proactive decision making for well control.

The present disclosure provides electric safety valves, systems (e.g., well completions) including such electric safety valves, and methods of operating electric safety valves. In some configurations, an inductive coupler is used with an electric safety valve or completion including an electric safety valve. The safety valves can have a flapper valve design. The present disclosure also provides an electro-magnet disconnect system. The disconnect system enables a safe and reliable closing mechanism capable of withstanding extreme slam shutting.

Figure 1B:
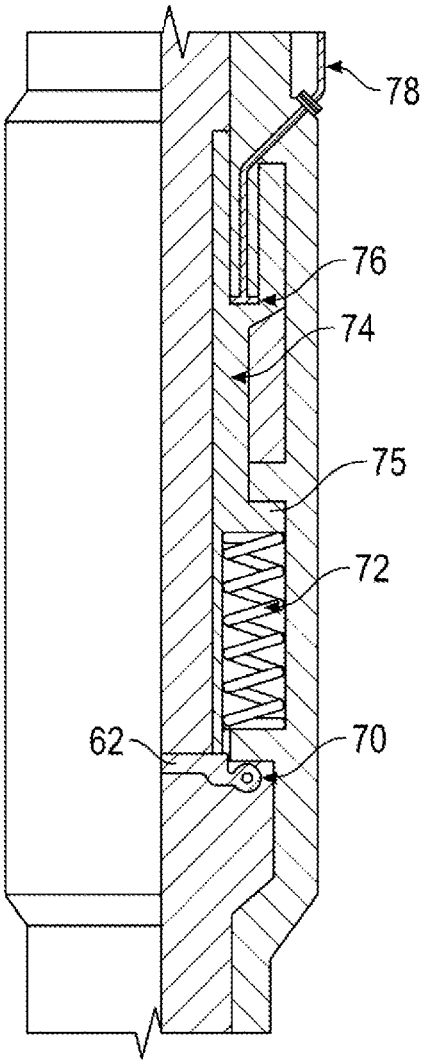
FIG. 1B illustrates the safety valve of FIG. 1A in a closed position.

Conventional downhole safety valves are typically operated via a hydraulic connection to or from a surface panel. FIGS. 1A and 1B illustrate an example hydraulic safety valve having a flapper valve design in open and closed positions, respectively. As shown, the safety valve assembly includes a flapper 62, a return spring 72, a flow tube or sleeve 74, a piston 76, and a control line 78. The position (open or closed) of the flapper 62 is controlled via the flow tube or sleeve 74 sliding up and down inside the production tubing. The sleeve position is controlled or moved by the return spring 72 and/or the piston 76. The flapper 62 and return spring 72 are biased to the closed position.

Hydraulic pressure applied from the surface via the control line 78 to the piston 76 causes the piston 76 to move the sleeve 74 downward, thereby compressing the return spring 72, and open the flapper 62. In the illustrated configuration, the sleeve 74 includes a radially outwardly projecting flange 75 that contacts and compresses the spring 72. Hydraulic pressure in the piston 76 maintains the sleeve's position and holds the valve open. As shown, at least a portion of the flapper 62 is shielded from flow through the production tubing by a portion of the sleeve 74, so the sleeve 74 protects the flapper 62 and tubing sealing area from flow erosion. If the hydraulic pressure in the control line 78 is released, whether intentionally or unintentionally, the spring 72 bias pushes the sleeve 74 upward, allowing the flapper 62 to close. The spring 72 and/or flapper 62 bias to the closed position provides a failsafe for the valve, as the spring 72 ensures valve closure in case of emergency, such as a catastrophic event on the surface leading to a pressure drop or loss in the hydraulic control line 78.

Figure 2:
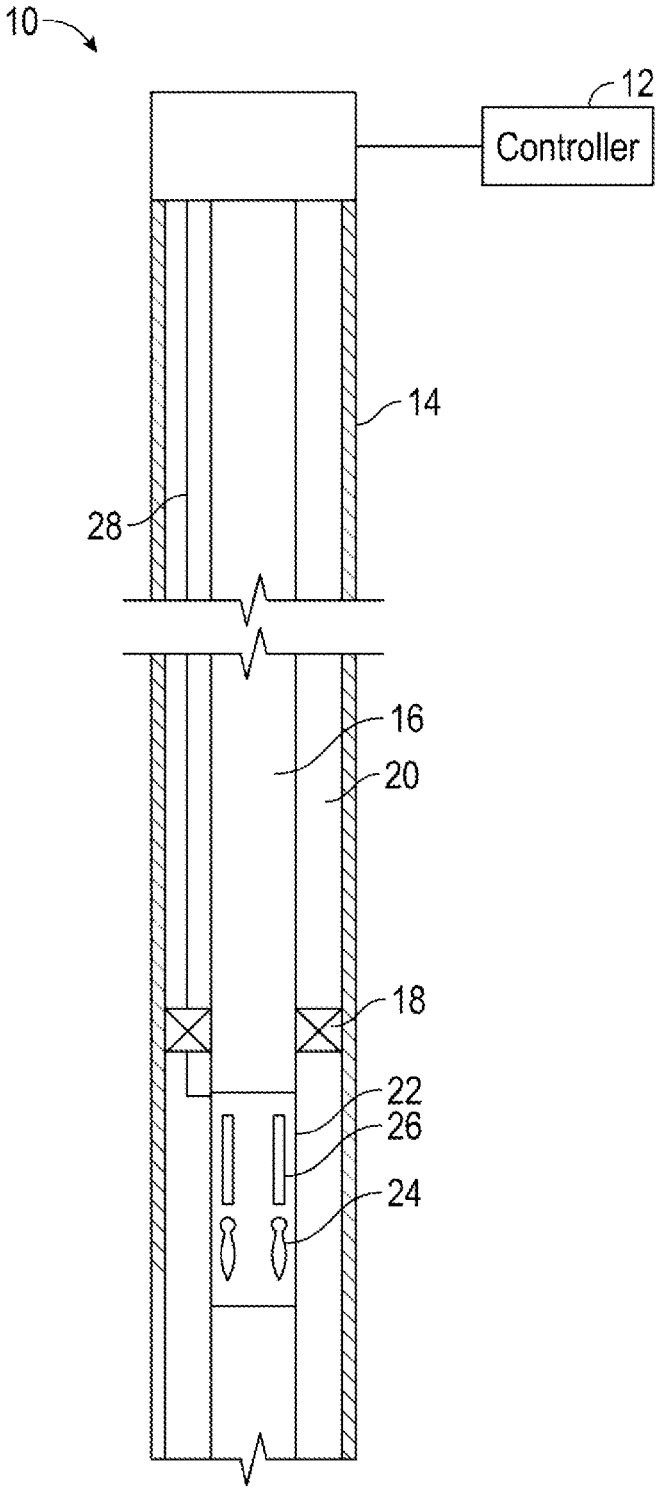
FIG. 2 illustrates an embodiment of a completion string having a subsurface safety valve in a wellbore.

FIG. 2 illustrates an example completion string including a safety valve according to the present disclosure positioned in a wellbore 10. The wellbore 10 may be part of a vertical well, deviated well, horizontal well, or a multilateral well. The wellbore 10 may be lined with casing 14 (or other suitable liner) and may include a production tubing 16 (or other type of pipe or tubing) that runs from the surface to a hydrocarbon-bearing formation downhole. A production packer 18 may be employed to isolate an annulus region 20 between the production tubing 16 and the casing 14.

A subsurface safety valve assembly 22 may be attached to the tubing 20. The subsurface safety valve assembly 22 may include a flapper valve 24 or some other type of valve (e.g., a ball valve, sleeve valve, disk valve, and so forth). The flapper valve 24 is actuated opened or closed by an actuator assembly 26. During normal operation, the valve 24 is actuated to an open position to allow fluid flow in the bore of the production tubing 16. The safety valve 24 is designed to close should some failure condition be present in the wellbore 10 to prevent further damage to the well.

The actuator assembly 26 in the safety valve assembly 22 may be electrically activated by signals provided by a controller 12 at the surface to the actuator assembly 26 via an electrical cable 28. The controller 12 is therefore operatively connected to the actuator assembly 26 via the cable 28. Other types of signals and/or mechanisms for remote actuation of the actuator assembly 26 are also possible. Depending on the application, the controller 12 may be in the form of a computer-based control system, e.g. a microprocessor-based control system, a programmable logic control system, or another suitable control system for providing desired control signals to and/or from the actuator assembly 26. The control signals may be in the form of electric power and/or data signals delivered downhole to subsurface safety valve assembly 22 and/or uphole from subsurface safety valve assembly 22.

Figure 3:
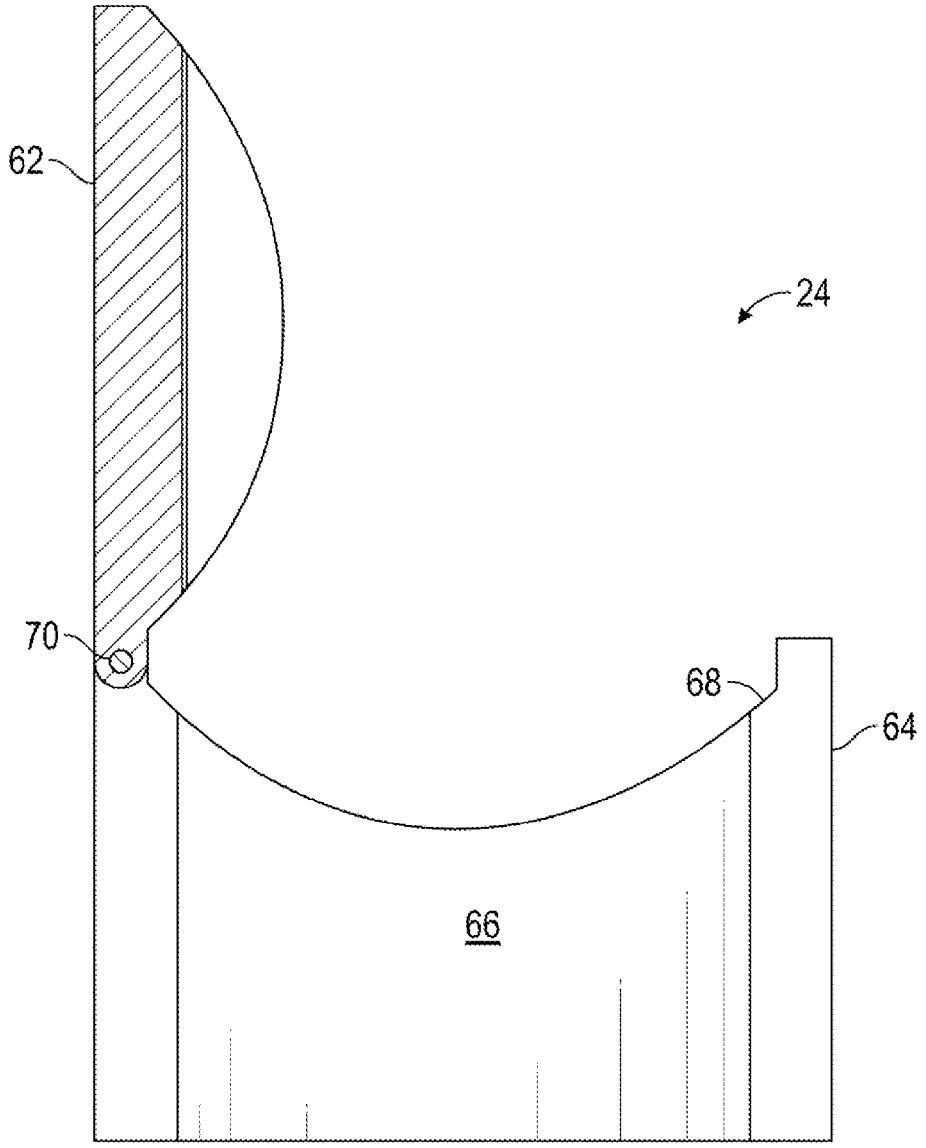
FIG. 3 is a cross-sectional illustration of an example of a flapper valve which may be utilized in a downhole system.

FIG. 3 illustrates an example flapper valve 24. In this embodiment, the flapper 62 is pivotably mounted along a flapper housing 64 having an internal passage 66 therethrough and having a hard sealing surface 68. The flapper 62 is pivotably coupled to the flapper housing 64, for example, via a hinge pin 70, for movement between an open position and a closed position. By pivotably coupled, it should be understood the flapper 62 may be directly coupled to housing 64 or indirectly coupled to the housing 64 via an intermediate member.

Additional details regarding safety valves can be found in, for example, U.S. Pat. No. 6,433,991 and WO 2019/089487, the entirety of each of which is hereby incorporated by reference herein. Although the present disclosure describes an actuator and electromagnetic disconnect used with a subsurface safety valve, it is contemplated that further embodiments may include actuators and/or electromagnetic disconnects used with other types of downhole devices. Such other types of downhole devices may include, as examples, flow control valves, packers, sensors, pumps, and so forth. Other embodiments may include actuators and/or electromagnetic disconnects used with devices outside the well environment.

The actuator assembly 26 can be or include various types of actuators, such as electrical actuators. For example, in some configurations, the actuator assembly 26 is or includes an electro hydraulic actuator (EHA), an electro mechanical actuator (EMA), or an electro hydraulic pump (EHP). An EHA can allow for quick backdrive or actuation and therefore quick close functionality, which advantageously allows for rapid closure of the valve 24 when desired or required.

In some configurations, the actuator assembly 26 is fully electric and the safety valve assembly 22 is fully electric. In other words, the safety valve assembly 22 includes no hydraulic components. In some such configurations, the actuator assembly 26 is or includes an EMA.

In some configurations, the present disclosure advantageously provides a downhole electro-mechanical actuator in combination with an electrical magnet to control a valve, such as a downhole safety valve 22, for example as shown in FIGS. 4, 9, 12, and 14. The safety valve can include various features of the configurations shown in FIGS. 1-3. However, compared to the example valve of FIGS. 1A-1B, the safety valves of FIGS. 4, 9, 12, and 14 include, and their position is controlled by, an electric actuator 26 rather than hydraulic pressure applied via a control line from the surface. The actuator 26 is controlled and powered by a downhole electronics cartridge 30. The downhole electronics 30 can be connected to the surface via an electrical cable, for example, cable 28 (shown in FIG. 2). In a closed mode or position of the safety valve, the actuator 26 may be fully retracted or fully extended, depending on the configuration of the safety valve as described in greater detail with respect to examples shown and described herein, such that the return spring 72 is fully expanded, and the flapper 62 is closed. In an open mode or position of the safety valve, the return spring 72 may be compressed and the flapper 62 open.

Figure 4:
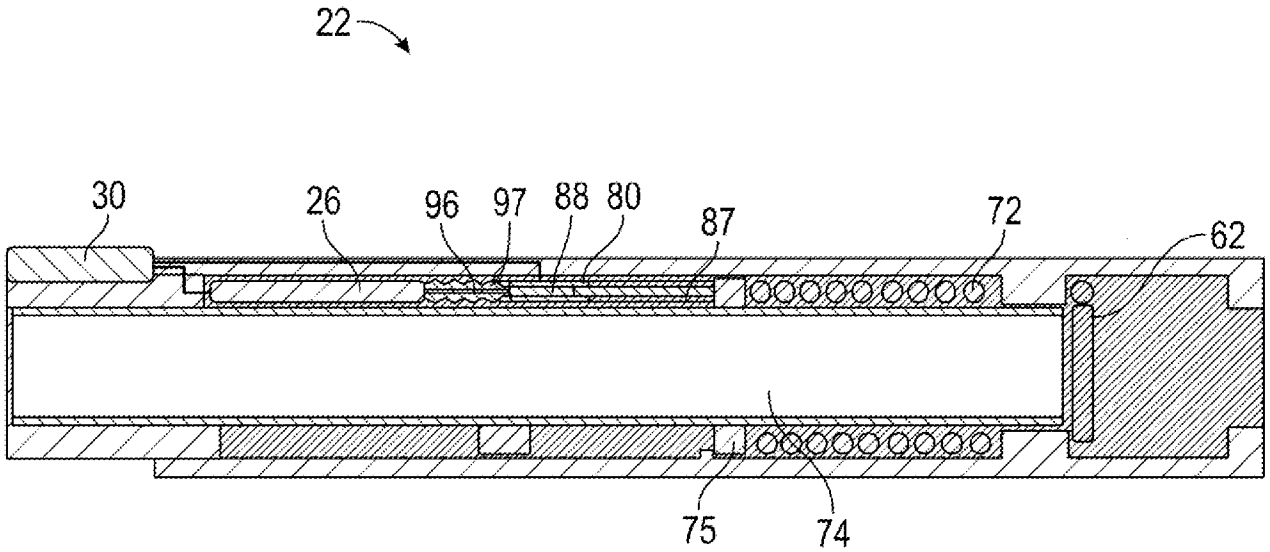
FIG. 4 schematically shows a longitudinal cross-section of an example downhole safety valve including a downhole electro-mechanical actuator and electro-magnet.
Figure 5:
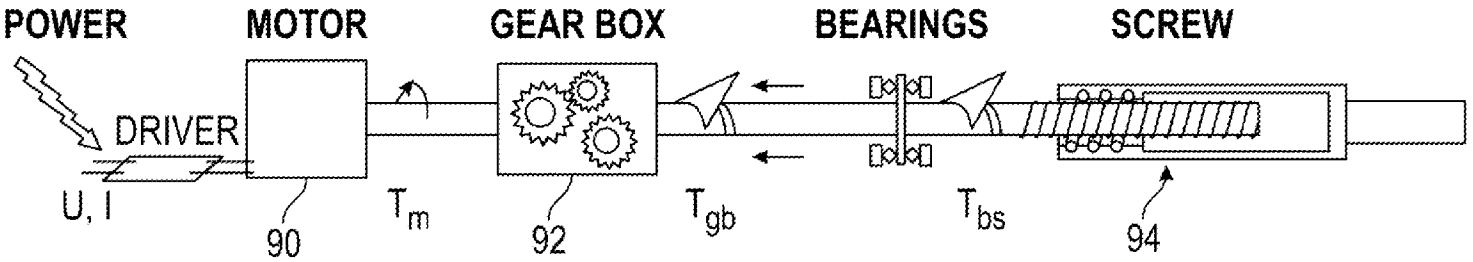
FIG. 5 schematically illustrates the principle of a linear electro-mechanical actuator that can be included in valves such as the valve of FIG. 4.

FIG. 5 schematically illustrates the principle of a linear electro-mechanical actuator, for example as may be included in valve assemblies according to the present disclosure, such as the valve assembly of FIGS. 4, 9, 12, and 14. As shown, an electrical motor 90 is powered and controlled by embedded downhole electronics 30. Motor rotation is converted into linear motion via a gear box 92 and screw mechanical assembly 94. In use, the motor 90 is activated by a surface command received and interpreted by the downhole electronics 30. The required linear force is obtained by the torque applied by the motor 90 at gear box entry.

Figure 6:
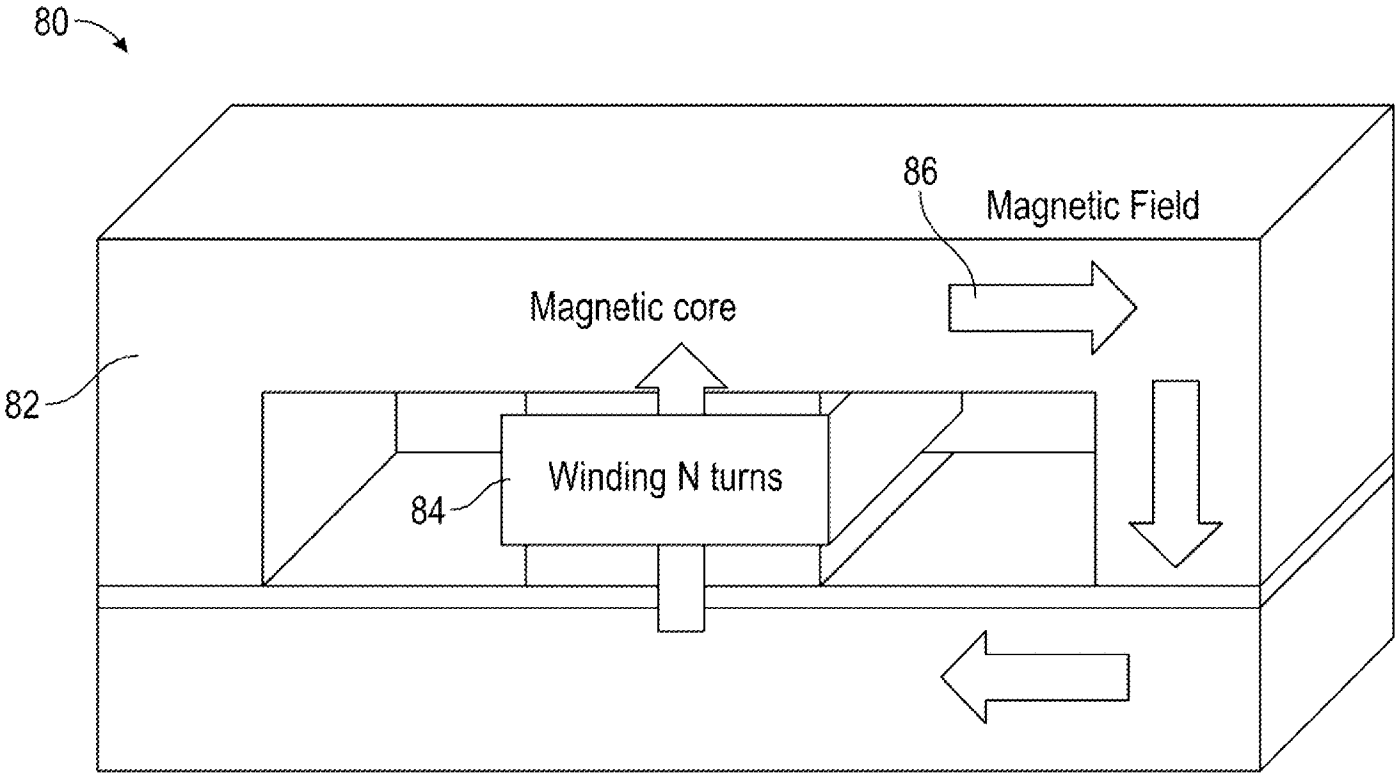
FIG. 6 schematically illustrates the principle of an electrical magnet that can be included in valves such as the valve of FIG. 4.

FIG. 6 schematically illustrates the principle of an electrical magnet 80, for example as may be included in valve assemblies according to the present disclosure, such as the valve assembly of FIGS. 4, 9, 12, and 14. As shown, the electrical magnet, or e-magnet 80, includes a magnetic core 82. The core 82 includes a coil of wires 84 having an appropriate number of turns to induce a required magnetic field when the coil 84 is powered on with a DC current. The magnetic field B (indicated by arrows 86 in FIG. 6) creates a force F inside each section area A of the core assembly according to the equation:

$$F = \frac{B^2 A}{2\mu_0}$$

A force up to 40 N can be induced by a magnetic field of 1 Tesla per $cm^2$. As core materials commonly used are known to saturate above 1.3 Tesla, a force up to 1000 N can be achieved with a core section in the order of 15 $cm^2$.

Figure 7:
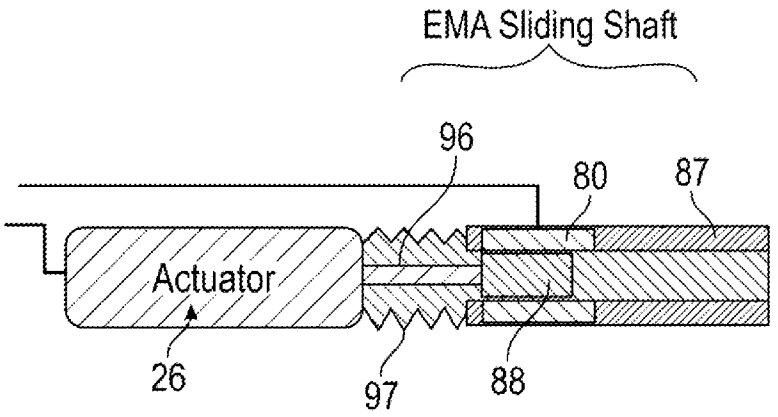
FIG. 7 schematically illustrates a portion of the safety valve of FIG. 4.

As shown in FIGS. 4 and 7, the actuator 26 includes an extendable or expandable piston or inner shaft 96. A magnet 88, e.g., a permanent magnet, magnet steel portion, magnetic metallic material, or magnet permeable base plate, is positioned at an end of the piston 96. A tube or sliding shaft 87 surrounds the magnet 88 and extends into contact with the flange 75. In the illustrated configuration, a cover 97, e.g., a bellows or corrugated sheath, surrounds the piston 96 and extends between the body of the actuator 26 and the tube 87. In other words, the tube 87 is connected to the actuator 26 housing by bellows 97. The tube 87, and in some configurations the bellows 97, can be filled with clean oil. An e-magnet 80 is disposed, e.g., mounted, on or in a portion of the tube 87. In a closed position of the safety valve assembly 22, for example as shown in FIGS. 4 and 7, the e-magnet 80 surrounds the magnet 88. In use, as described in further detail herein, the shaft 96 and magnet 88 can move axially, e.g., extend or expand and retract or contract, within the tube 87. In alternative configurations, the e-magnet 80 can be disposed on or at the end of the shaft 96, and the magnet 88 can be disposed on or in the tube 87 surrounding the e-magnet 80.

The e-magnet 80 and/or magnet 88 can be fully sealed, e.g., by the covers 87, 97, and welded to advantageously protect against debris and wellbore fluids. The e-magnet 80 and magnet 88 can therefore be sealed and welded together in one fluid zone, which can be filled with clean oil as described. In some configurations, the motor 90, gearbox 92, screw 94, piston 96, e-magnet 80, and/or magnet 88 can all be sealed and welded in the same fluid zone or module, for example, as at least partially defined or surrounded by the covers 87, 97. Sealing the e-magnet 80 and magnet 88 in the same module or zone allows for the radial gap between the e-magnet 80 and magnet 88 to be reduced, minimized, or possibly eliminated, which advantageously allows for an increased holding force, or the same or increased holding force with smaller magnets. As an increased gap between the e-magnet 80 and magnet 88 reduces the holding force between them, reducing or eliminating the gap can increase the holding force. This can allow for the use of smaller magnets.

Figure 8A:
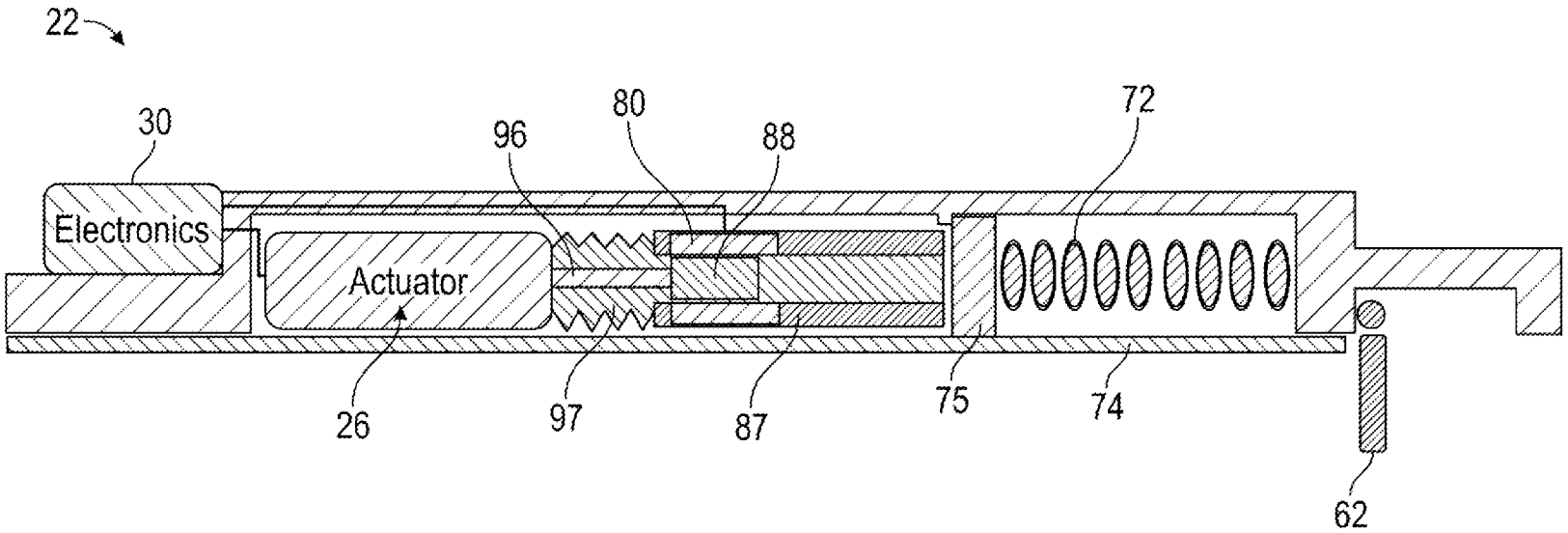
FIGS. 8A-8H schematically illustrate operation of the safety valve of FIG. 4.
Figure 8B:
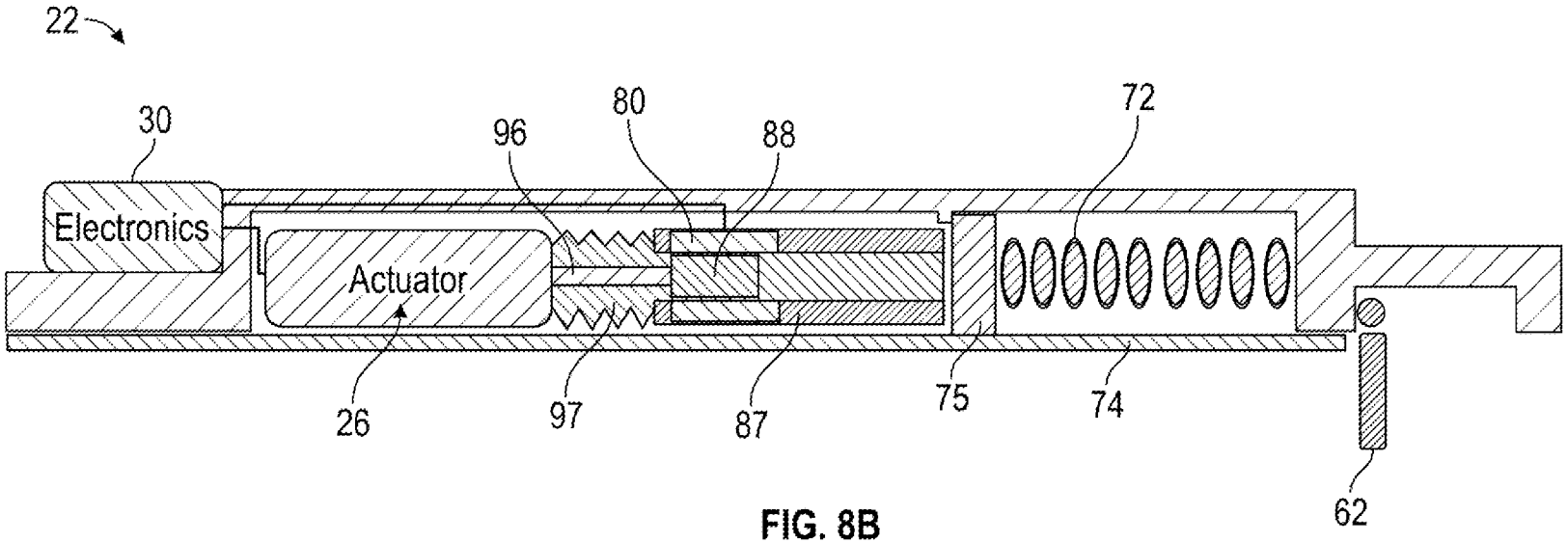

FIGS. 8A-8H schematically illustrate operation of the valve of FIG. 4. FIG. 8A shows the valve in a closed position, with the actuator 26 in a fully retracted position and the e-magnet 80 not activated. The actuator 26 can be not powered, or powered only for monitoring. In FIG. 8B, the e-magnet 80 is activated to prepare the actuator 26 for actuation and initialize the valve opening sequence. E-magnet 80 activation establishes a magnetic coupling between the e-magnet 80 and magnet 88, and therefore a coupling between movement of the piston 96 and movement of the tube 87.

Figure 8C:
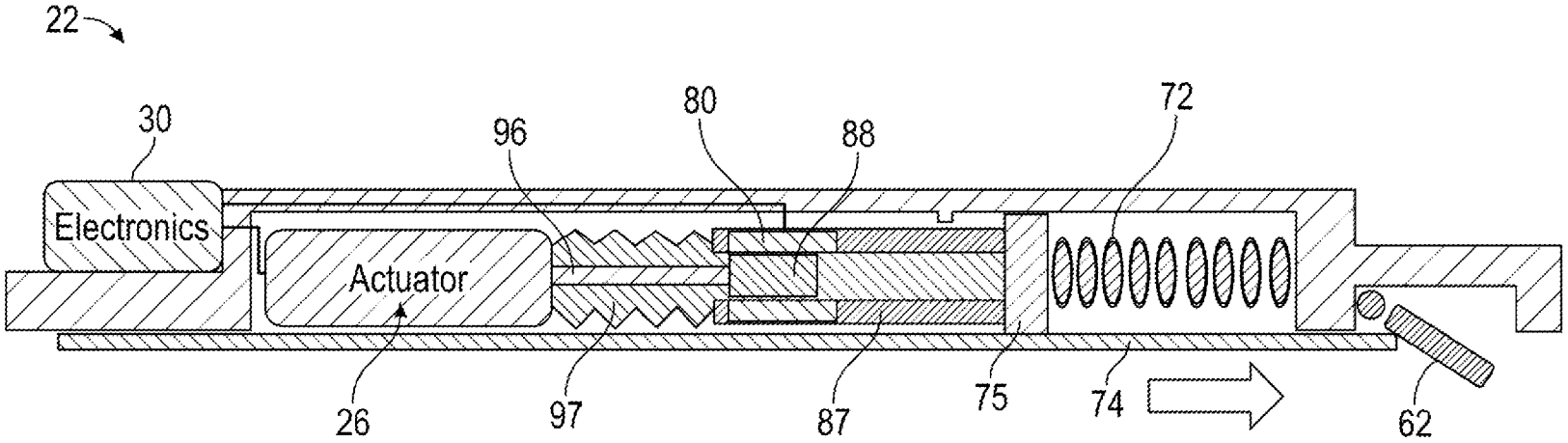

FIG. 8C shows the valve opening, for example in response to a command from the surface to the downhole electronics 30. As shown, the E-magnet 80 is activated and the actuator 26 (e.g., the piston or shaft 96) is extending. Due to the magnetic coupling between the magnet 88 of the piston 96 and the e-magnet 80 of the tube 87, extension of the actuator 26 (e.g., the piston or shaft 96) causes linear motion of the tube 87. The tube 87 in turn shifts the flange 75, thereby compressing the return spring 72. Due to the magnetic connection between the piston 96 and the tube 87, and the tube 87 contacting and moving the flange 75, extension of the actuator 26 (e.g., piston or shaft 96) also moves the internal tubing sleeve 74, toward, into contact with, and/or past the flapper 62 to open the flapper 62. As the tube 87 moves linearly while the actuator body 26 remains stationary, the bellows 97 can expand.

Figure 8D:
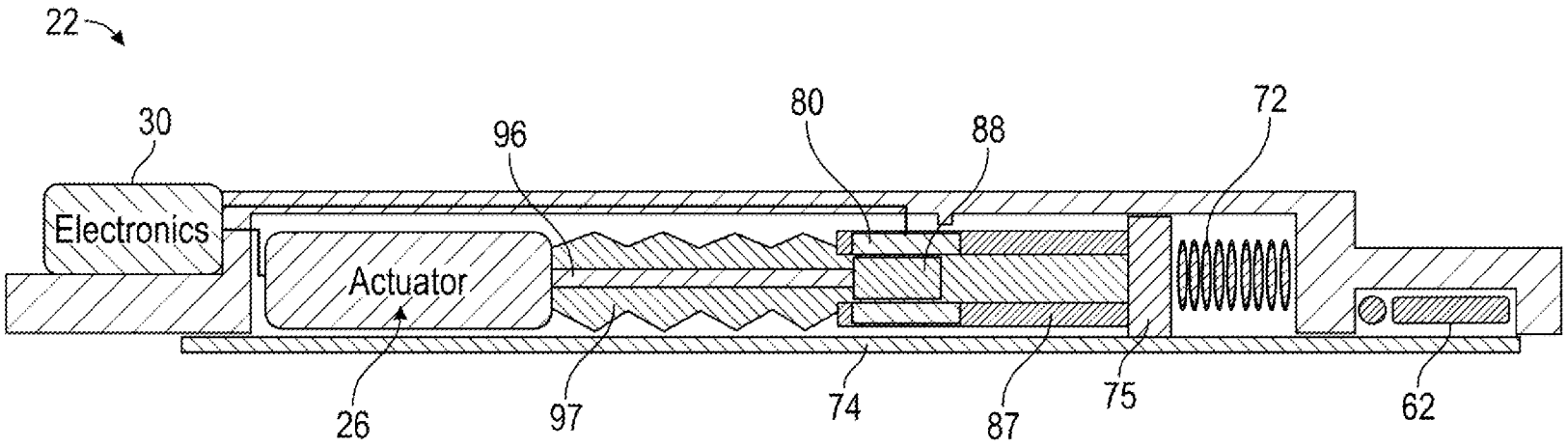
Figure 8E:
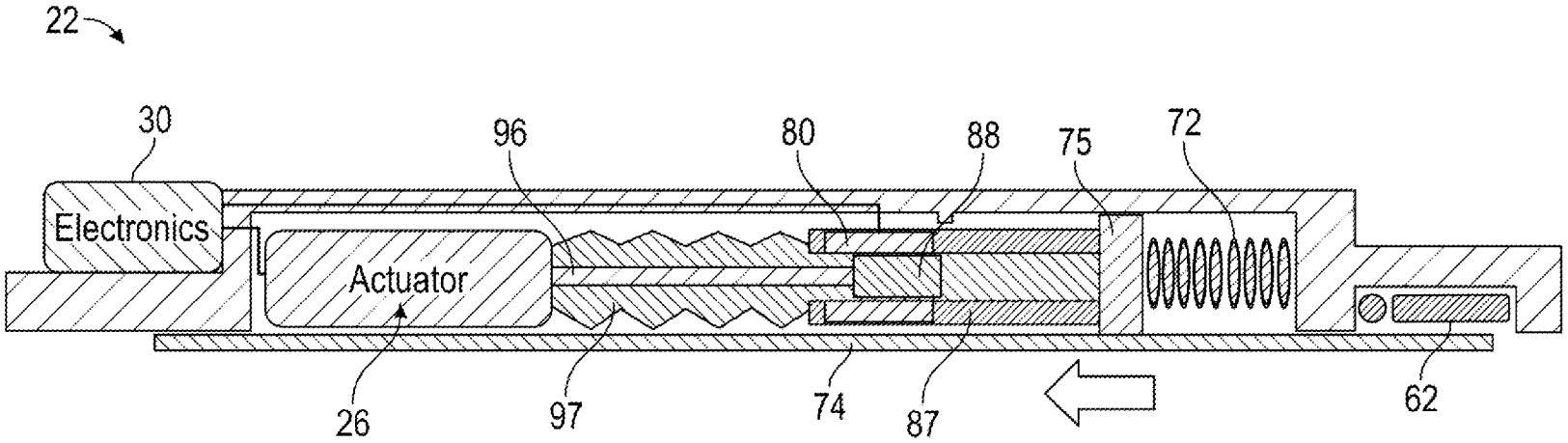
Figure 8F:
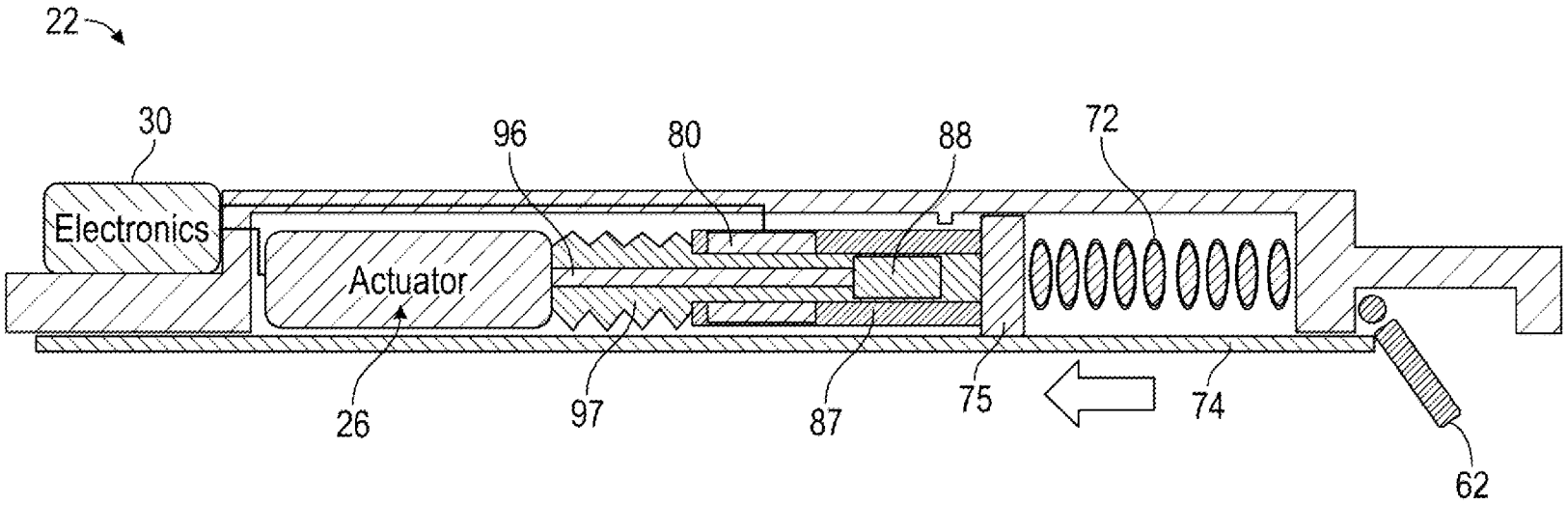

In FIG. 8D, the valve 22 is fully opened, the actuator 26 is in the fully expanded position (and the return spring 72 can be fully compressed and/or the internal tubing sleeve 74 can be shifted to hold open and protect the flapper 62), and the E-magnet 80 is kept activated. Continued activation of the E-magnet 80 can hold the internal tubing sleeve 74 in its shifted position (e.g., the position holding open and protecting the flapper 62, for example as shown in FIG. 8D). If the EMA 26 has enough holding force, the motor can be shut-in or powered down. The valve is monitored for EMA back-drive, and if back-drive is detected, the EMA 26 can be powered on and actuated to the proper shaft position. FIG. 8D illustrates the continuous or normal state of the eSV and actuator in full open mode.

Figure 8G:
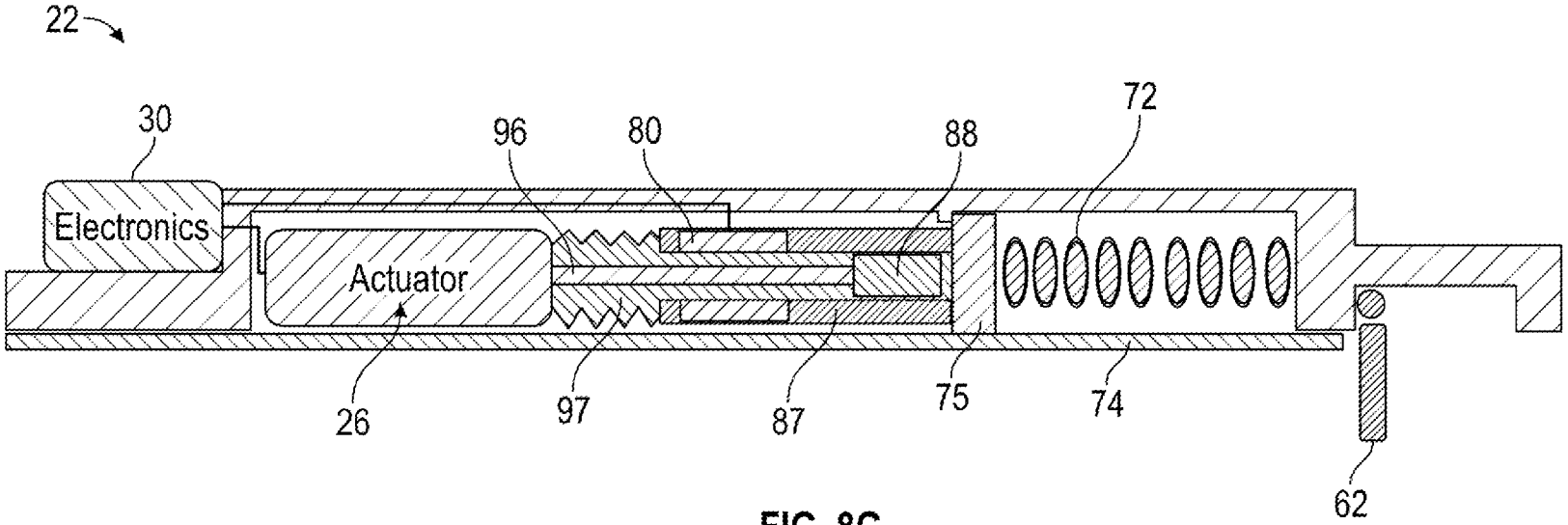
Figure 8H:
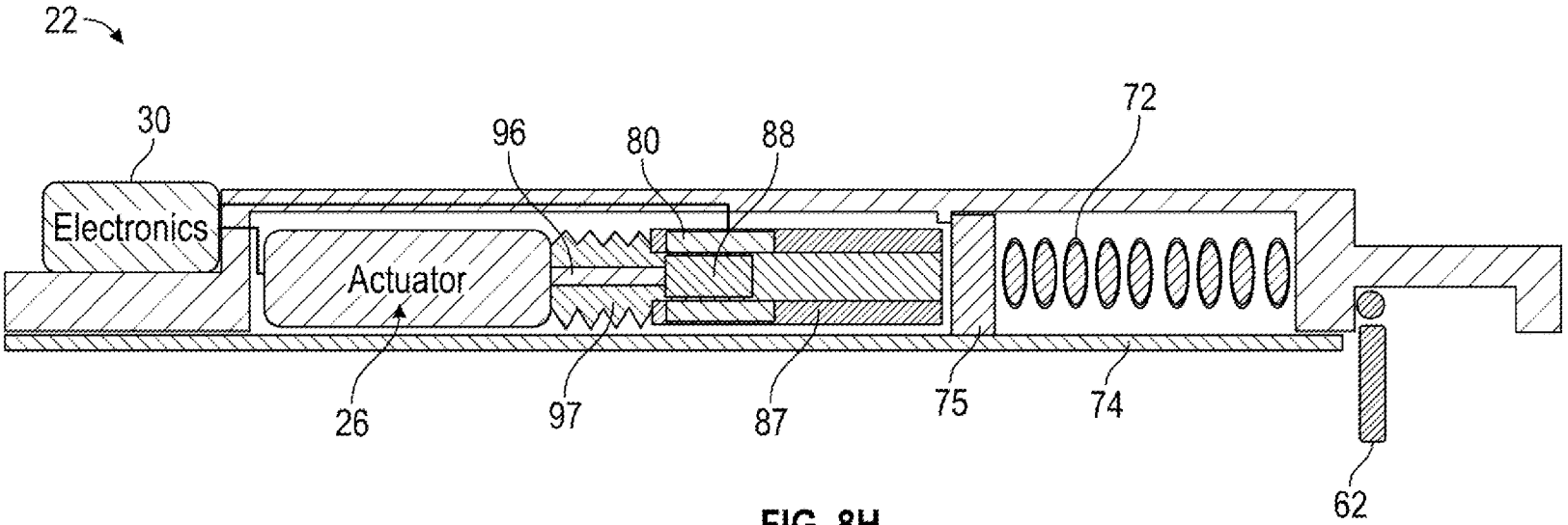

FIGS. 8E-8H show the valve closure mode via de-activation of the e-magnet 80. Closure mode can be triggered intentionally, for example for periodic testing of equipment, or automatically in the case of emergency or electrical shut-down (failsafe mode). De-activation of the E-magnet 80 releases the magnetic coupling with the piston 96, allowing the return spring 72 to expand, for example against the flange 75, and bias the internal sleeve 74 back to its original, closed position, and allowing the flapper 62 to close such that the valve is in a fully closed position or state (FIG. 8G). As the e-magnet 80 is magnetically decoupled from the actuator 26, and there is no mechanical link between the actuator 26 and the sleeve 74, the slam force is not transmitted to actuator shaft 96. In other words, the internal sleeve 74 can be retracted to its original, closed position without movement of or force on the actuator shaft 96, thereby avoiding or reducing the risk of damage in the event of slam closure. The piston 96 can then be retracted. FIG. 8H shows the valve fully closed with the actuator 26 (e.g., shaft or piston 96) retracted and monitored and the e-magnet 80 de-activated. The valve 22 can be re-opened by repeating the process shown in FIGS. 8A-8D.

In some configurations, a valve 22 or electro-mechanical coupling and/or disconnect according to the present disclosure includes features to provide a mechanical advantage to assist the holding force of the e-magnet 80 and magnet 88 (e.g., in the normal state of the valve in full open mode) and/or assist the transfer and application of axial load and linear movement from the piston 96 to the sleeve 74. The mechanical advantage can advantageously reduce the load on the magnets and/or allow the use of smaller magnets or lower power. A safety valve is installed in a well permanently, and may have a lifespan of, for example, more than 27 years. For the majority of this time, the safety valve flapper is held open. The powerful return spring 72 is pre-loaded so that if electrical power is lost the safety valve will slam closed. Therefore, enough electrical power must be supplied to keep this spring 72 compressed. Supplying this amount of power, over long distances, for example, several kilometers, for many years, consumes a lot of power. Additionally, high power systems need to be put in place to deliver the power. The present disclosure provides a low power mechanism to achieve the fail-safe functionality. Lower power electronics can be less expensive and/or more reliable over long periods of time in downhole hot environments.

The e-magnet and features providing a mechanical advantage form an electro-mechanical coupling. The electro-mechanical coupling can provide a coupling between two shafts, and can be used to overcome a heavy load to selectively couple the two shafts. For example, in configurations in which such an electro-mechanical coupling is included in a safety valve, the coupling can couple the actuator piston or shaft to the flow tube 74. Electro-mechanical couplings according to the present disclosure advantageously allow the coupling to hold a large load with a relatively small amount of power.

In some configurations, a valve 22 according to the present disclosure includes features providing a mechanical advantage, and the e-magnet 80 and magnet 88 (and potentially other components, such as the piston 96 and/or other components of the actuator 26) sealed (e.g., welded) in the same fluid zone or module. The combination of the sealed e-magnet 80 and magnet 88 zone with the mechanical advantage features can advantageously allow for smaller magnets and/or a greater holding force.

Figure 9:
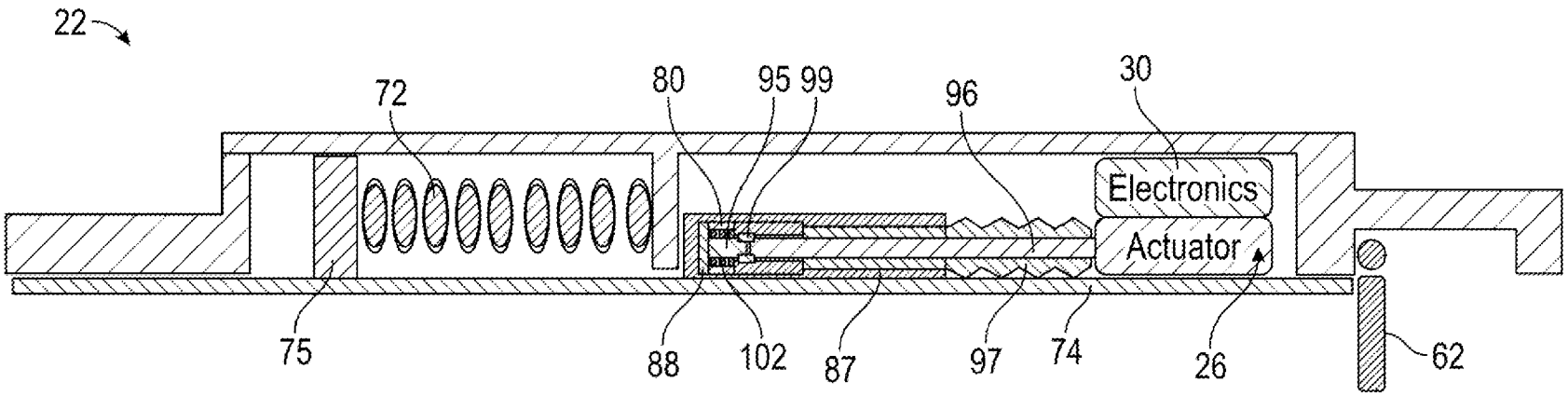
FIG. 9 schematically shows a partial longitudinal cross-section of another example downhole safety valve including a downhole electro-mechanical actuator and electro-magnet.
Figure 10:
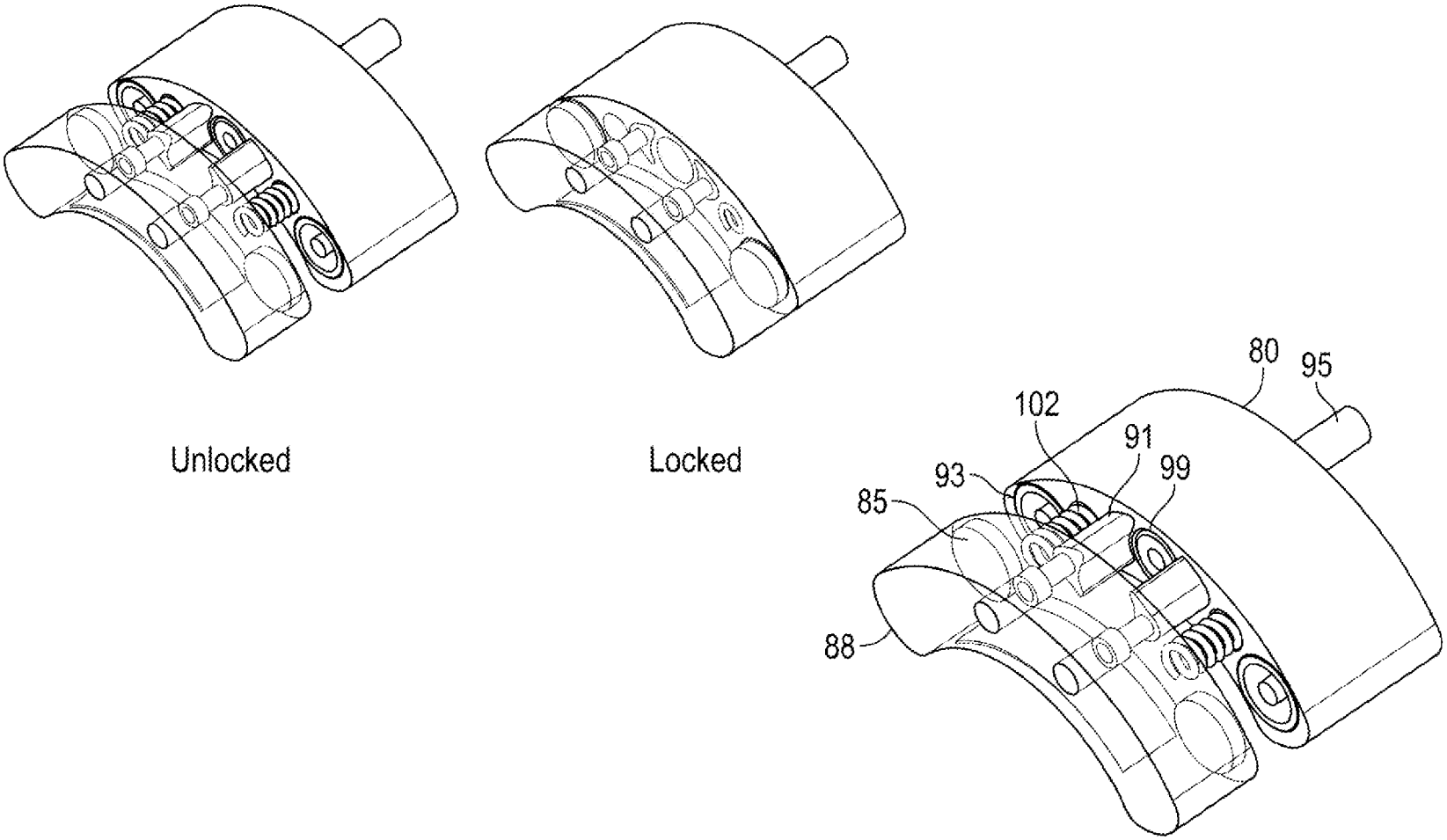
FIG. 10 schematically illustrates a portion of the safety valve of FIG. 9.

FIGS. 9-11H illustrate another example valve 22 according to the present disclosure. As shown in FIGS. 9 and 10, the actuator 26 includes an extendable or expandable piston or inner shaft 96. A stem 95 is positioned at and releasably coupled to an end of the piston 96. An electro-magnet 80 is disposed, e.g., mounted, on or about an end of the stem 95 (e.g., an end of the stem 95 opposite the end of the stem 95 releasably coupled to the piston 96). As shown in FIG. 10, the e-magnet 80 includes one or more electrical coils 93 disposed in or on an end face (e.g., a face or surface of the e-magnet 80 facing axially away from the stem 95 and piston 96) of the e-magnet 80. The e-magnet 80 also includes a mechanical collet 99 and one or more locking sleeves 91. One or more release springs 102 are disposed in cavities or recesses in the end face. A magnet component or yoke 88 is disposed or positioned adjacent or proximate the end face of the e-magnet 80. As shown, the yoke 88 includes one or more magnet permeable base plates 85, which may correspond or be complementary to the coils of the e-magnet 80. The locking sleeves 91 can be coupled or fixed to the yoke 88.

In use, the e-magnet 80, e.g., the coils 93 of the e-magnet 80, is used to lock the collet 99. The coils 93 must have enough force to compress the release spring(s) 102. As shown in FIG. 10, in a locked configuration, e.g., with the e-magnet 80 activated, the locking sleeves 91 and release springs 102 are retracted or compressed into cavities in the e-magnet 80. The locking sleeves 91 hold the collet 99 in a locked position to lock the stem 95 to the piston 96. The yoke 88 may be in contact with the end face of the e-magnet 80. In an unlocked configuration, e.g., with the e-magnet 80 deactivated, the release springs 102 expand against the yoke 88, thereby pushing the yoke 88 away from the e-magnet 80 as shown in FIG. 10. As the locking sleeves 91 are fixed to the yoke 88, movement of the yoke 88 away from the e-magnet 80 pulls the locking sleeves at least partially out of the cavities in the e-magnet 80, thereby releasing the collet 99 and decoupling the stem 95 from the piston 96.

As shown in FIG. 9, a tube or sliding shaft 87 can surround the e-magnet 80, stem 95, and a portion of the piston 96. The yoke 88 can be coupled to and/or disposed within the tube 87. The tube 87 and/or flange 75 can be coupled to the sleeve 74. In the illustrated configuration, a cover 97, e.g., a bellows or corrugated sheath, surrounds a portion of the piston 96 and extends between the body of the actuator 26 and the tube 87. In other words, the tube 87 is connected to the actuator 26 housing by bellows 97. The tube 87, and in some configurations the bellows 97, can be filled with clean oil. The e-magnet 80 and/or magnet 88 can be fully sealed, e.g., by the covers 87, 97, and welded to advantageously protect against debris and wellbore fluids. As described above with respect to the embodiment of FIGS. 4 and 7-8H, sealing and welding the e-magnet 80 and magnet 88 in the same fluid zone or module can allow the gap between the e-magnet 80 and magnet 88 to be reduced, minimized, or eliminated, which advantageously can allow for increased holding force or the use of smaller magnets.

The locking sleeves 91 and/or collet 99 provide a mechanical advantage to assist the magnet holding force and/or transfer of axial load and movement in use. The magnets therefore only require enough force to compress the smaller release spring(s) 102 rather than the larger return spring 72, thereby allowing the use of smaller magnets. When the e-magnet 80 is activated, the force between the e-magnet 80 and yoke 88 compresses the release spring(s) 102 and pulls the e-magnet 80 and yoke 88 into contact, such that the locking sleeves 91 are retracted into cavities in the e-magnet 80 and hold the collet 99 in the locked position to lock the stem 95 to the piston 96. The mechanical lock of the collet 99 and locking sleeves 91 allows axial motion of the piston 96 to be transferred to axial motion of the yoke 88 and therefore the sleeve 74. When the e-magnet 80 is deactivated, the release spring(s) 102 expand, pulling the locking sleeves 91 out of the e-magnet 80 and releasing the collet 99 and therefore the stem 95 from the piston 96.

Figure 11A:
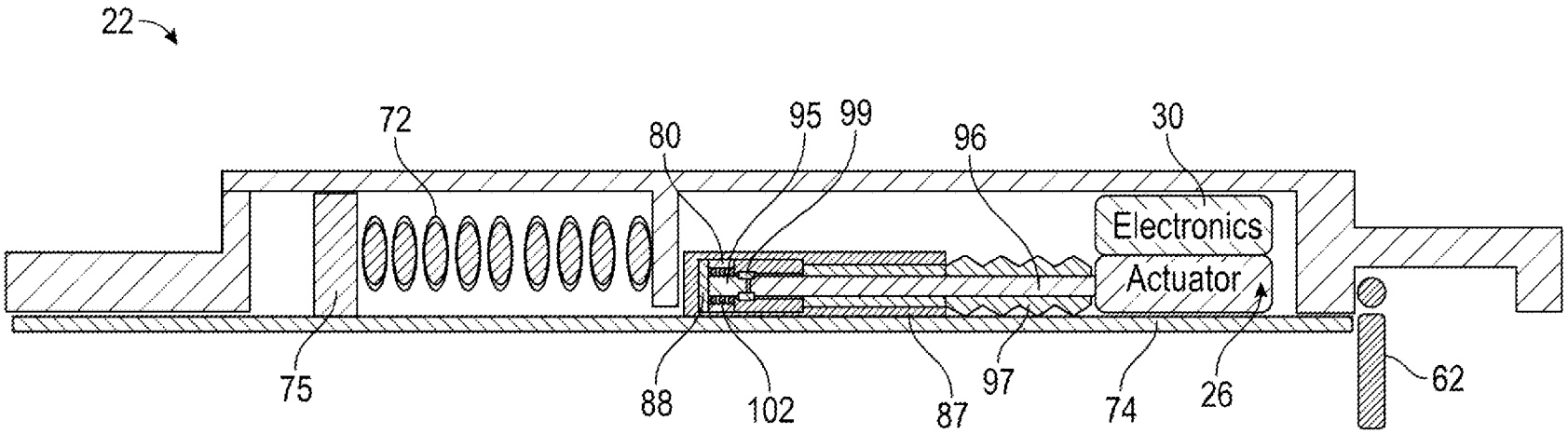
FIGS. 11A-11H schematically illustrate operation of the safety valve of FIG. 9.
Figure 11B:
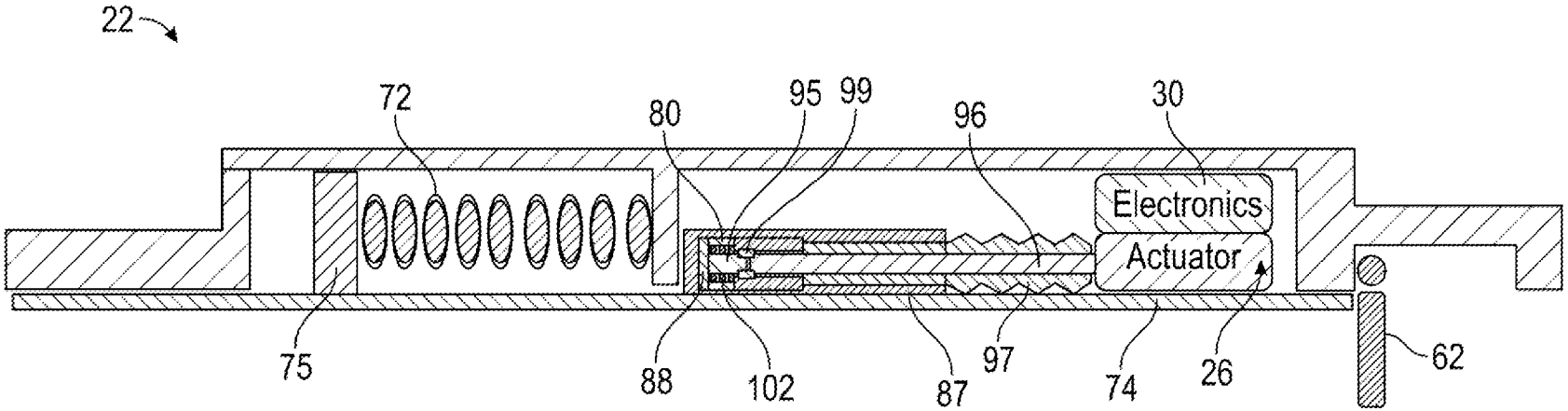

FIGS. 11A-11H schematically illustrate operation of safety valves according to the present disclosure, such as the valve of FIG. 9. FIG. 11A shows the valve in a closed position, with the actuator 26 in a fully extended position and the e-magnet 80 not activated. The actuator 26 can be not powered, or powered only for monitoring. In FIG. 11B, the e-magnet 80 is activated to prepare the actuator 26 for actuation and initialize the valve opening sequence. E-magnet 80 activation establishes a magnetic coupling between the e-magnet 80 and magnet 88. In some configurations, E-magnet 80 activation can also establish a coupling between movement of the piston 96 and movement of the tube 87 and/or sleeve 74.

Figure 11C:
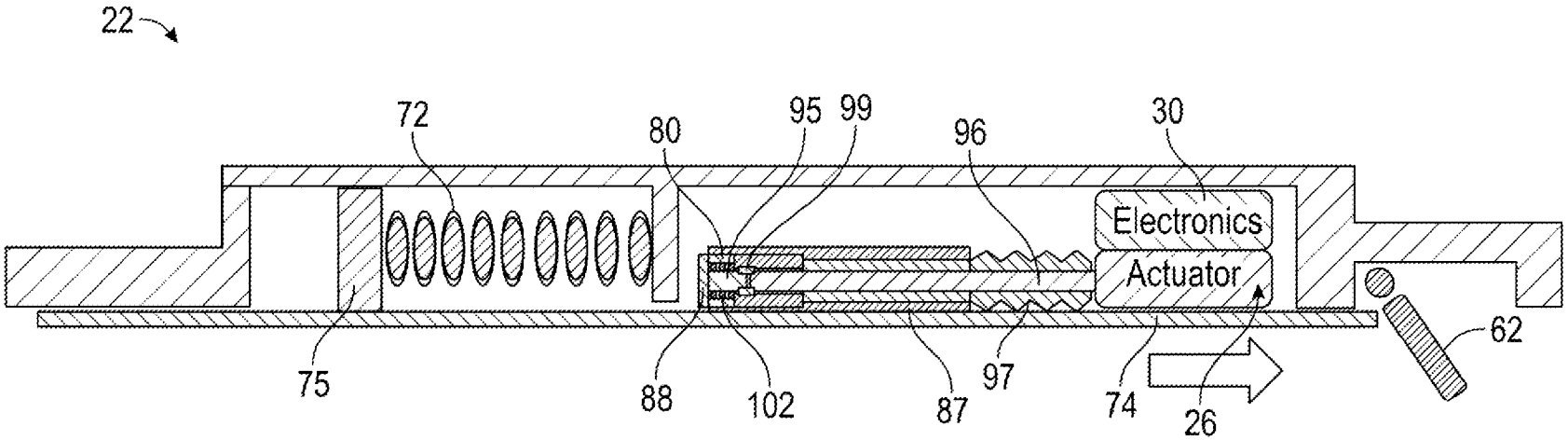

FIG. 11C shows the valve opening, for example in response to a command from the surface to the downhole electronics 30. As shown, the E-magnet 80 is activated and the actuator 26 (e.g., the piston or shaft 96) is retracting. Retraction of the actuator 26 (e.g., the piston or shaft 96) causes linear motion of the tube 87. The tube 87 in turn shifts the sleeve 74 and therefore the flange 75, thereby compressing the return spring 72. The internal tubing sleeve 74 moves toward, into contact with, and/or past the flapper 62 to open the flapper 62. As the piston 96 and/or tube 87 move linearly while the actuator body 26 remains stationary, the bellows 97 can contract.

Figure 11D:
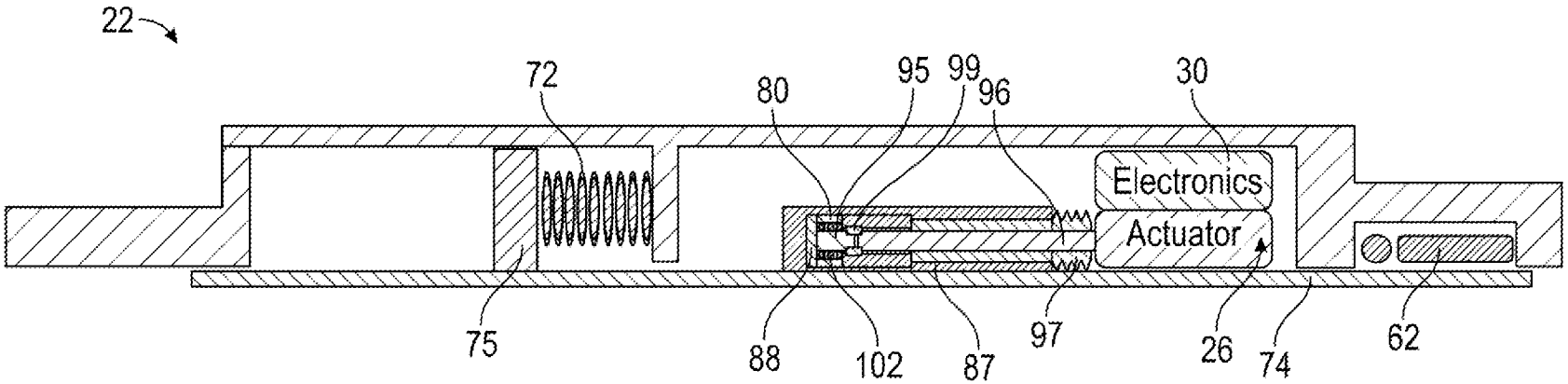
Figure 11E:
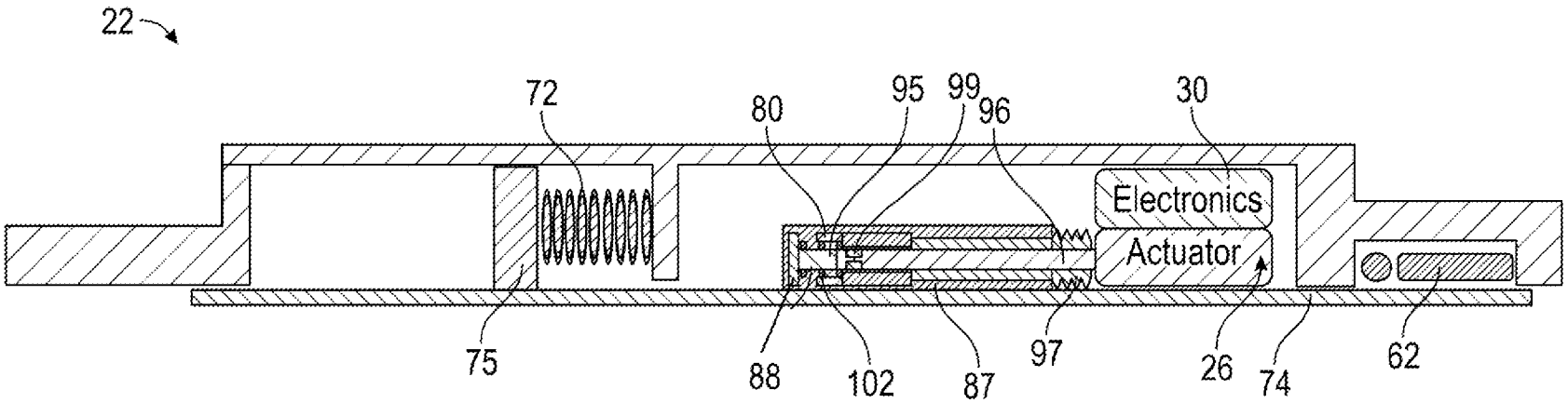
Figure 11F:
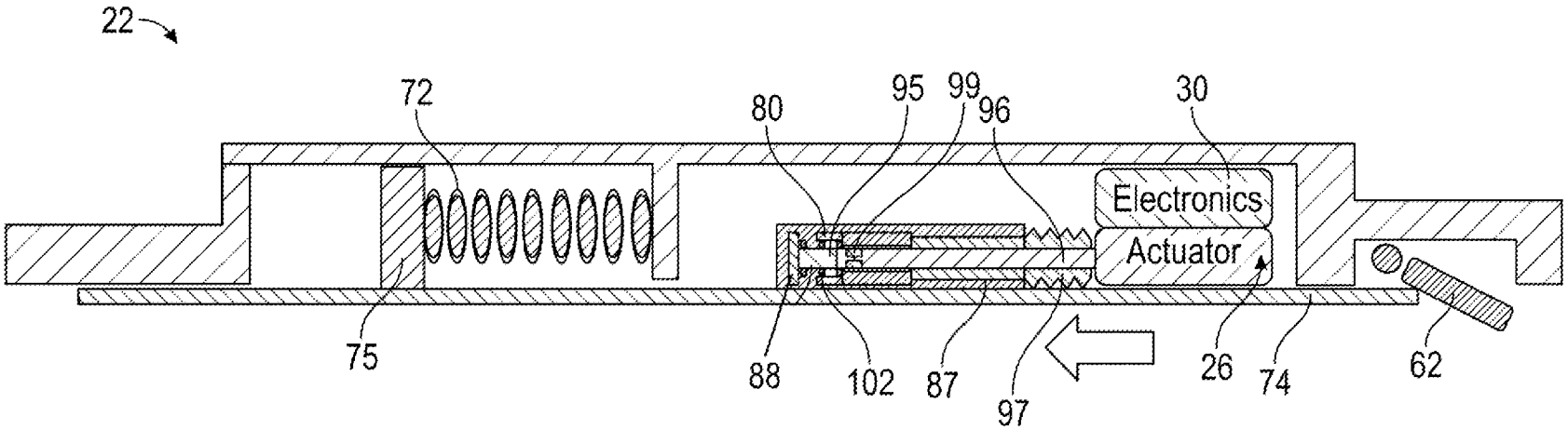

In FIG. 11D, the valve 22 is fully opened, the actuator 26 is in the fully contracted position (and the return spring 72 can be fully compressed and/or the internal tubing sleeve 74 can be shifted to hold open and protect the flapper 62), and the E-magnet 80 is kept activated. Continued activation of the E-magnet 80 can hold the internal tubing sleeve 74 in its shifted position (e.g., the position holding open and protecting the flapper 62, for example as shown in FIG. 11D). If the EMA 26 has enough holding force, the motor can be shut-in or powered down. The valve is monitored for EMA back-drive, and if back-drive is detected, the EMA 26 can be powered on and actuated to the proper shaft position. FIG. 11D illustrates the continuous or normal state of the eSV and actuator in full open mode. The magnet holding force between the e-magnet 80 and magnet 88 is strong enough to keep the release springs 102 compressed and the collet 99 locked. The holding force of the locked collet 99 is sufficient to compress the spring 72.

Figure 11G:
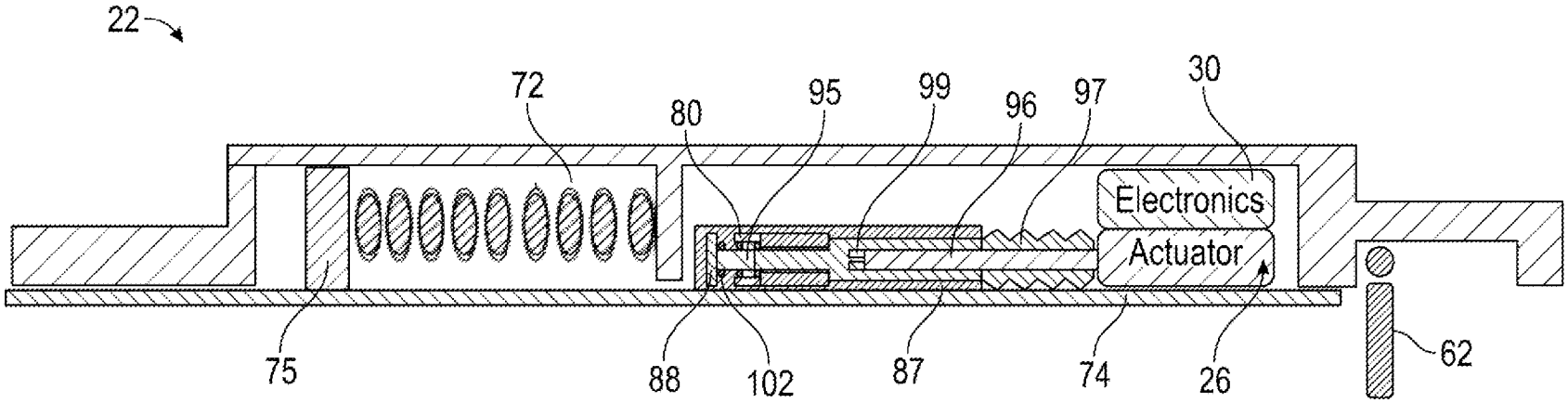

FIGS. 11E-11H show the valve closure mode via de-activation of the e-magnet 80. Closure mode can be triggered intentionally, for example for periodic testing of equipment, or automatically in the case of emergency or electrical shut-down (failsafe mode). De-activation of the E-magnet 80 releases the magnetic coupling between the E-magnet 80 and yoke 88 and allows the release spring(s) 102 to expand. The release springs 102 push the yoke 88 away, thereby moving the locking sleeve 91 out of its cavity and releasing the collet 99 such that the stem 95, and therefore the E-magnet 80, are released from the piston 96. The spring 72 is therefore able to expand, for example against the flange 75, and bias the internal sleeve 74 back to its original, closed position, allowing the flapper 62 to close such that the valve is in a fully closed position or state (FIG. 11G).

Figure 11H:
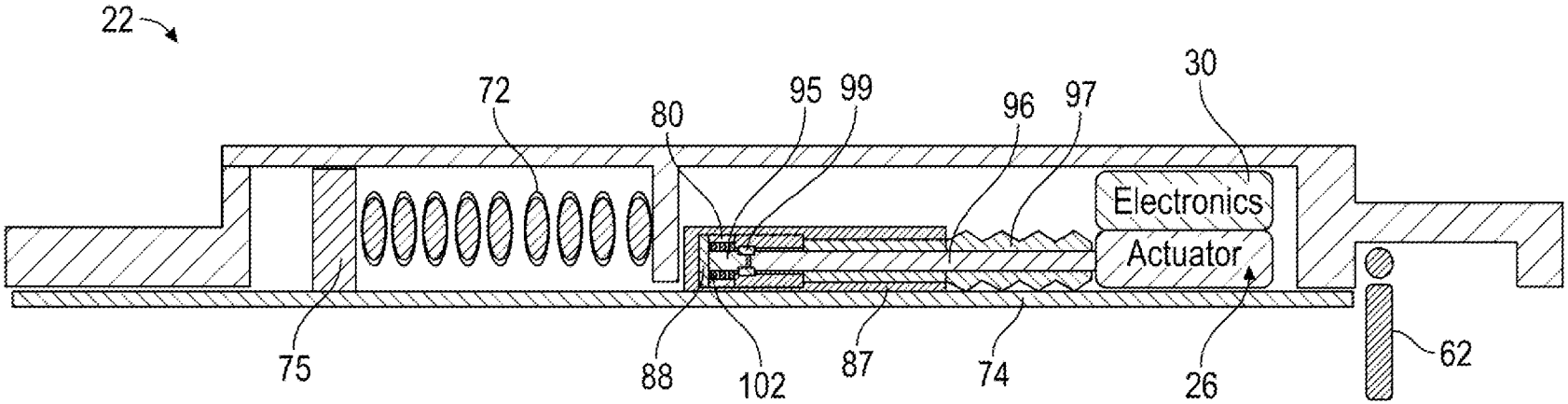

As the e-magnet 80 is magnetically decoupled from the actuator 26, and there is no mechanical link between the actuator 26 and the sleeve 74, the slam force is not transmitted to actuator shaft 96. In other words, the internal sleeve 74 can be retracted to its original, closed position without movement of or force on the actuator shaft 96, thereby avoiding or reducing the risk of damage in the event of slam closure. The piston 96 can then be extended to realign and/or couple with the stem 95. FIG. 11H shows the valve fully closed with the actuator 26 (e.g., shaft or piston 96) extended and monitored and the e-magnet 80 de-activated. The valve 22 can be re-opened by repeating the process shown in FIGS. 11A-11D.

Figure 12:
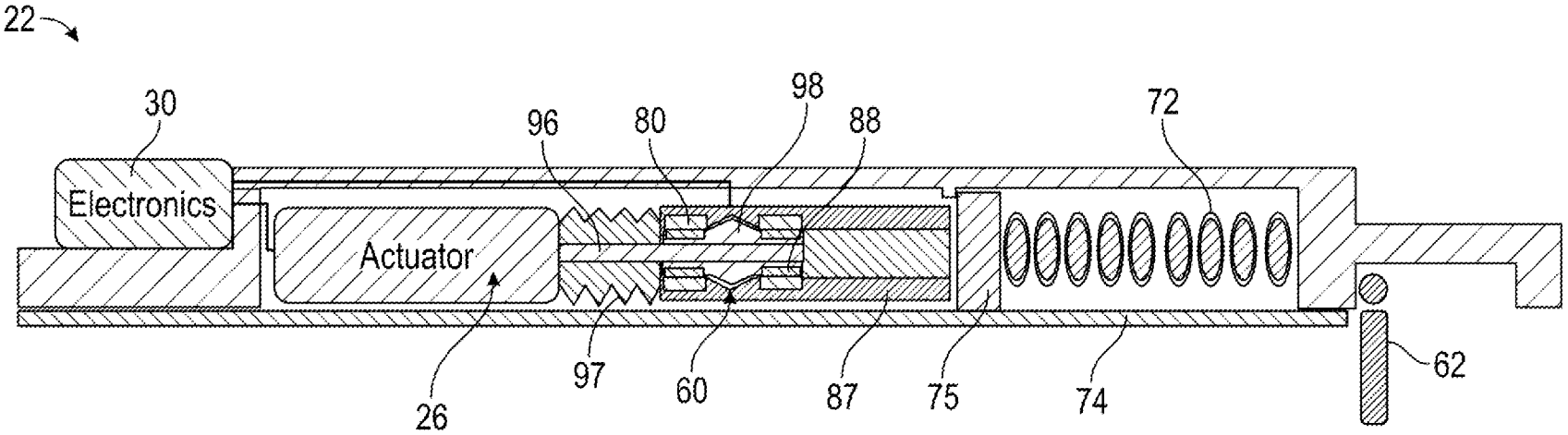
FIG. 12 schematically shows a partial longitudinal cross-section of another example downhole safety valve including a downhole electro-mechanical actuator and electro-magnet.
Figure 13A:
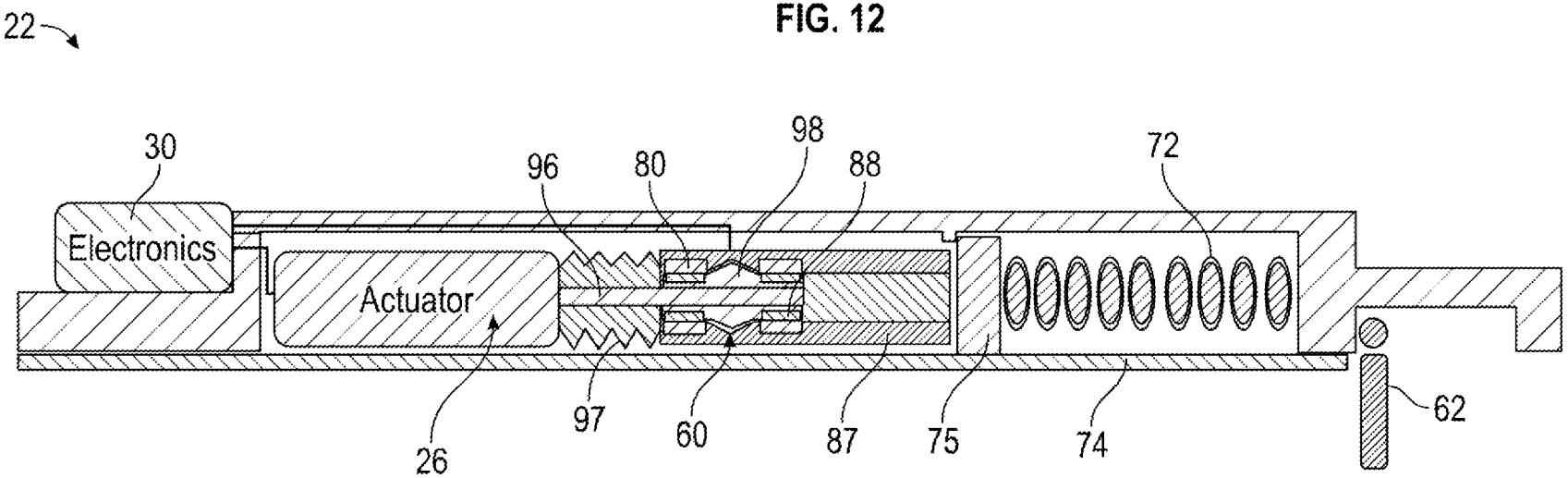
FIGS. 13A-13H schematically illustrate operation of the safety valve of FIG. 12.
Figure 13B:
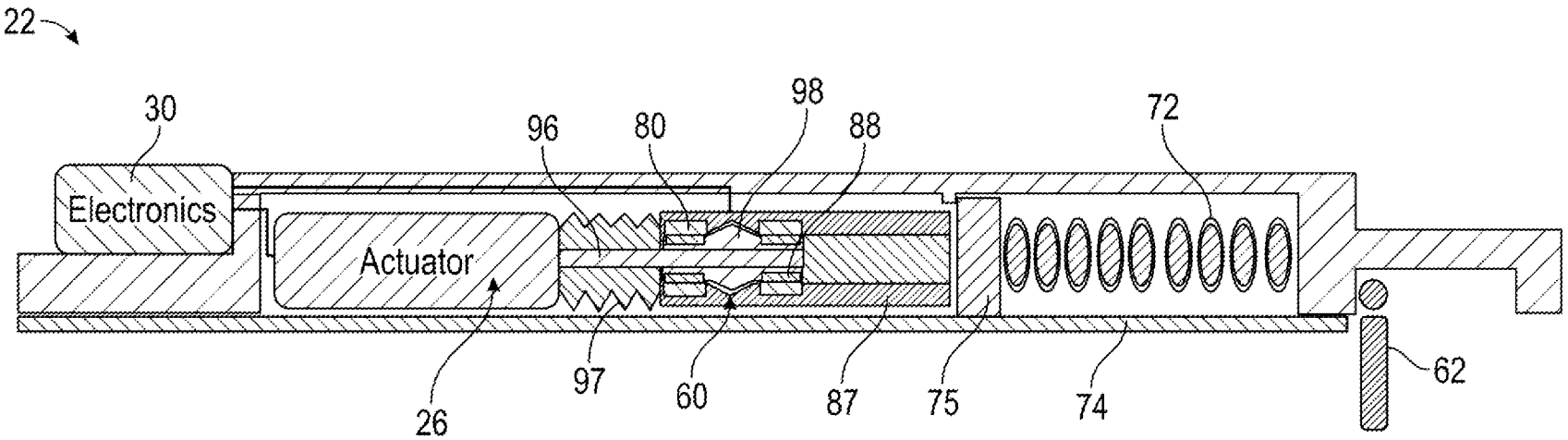
Figure 13C:
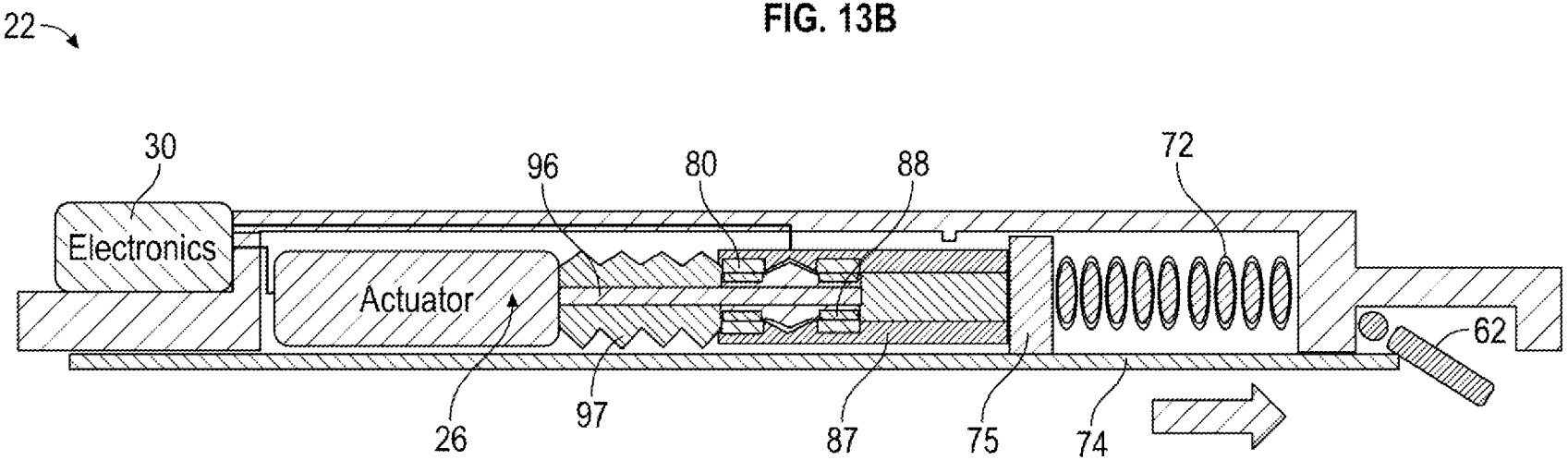
Figure 13D:
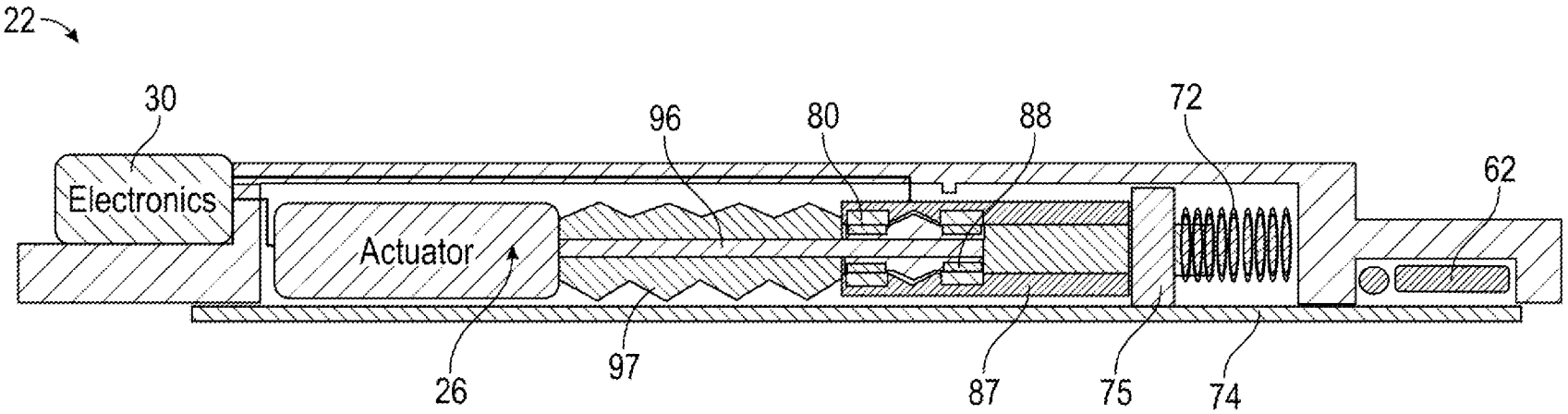
Figure 13E:
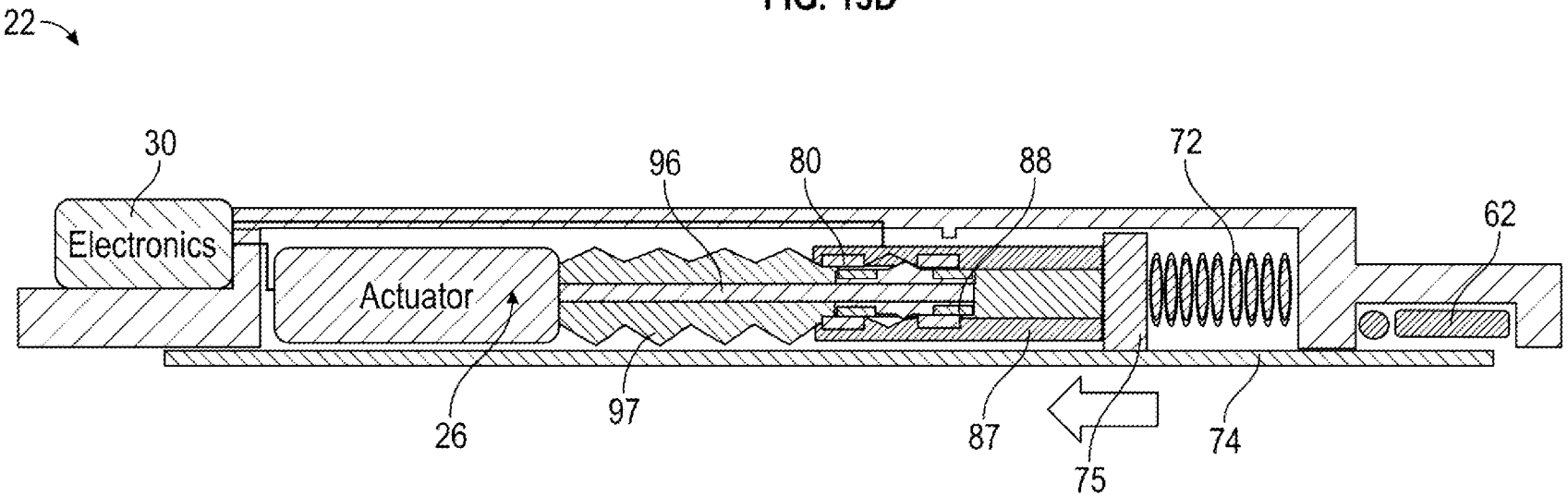
Figure 13F:
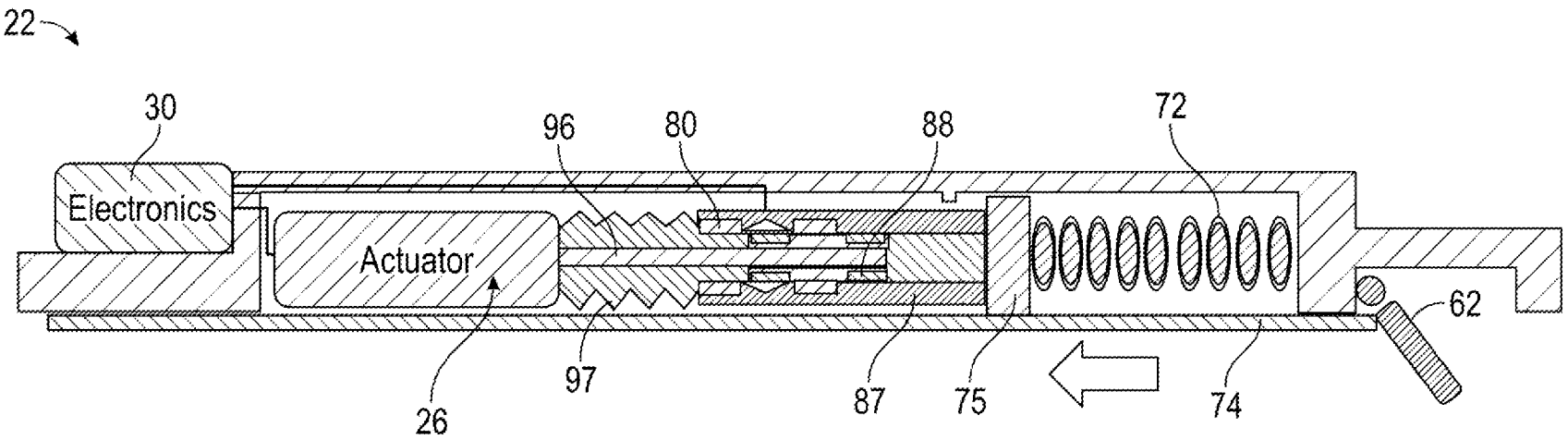
Figure 13G:
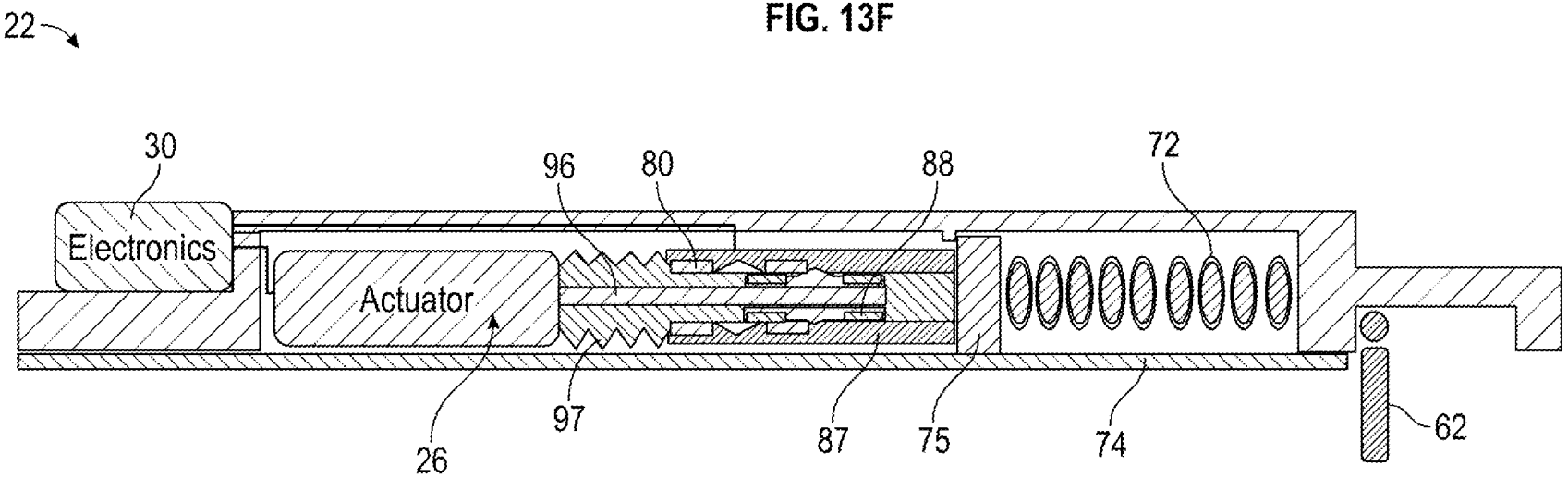
Figure 13H:
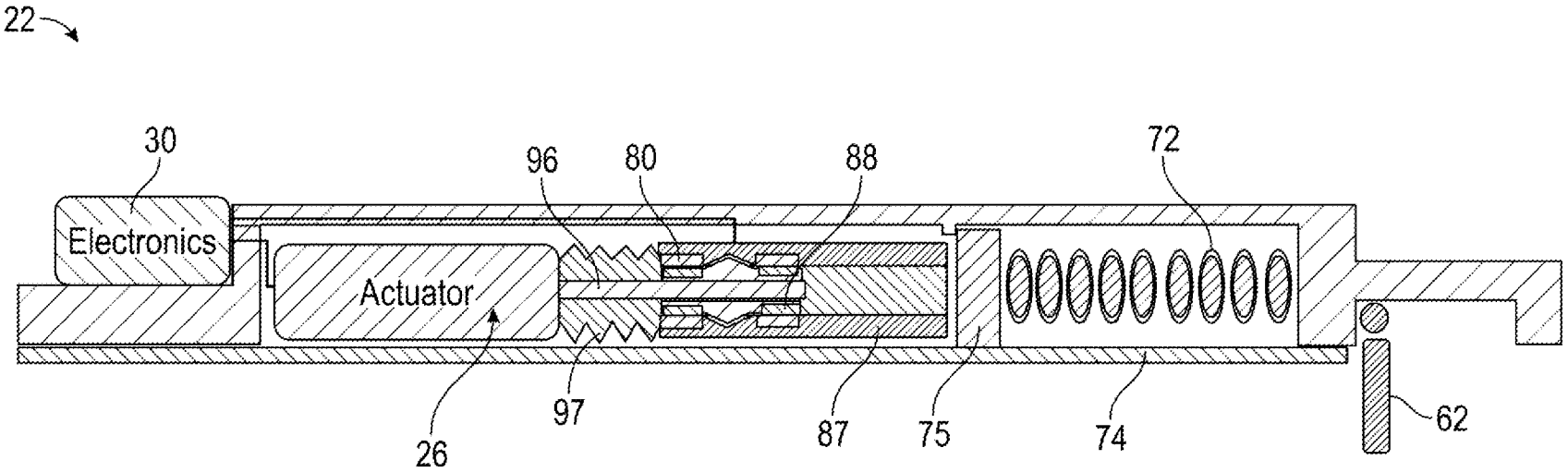

FIGS. 12-13H illustrate another example valve 22 according to the present disclosure. As shown in FIG. 12, the actuator 26 includes an extendable or expandable piston or inner shaft 96. One or more magnets 88, e.g., a permanent magnet or magnet steel portion, is positioned at, about, and/or proximate and operably coupled to an end of the piston 96. In the illustrated configuration, the magnet(s) 88 are coupled to a central piece 98, which in the configuration of FIG. 12 is coupled to the piston 96. A tube or sliding shaft 87 can surround the central piece 98, magnet(s) 88, and a portion of the piston 96. The tube 87 extends into contact with the flange 75. In the illustrated configuration, a cover 97, e.g., a bellows or corrugated sheath, surrounds a portion of the piston 96 and extends between the body of the actuator 26 and the tube 87. In other words, the tube 87 is connected to the actuator 26 housing by bellows 97. The tube 87, and in some configurations the bellows 97, can be filled with clean oil.

One or more e-magnets 80 is disposed, e.g., mounted, on or in a portion of the tube 87. In a closed position of the safety valve assembly 22, for example as shown in FIG. 12, the e-magnet(s) 80 are aligned, e.g., radially aligned, with the magnet(s) 88. In use, as described in further detail herein, the shaft 96 and magnet(s) 88 can move axially, e.g., extend or expand and retract or contract, within the tube 87. In alternative configurations, the e-magnet(s) 80 can be disposed on or at the end of the shaft 96, and the magnet(s) 88 can be disposed on or in the tube 87 surrounding the e-magnet(s) 80. The e-magnet(s) 80 and/or magnet(s) 88 can be fully sealed, e.g., by the covers 87, 97, and welded to advantageously protect against debris and wellbore fluids.

FIGS. 13A-13H schematically illustrate operation of example safety valves according to the present disclosure, such as the valve of FIG. 12. FIG. 13A shows the valve in a closed position, with the actuator 26 in a fully retracted position and the e-magnet 80 not activated. The actuator 26 can be not powered, or powered only for monitoring. In FIG. 13B, the e-magnet 80 is activated to prepare the actuator 26 for actuation and initialize the valve opening sequence. E-magnet 80 activation establishes a magnetic coupling between the e-magnet 80 and magnet 88. In some configurations, E-magnet 80 activation can also establish a coupling between movement of the piston 96 and movement of the tube 87 and/or sleeve 74.

FIG. 13C shows the valve opening, for example in response to a command from the surface to the downhole electronics 30. As shown, the E-magnet 80 is activated and the actuator 26 (e.g., the piston or shaft 96) is extending. Due to the magnetic coupling between the magnet 88 of the piston 96 and the e-magnet 80 of the tube 87, extension of the actuator 26 (e.g., the piston or shaft 96) causes linear motion of the tube 87. The tube 87 in turn shifts the flange 75, thereby compressing the return spring 72. Due to the magnetic connection between the piston 96 and the tube 87, and the tube 87 contacting and moving the flange 75, extension of the actuator 26 (e.g., piston or shaft 96) also moves the internal tubing sleeve 74, toward, into contact with, and/or past the flapper 62 to open the flapper 62. As the tube 87 moves linearly while the actuator body 26 remains stationary, the bellows 97 can expand.

In FIG. 13D, the valve 22 is fully opened, the actuator 26 is in the fully expanded position (and the return spring 72 can be fully compressed and/or the internal tubing sleeve 74 can be shifted to hold open and protect the flapper 62), and the E-magnet 80 is kept activated. Continued activation of the E-magnet 80 can hold the internal tubing sleeve 74 in its shifted position (e.g., the position holding open and protecting the flapper 62, for example as shown in FIG. 7D). If the EMA 26 has enough holding force, the motor can be shut-in or powered down. The valve is monitored for EMA back-drive, and if back-drive is detected, the EMA 26 can be powered on and actuated to the proper shaft position. FIG. 13D illustrates the continuous or normal state of the eSV and actuator in full open mode.

FIGS. 13E-13H show the valve closure mode via de-activation of the e-magnet 80. Closure mode can be triggered intentionally, for example for periodic testing of equipment, or automatically in the case of emergency or electrical shut-down (failsafe mode). De-activation of the E-magnet 80 releases the magnetic coupling with the piston 96, allowing the return spring 72 to expand, for example against the flange 75, and bias the internal sleeve 74 back to its original, closed position, and allowing the flapper 62 to close such that the valve is in a fully closed position or state (FIG. 13G).

As the e-magnet 80 is magnetically decoupled from the actuator 26, and there is no mechanical link between the actuator 26 and the sleeve 74, the slam force is not transmitted to actuator shaft 96. In other words, the internal sleeve 74 can be retracted to its original, closed position without movement of or force on the actuator shaft 96, thereby avoiding or reducing the risk of damage in the event of slam closure. The piston 96 can then be retracted. FIG. 13H shows the valve fully closed with the actuator 26 (e.g., shaft or piston 96) retracted and monitored and the e-magnet 80 de-activated. The valve 22 can be re-opened by repeating the process shown in FIGS. 13A-13D.

The safety valve configuration of FIG. 12 includes one or more corresponding and interlocking teeth or shoulders 60 on or in a radial outer surface of the central piece 98 and a radial inner surface of the tube 87. When the e-magnets 80 are activated in use, the magnetic attraction of the e-magnets 80 can pull the magnets 80 toward and/or into contact with the e-magnets 80. The radial displacement of the magnets 88 and/or central piece 98 outward toward the e-magnets 80 and/or tube 87 causes engagement of the corresponding teeth or shoulders 60. The engagement and/or friction force of the teeth or shoulders 60 provides a mechanical advantage or an additional radial load to enhance the magnetic radial load provided by the activated e-magnets 80. The enhanced radial load advantageously helps transfer and apply axial load such that axial movement of the piston 96 and central piece 98 can cause axial movement of the tube 87 and therefore sleeve 74 when the e-magnets 80 are activated and the piston 96 is in motion, and such that axial movement of the tube 87 can be resisted against the force of the return spring 72 to hold the valve open in the normal state of the eSV in full open position (shown in FIG. 13D). When the E-magnets 80 are de-activated, the magnetic radial load is lost, and the teeth or shoulders 60 are no longer held in engagement, and relative axial movement between the central piece 98 and the tube 87 is permitted.

Figure 14:
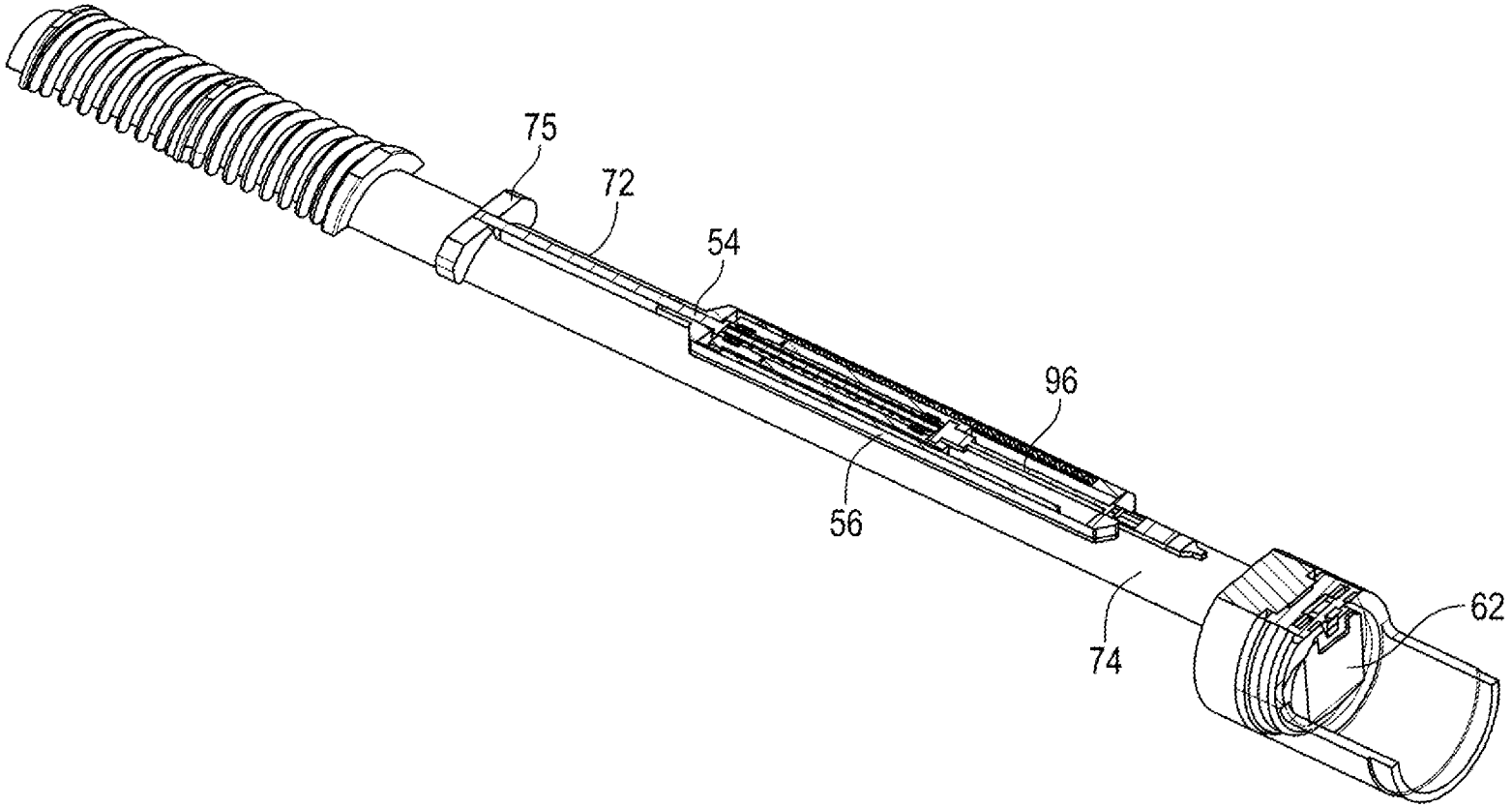
FIG. 14 shows a partial perspective view of another example downhole safety valve including a downhole electro-mechanical actuator and electro-magnet.
Figure 15A:
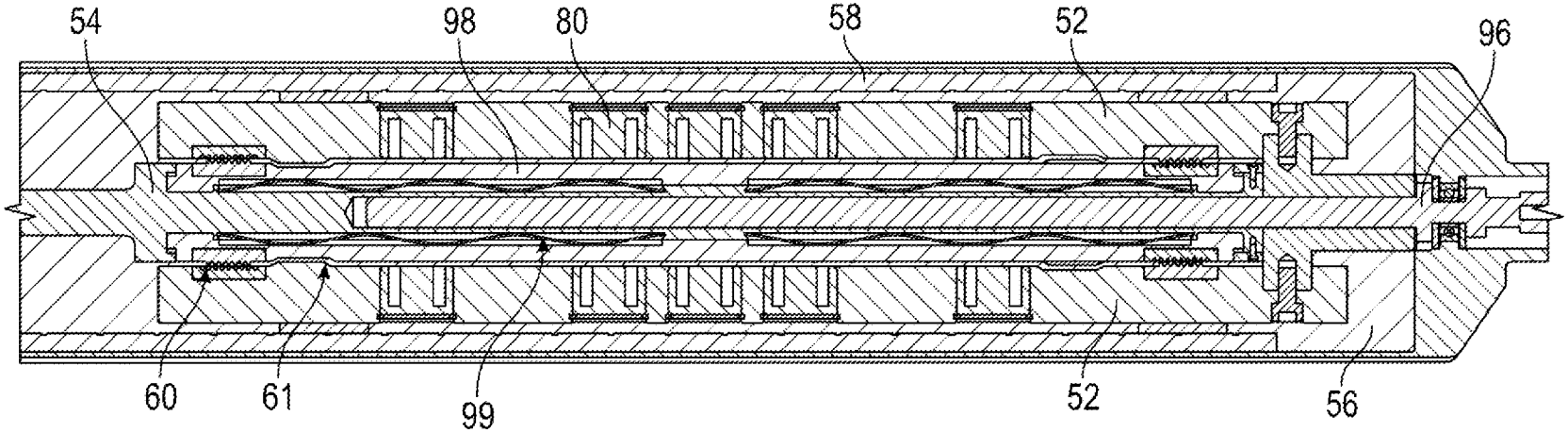
FIG. 15A illustrates a portion of the safety valve of FIG. 14 including an electro-magnetic disconnect system.
Figure 15B:
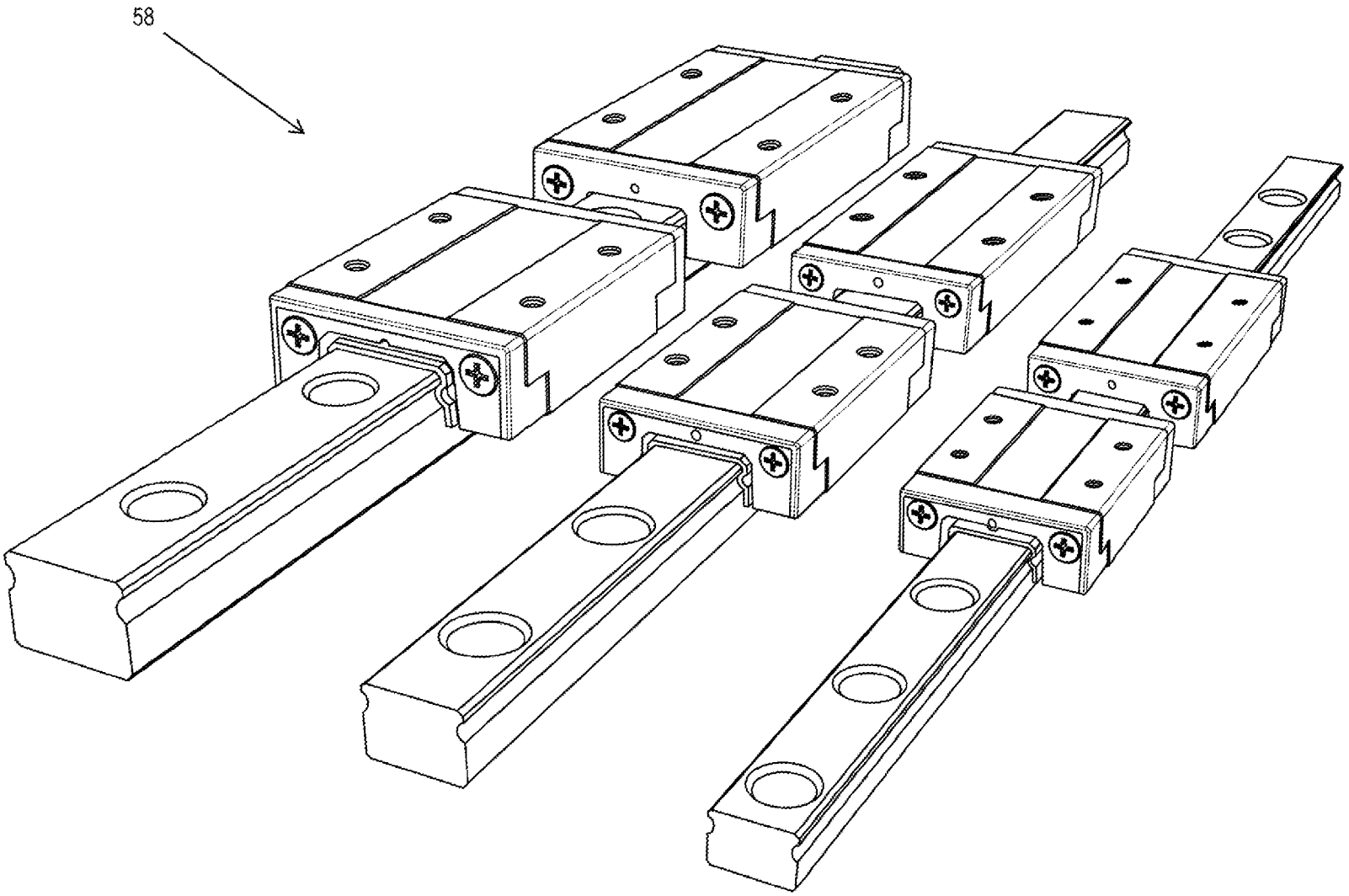
FIG. 15B illustrates example guide rails that can be included in the electro-magnetic disconnect system of FIG. 15A.
Figure 15C:
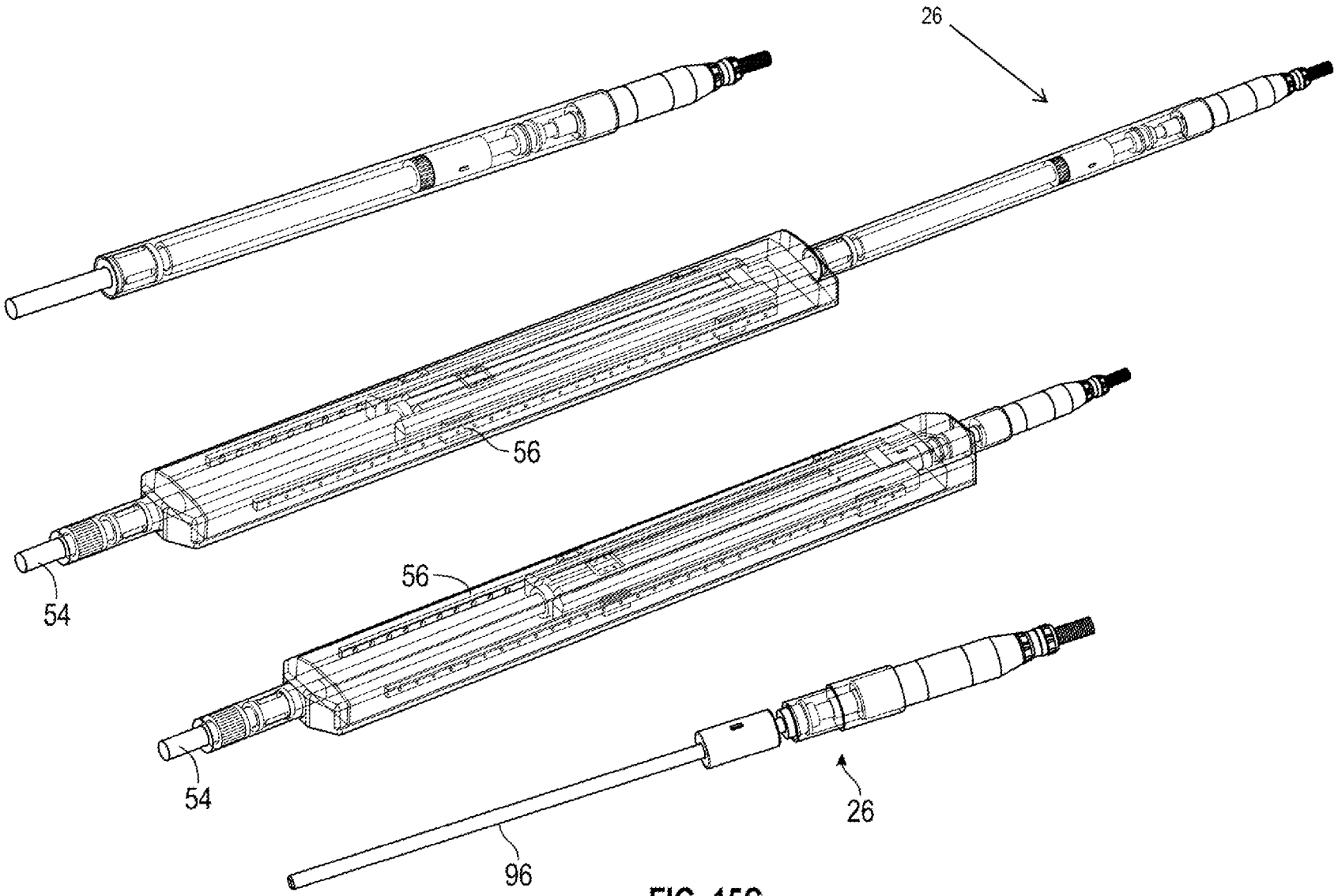
FIG. 15C illustrates the electro-magnetic disconnect system of the safety valve of FIG. 14.

FIG. 14 illustrates another example configuration of a safety valve 22 according to the present disclosure. In this configuration, the E-magnet(s) 80 are operably coupled to the actuator shaft 96. As also shown in FIG. 15A, E-magnets 80 can be disposed on both sides or tines of a dual-tined fork 52 that is coupled to the actuator shaft 96. The magnet(s) 88 are disposed in or on or incorporated into a central piece 98 that is disposed between the tines of the fork 52 and axially movable relative to the fork 52. In other configurations, the E-magnets 80 can be disposed in or on or incorporated into the central piece 98, and the magnets 88 can be disposed on the fork 52. The central piece 98 is coupled to a yoke shaft 54, which in turn is coupled to the flange 75. The fork 52 and central piece 98 can be disposed within a housing 56. In some configurations, the housing 56 includes guide rails 58, for example like those shown in FIG. 15B, along which the fork 52 can move in use. The spring 72 can be disposed about a portion of the yoke shaft 54 and disposed axially between the flange 75 and the housing 56. The actuator can be disposed at or near an axial end of the housing 56 closer to the flapper 62. FIG. 15C illustrates various views of the actuator 26, housing 56, and yoke shaft 54.

Figure 16A:
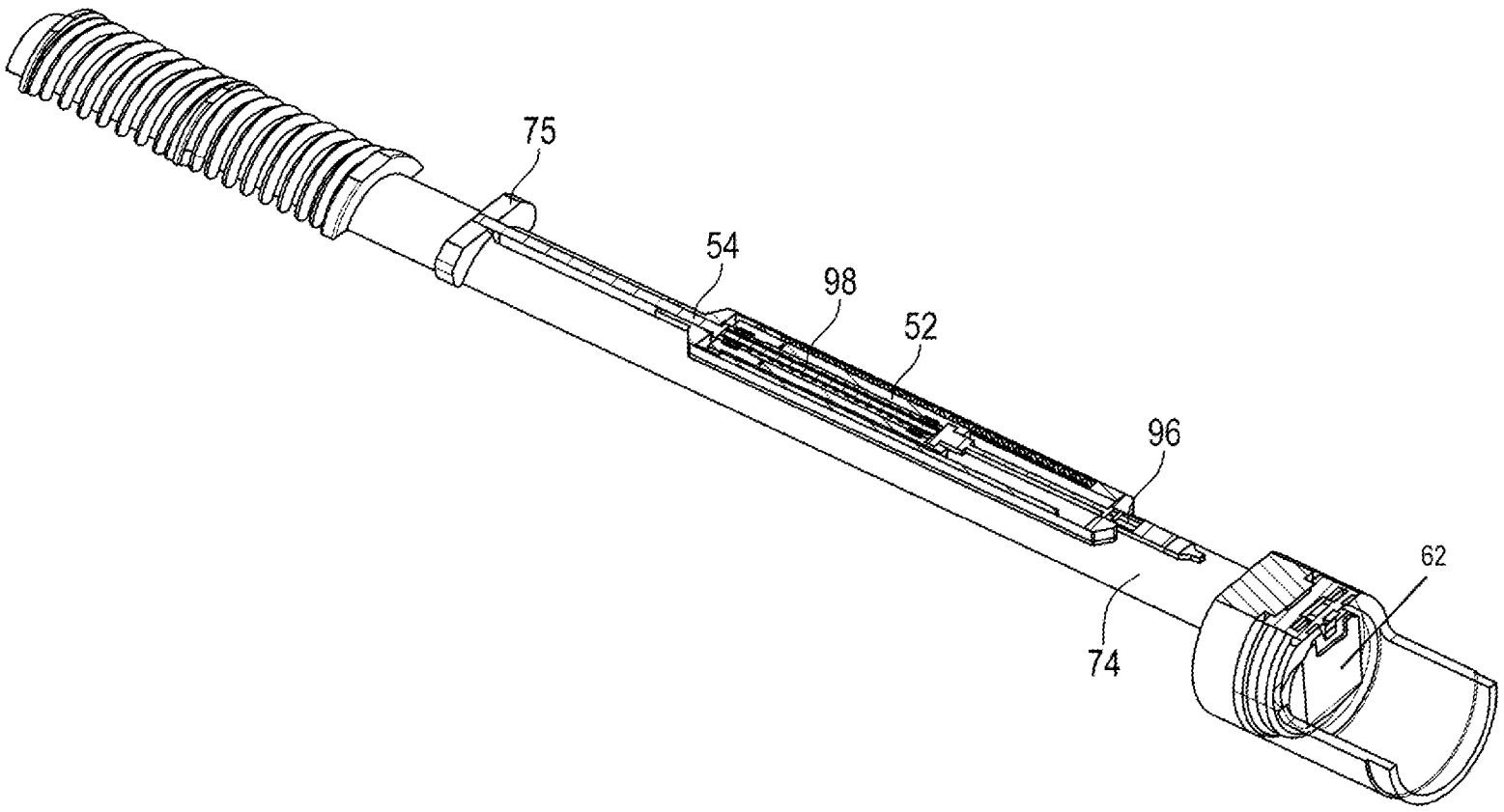
FIGS. 16A-16G illustrate operation of the safety valve of FIG. 14.

FIGS. 16A-16G schematically illustrate operation of example safety valves according to the present disclosure, such as the valve of FIG. 14. FIG. 16A shows the valve in a closed position, with the actuator 26 in a fully extended position. The actuator 26 can be not powered, or powered only for monitoring. The e-magnet 80 is activated to prepare the actuator 26 for actuation and initialize the valve opening sequence. E-magnet 80 activation establishes a magnetic coupling between the e-magnet 80 and magnet 88. In some configurations, E-magnet 80 activation can also establish a coupling between movement of the piston 96 and movement of the sleeve 74.

Figure 16B:
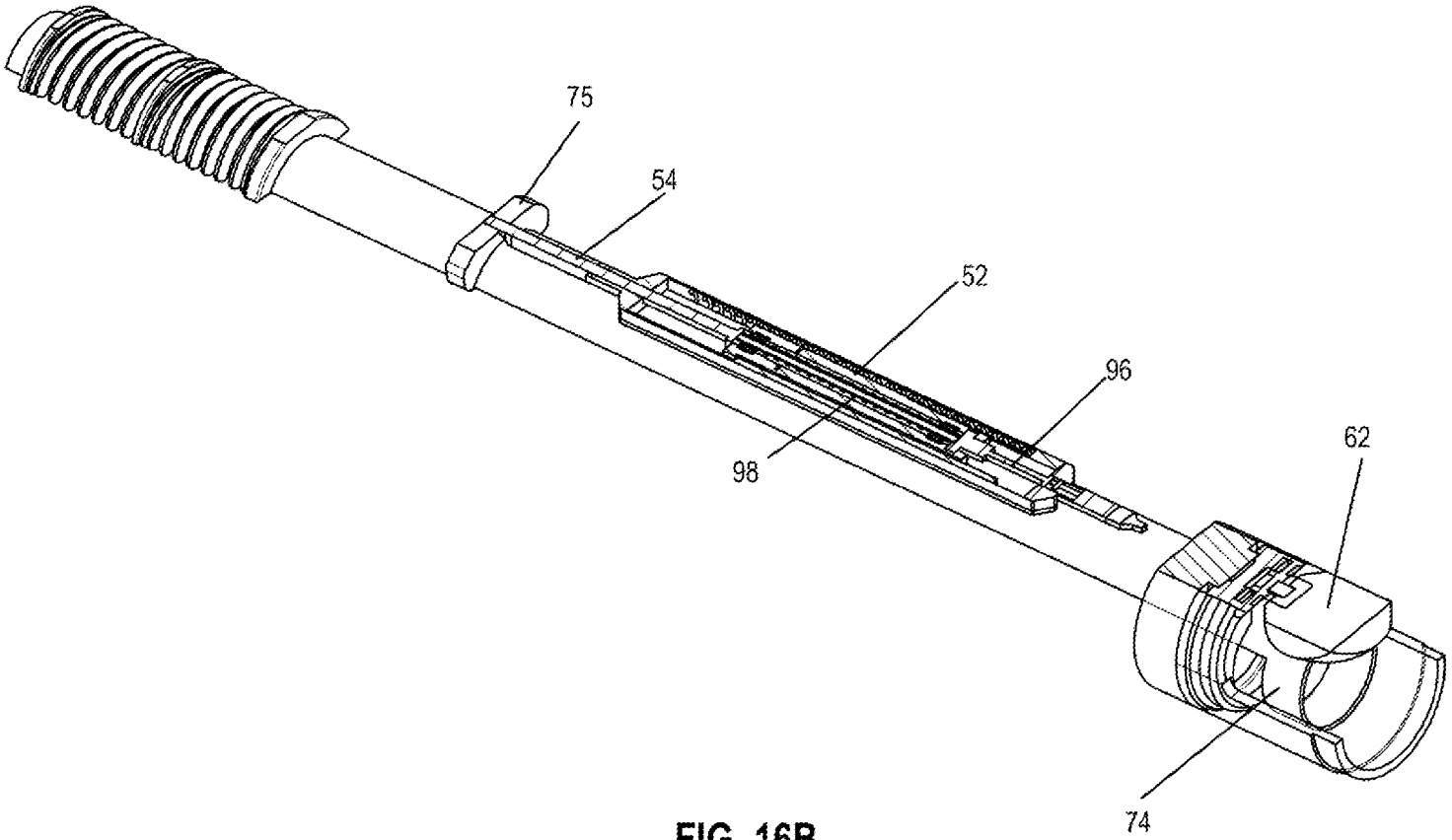

FIG. 16B shows the valve opening, for example in response to a command from the surface to the downhole electronics 30. As shown, the E-magnet 80 is activated and the actuator 26 (e.g., the piston or shaft 96) is retracting. Due to the magnetic coupling between the magnet 88 of the central piece 98 and the e-magnet 80 of the fork 52, which is coupled to the piston 96, retraction of the actuator 26 (e.g., the piston or shaft 96), and therefore the fork 52, causes linear axial motion of the central piece 98. The central piece 98 in turn shifts the yoke shaft 54 and therefore the flange 75, thereby compressing the return spring 72. The internal tubing sleeve 74 moves toward, into contact with, and/or past the flapper 62 to open the flapper 62.

Figure 16C:
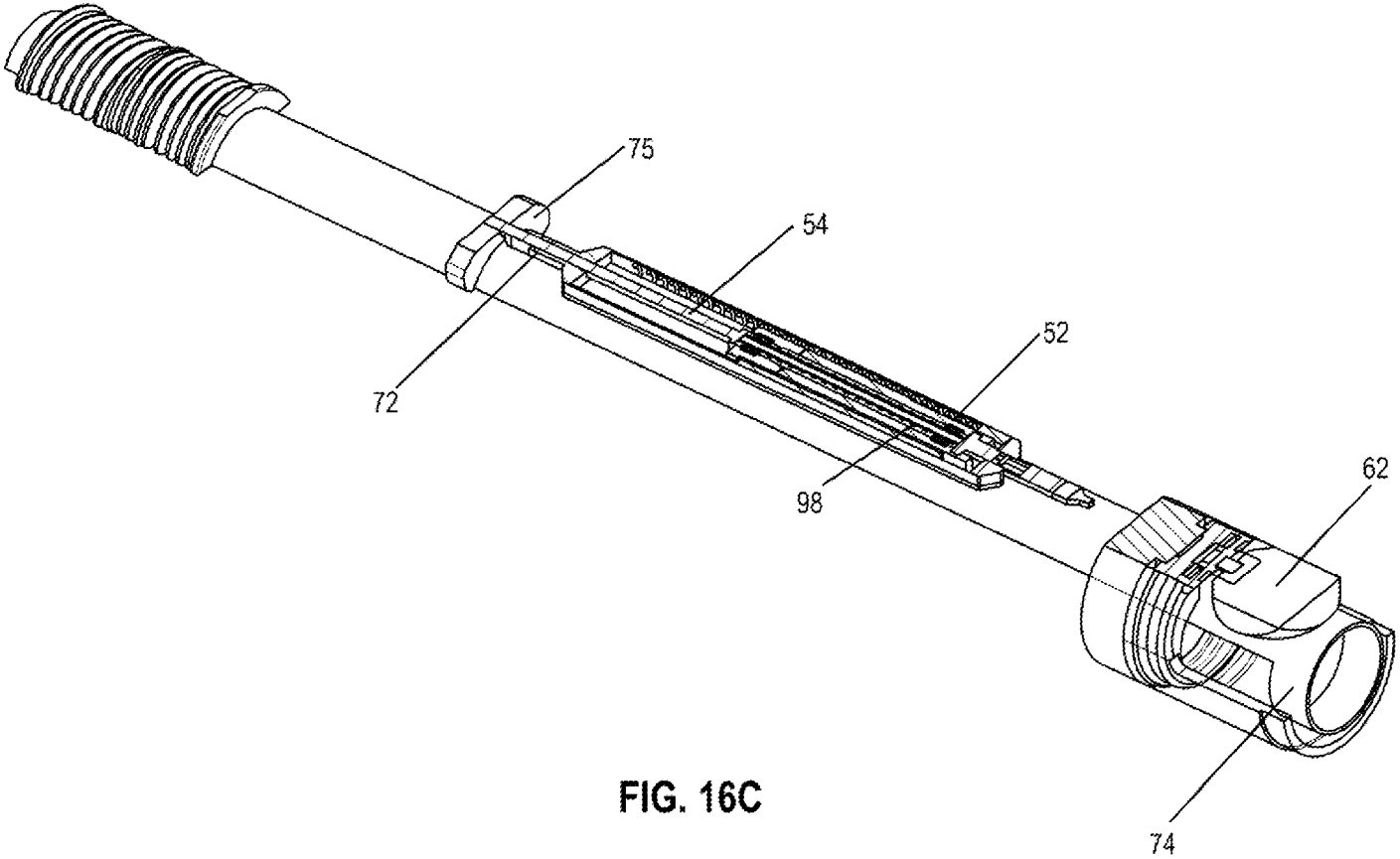
Figure 16D:
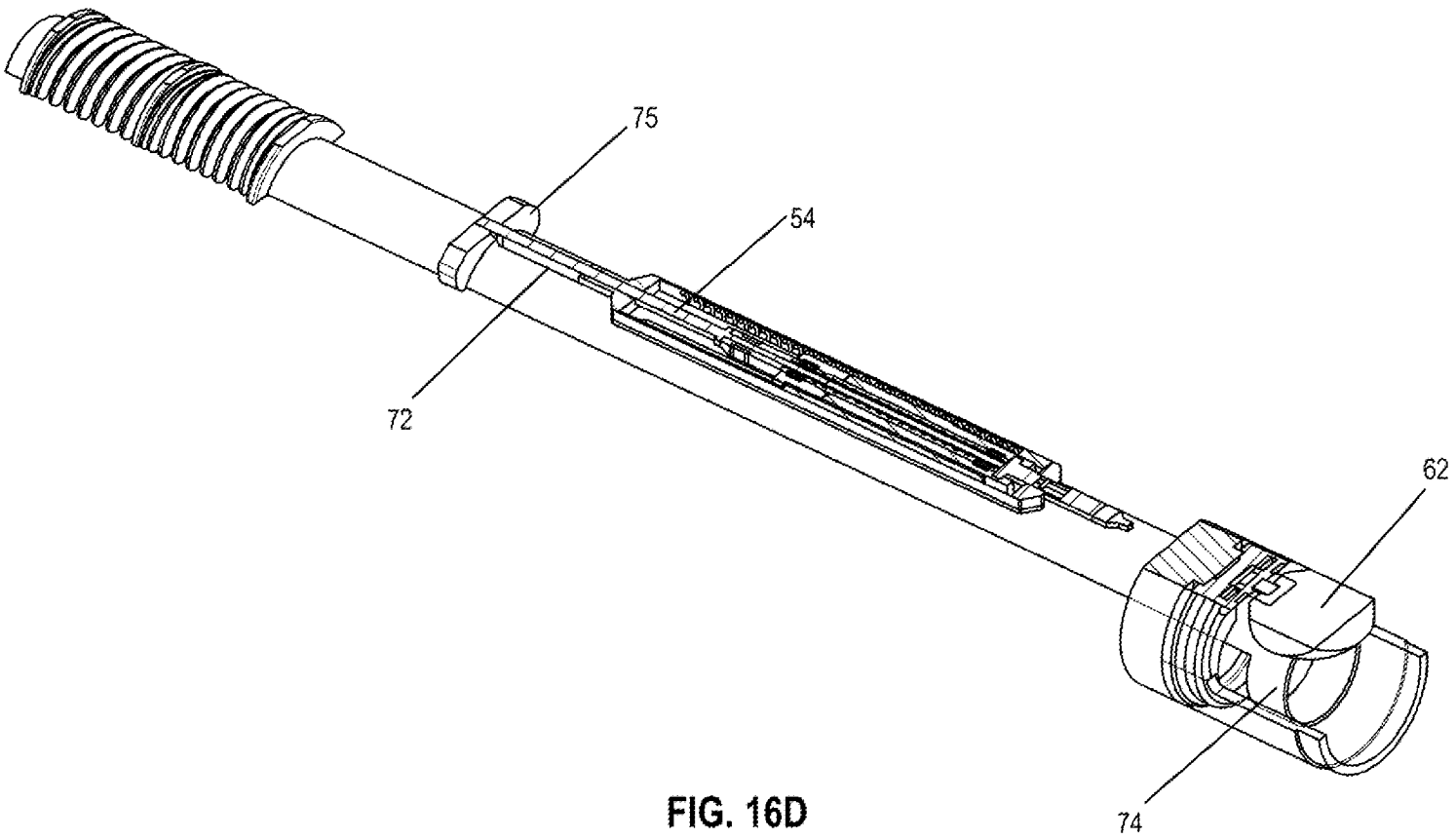

In FIG. 16C, the valve 22 is fully opened, the actuator 26 is in the fully contracted position (and the return spring 72 can be fully compressed and/or the internal tubing sleeve 74 can be shifted to hold open and protect the flapper 62), and the E-magnet 80 is kept activated. Continued activation of the E-magnet 80 can hold the internal tubing sleeve 74 in its shifted position (e.g., the position holding open and protecting the flapper 62, for example as shown in FIG. 16C). If the EMA 26 has enough holding force, the motor can be shut-in or powered down. The valve is monitored for EMA back-drive, and if back-drive is detected, the EMA 26 can be powered on and actuated to the proper shaft position. FIG. 16C illustrates the continuous or normal state of the eSV and actuator in full open mode.

Figure 16E:
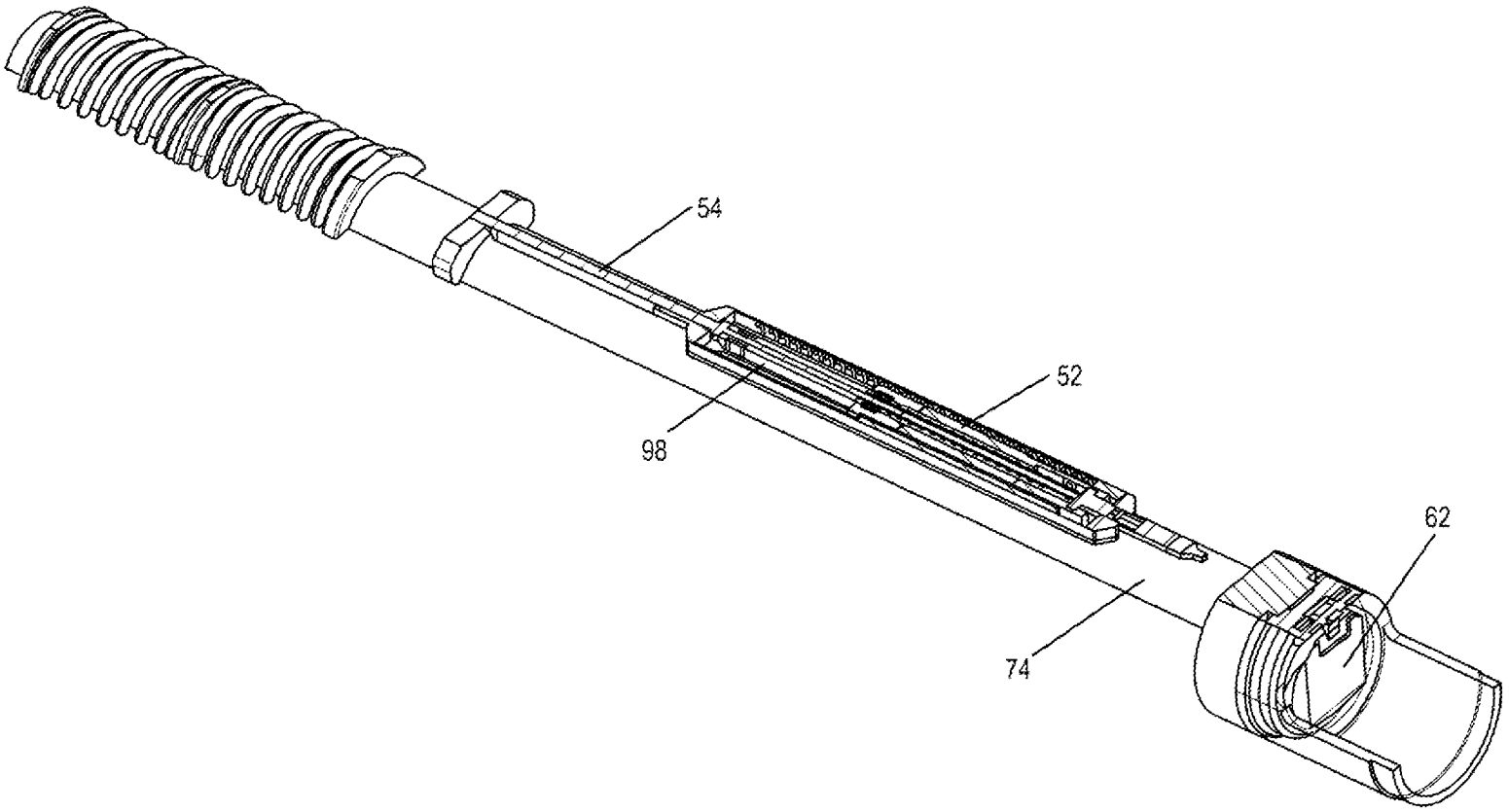

FIGS. 16D-16G show the valve closure mode via de-activation of the e-magnet 80. Closure mode can be triggered intentionally, for example for periodic testing of equipment, or automatically in the case of emergency or electrical shut-down (failsafe mode). De-activation of the E-magnet 80 releases the magnetic coupling between the E-magnet 80 of the fork 52 and the magnet 88 of the central piece 98. The spring 72 is therefore able to expand, for example against the flange 75, and bias the internal sleeve 74 back to its original, closed position, allowing the flapper 62 to close such that the valve is in a fully closed position or state (FIG. 16E). The central piece 98 moves axially relative to the fork 52, as the central piece 98 is coupled to and translates with the yoke shaft 54 and flange 75.

Figure 16F:
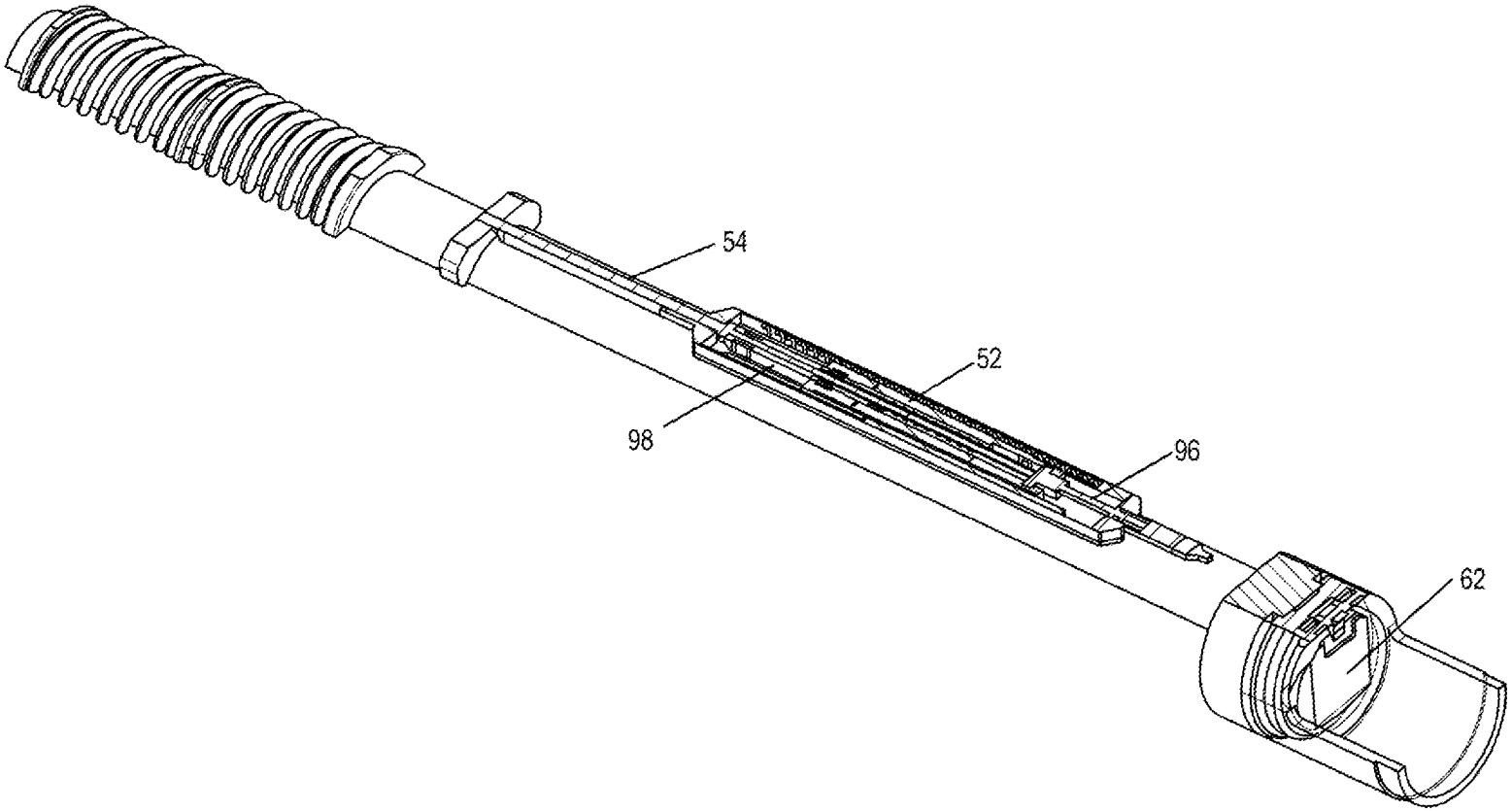
Figure 16G:
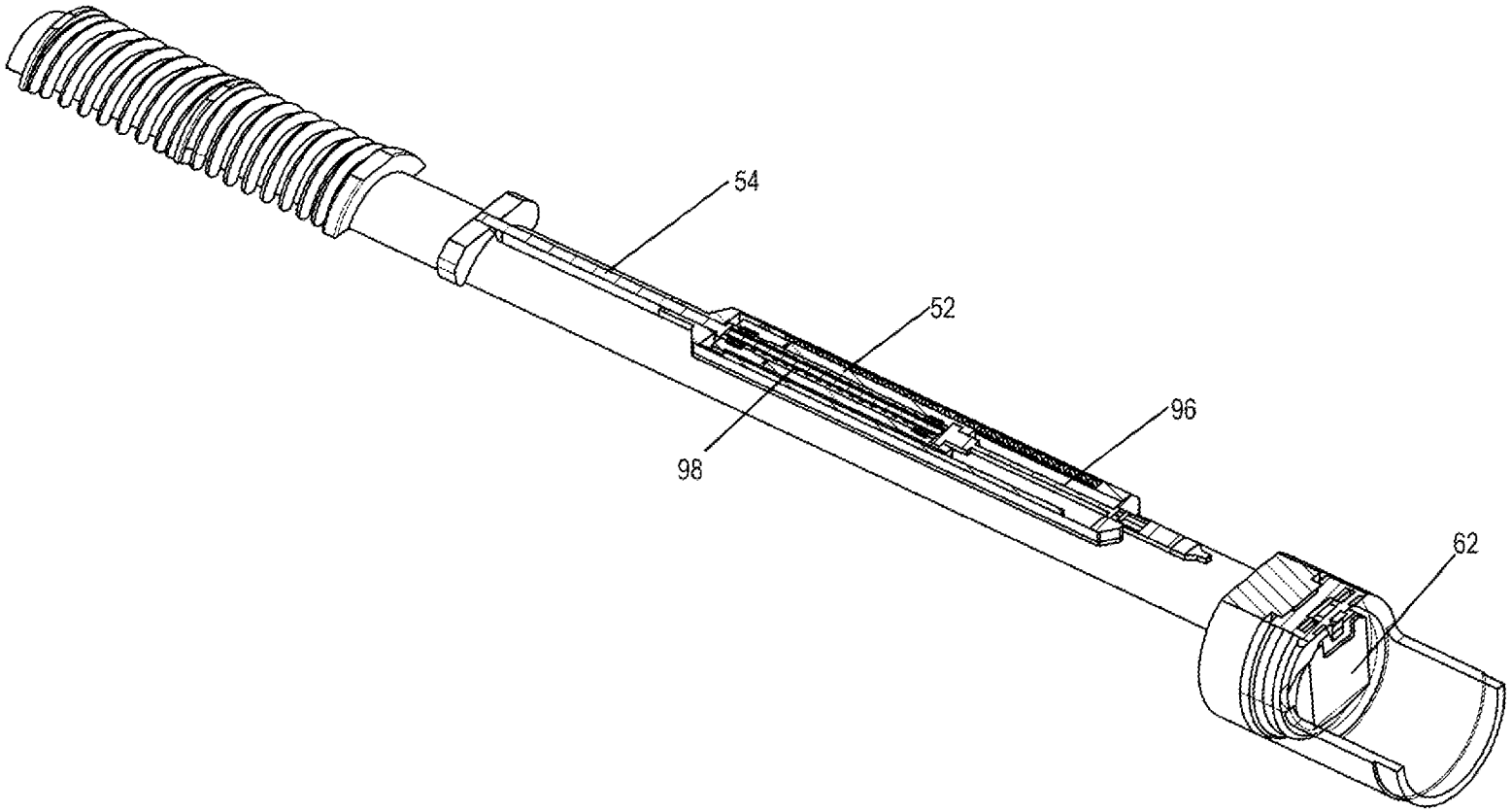

As the e-magnet 80 is magnetically decoupled from the magnet 88, and there is no mechanical link between the actuator 26 and the sleeve 74, the slam force is not transmitted to actuator shaft 96. In other words, the internal sleeve 74 can be retracted to its original, closed position without movement of or force on the actuator shaft 96, thereby avoiding or reducing the risk of damage in the event of slam closure. The piston 96 can then be extended as shown in FIGS. 16F-16G to realign the fork 52 with the central piece 98 and the E-magnets 80 with the magnets 88. FIG. 16G shows the valve fully closed with the actuator 26 (e.g., shaft or piston 96) extended and monitored and the e-magnet 80 de-activated. The valve 22 can be re-opened by repeating the process shown in FIGS. 16A-16C.

In some configurations, for example as shown in FIG. 15A, the disconnect system includes one or more (four in the illustrated configuration) pairs of teeth inserts 60. In some configurations, for example as also shown in FIG. 15A, the disconnect system includes one or more corresponding ramped profiles or shoulders 61 on outer edges or surfaces of the central piece 98 and inner edges or surfaces of the fork 52. When the e-magnets 80 are activated in use, the magnetic attraction of the e-magnets 80 can pull the magnets 80 toward and/or into contact with the e-magnets 80. The radial displacement of the magnets 88 and/or central piece 98 outward toward the e-magnets 80 and/or fork 52 causes engagement of the corresponding teeth 60 and/or shoulders 61. The teeth 60 and/or shoulders 61 advantageously provide a mechanical advantage. The engagement and/or friction force of the teeth 60 or shoulders 61 provides an additional radial load to enhance the magnetic radial load provided by the activated e-magnets 80. The enhanced radial load advantageously helps transfer and apply axial load such that axial movement of the piston 96 and fork 52 can cause axial movement of the central piece 98 and therefore sleeve 74 (via the yoke shaft 54 and flange 75) when the e-magnets 80 are activated and the piston 96 is in motion, and such that axial movement of the central piece 98 and sleeve 74 can be resisted against the force of the return spring 72 to hold the valve open in the normal state of the eSV in full open position (shown in FIG. 16C). When the E-magnets 80 are de-activated, the magnetic radial load is lost, the teeth 60 or shoulders 61 are no longer held in engagement, and relative axial movement between the central piece 98 and the fork 52 is permitted.

The yoke shaft 54 may extend into and through at least a portion of the central piece 98, such that the central piece 98 is disposed about a portion of the yoke shaft 54. The disconnect system may include one or more springs 99, e.g., wave springs, disposed radially between the yoke shaft 54 and the central piece 98, for example as shown in FIGS. 15A and 17A-17C. The springs 99 can advantageously help cushion radial displacement as the central piece 98 is pulled into contact with the fork 52 and released as the e-magnets 80 are activated and de-activated, respectively. As described, the teeth inserts 60 and/or shoulders 61 can help provide a friction force and/or enhanced radial load for improved transfer of axial load and for a holding configuration. In some configurations, the teeth 60 and/or shoulders 61 are inclined at an angle of approximately 45°. The angle can be selected to optimize a balance between a secure holding force between the central piece 98 and the fork 52 when the e-magnets 80 are activated, and allowing relative axial movement between the central piece 98 and the fork 52 when the e-magnets 80 are de-activated.

Figure 17A:
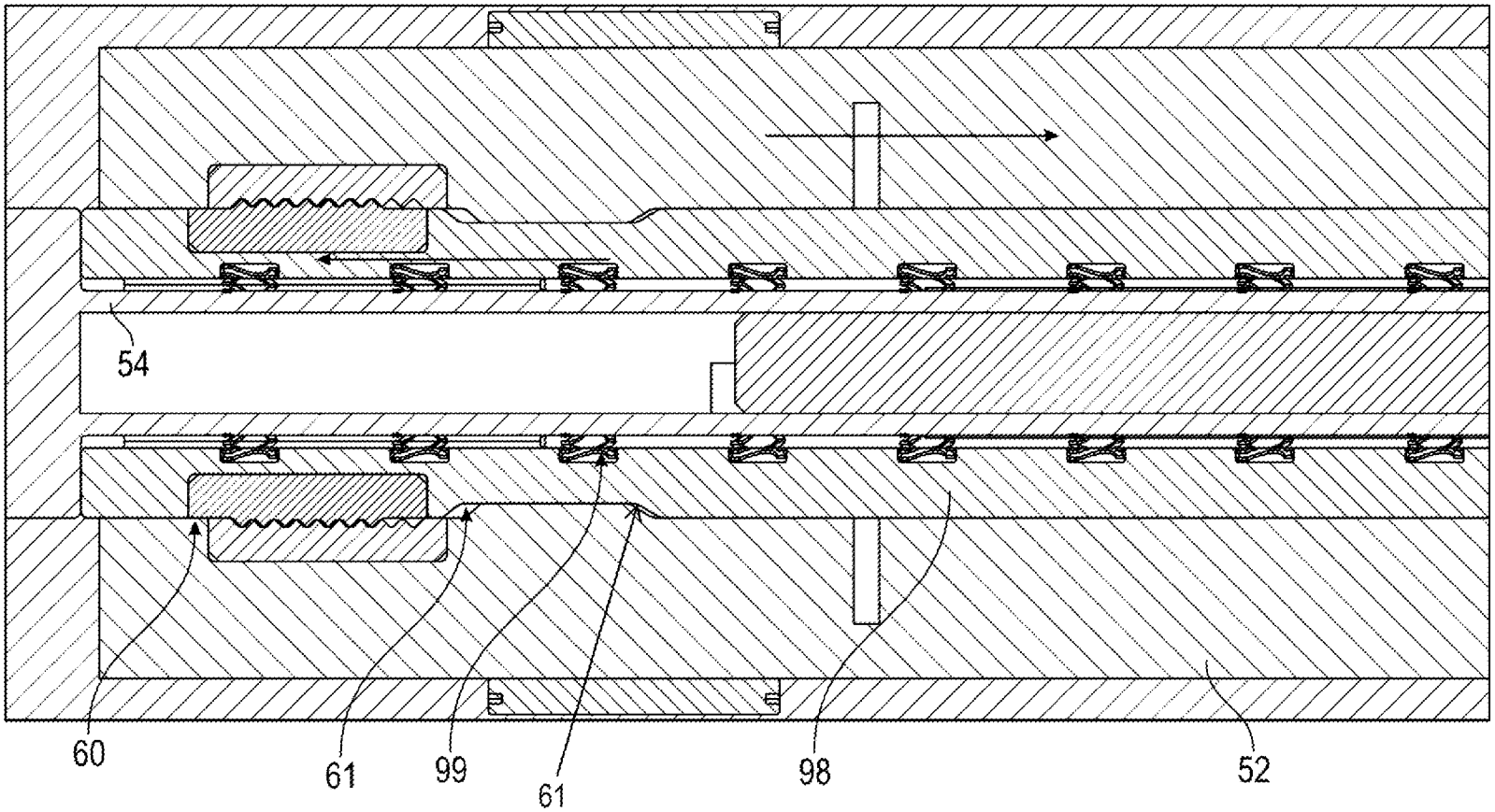
FIGS. 17A-17C illustrate operation of a portion of the safety valve of FIG. 14.
Figure 17B:
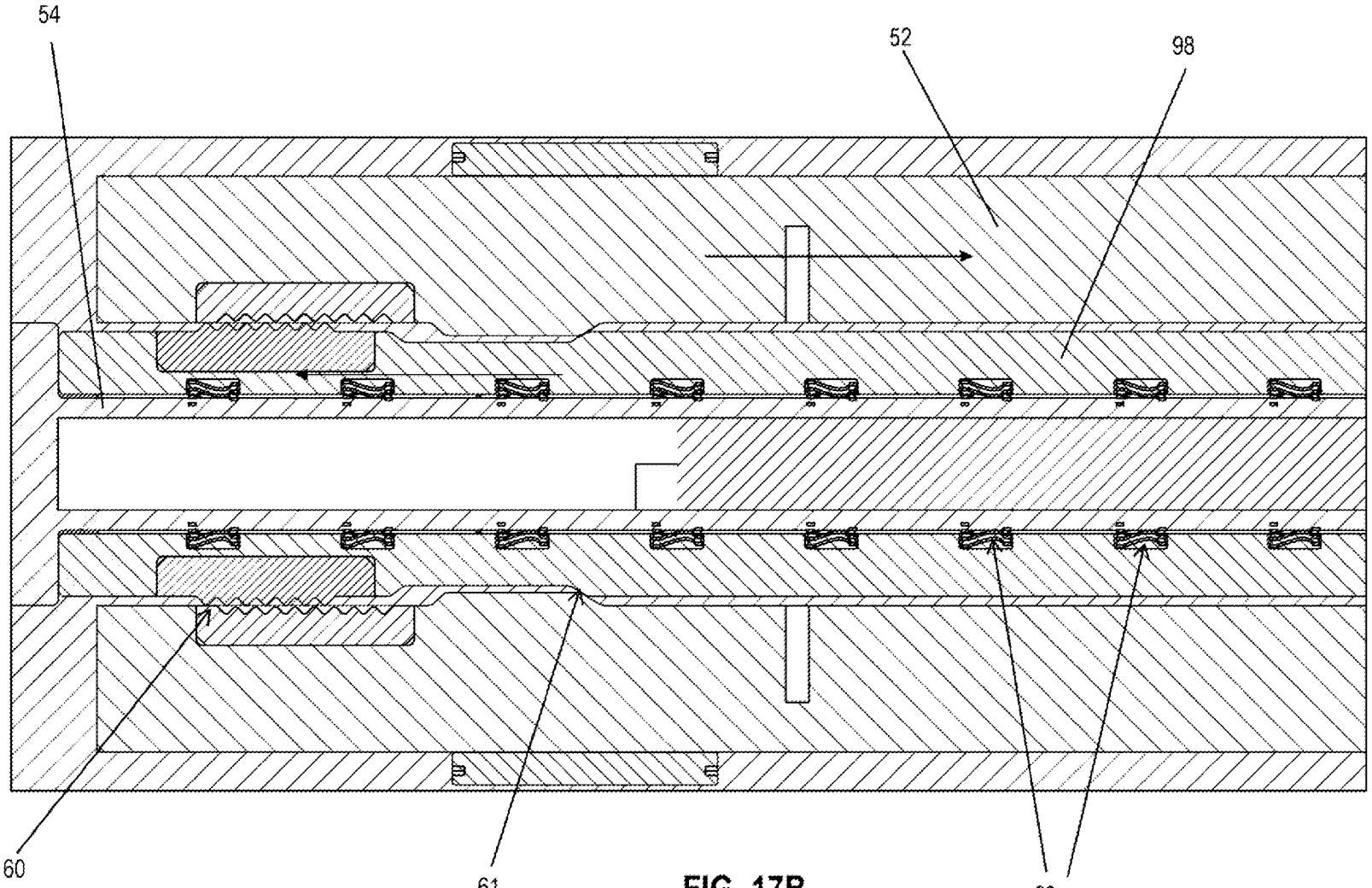
Figure 17C:
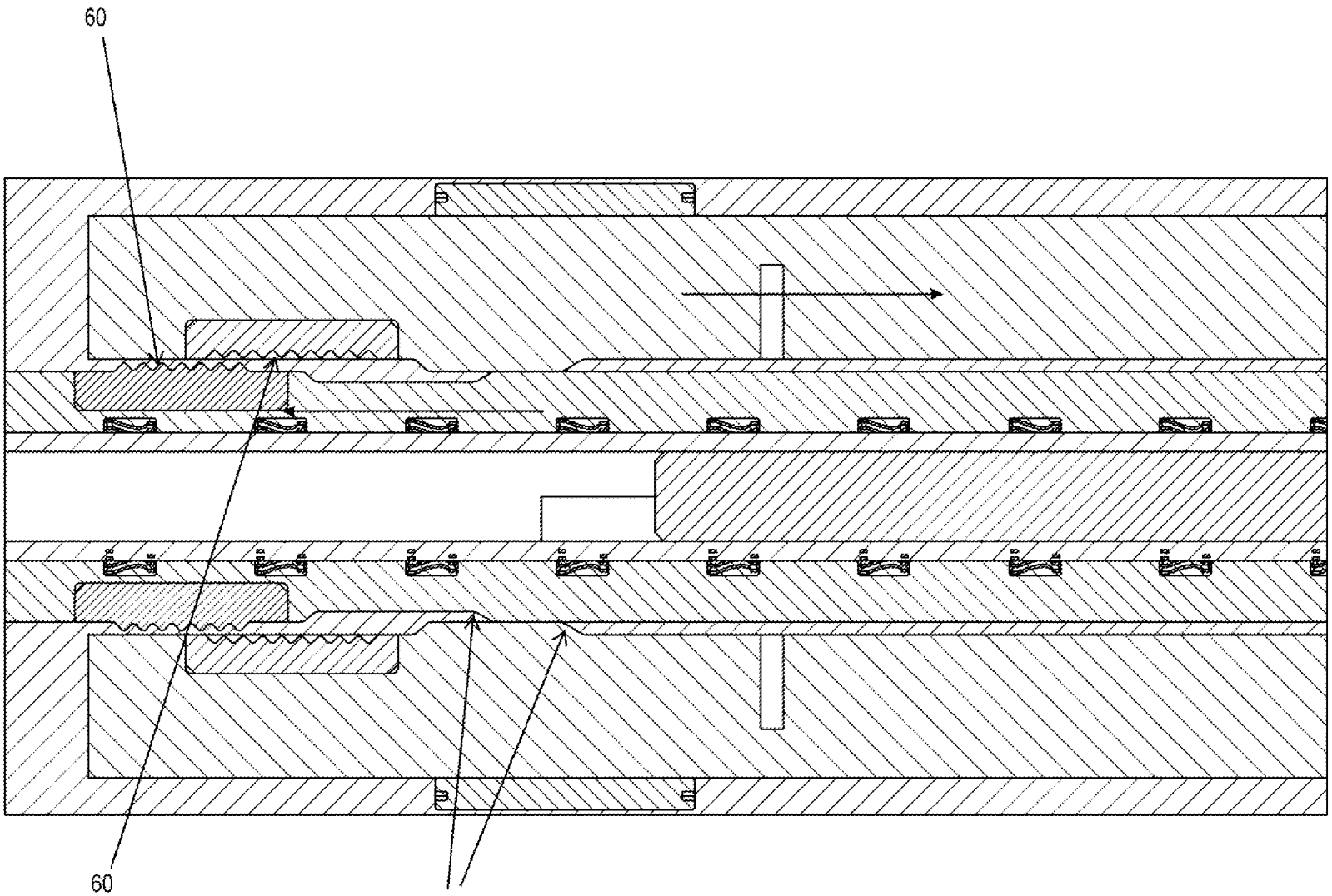

FIGS. 17A-17C show additional detail of the teeth 60 and ramped profiles 61, which can be included in, for example, the valve configurations shown in FIGS. 12 and 14, in operation. In FIG. 17A, the E-magnets 80 are activated, and the magnetic coupling between the E-magnets 80 and the magnets 88 pulls the central piece 98 radially outward away from the yoke shaft 54 and into contact with the fork 52. As shown, the corresponding teeth 60 and shoulders 61 of the central piece 98 and fork 52 are engaged, thereby inhibiting relative axial movement between the central piece 98 and the fork 52. Axial movement of the piston 96 and fork 52 is therefore transferred to the central piece 98, allowing the central piece 98, yoke shaft 54, flange 75 and sleeve 74 to be translated by the piston 96.

The engagement of the teeth 60 and/or shoulders 61 also works with the magnetic coupling between the e-magnets 80 and magnets 88 to hold the safety valve in an open position while the e-magnets 80 are activated in use. Deactivation of the E-magnets 80 allows the central piece 98 to collapse radially inward toward away from the fork 52 as shown in FIG. 17B, thereby moving the teeth 60 and/or shoulders 61 at least partially out of engagement and/or reducing or eliminating the friction force between them. The central piece 98 can then move axially relative to the fork 52, as shown in FIG. 17C, for example, due to the spring 72 force on the flange 75.

Figure 18:
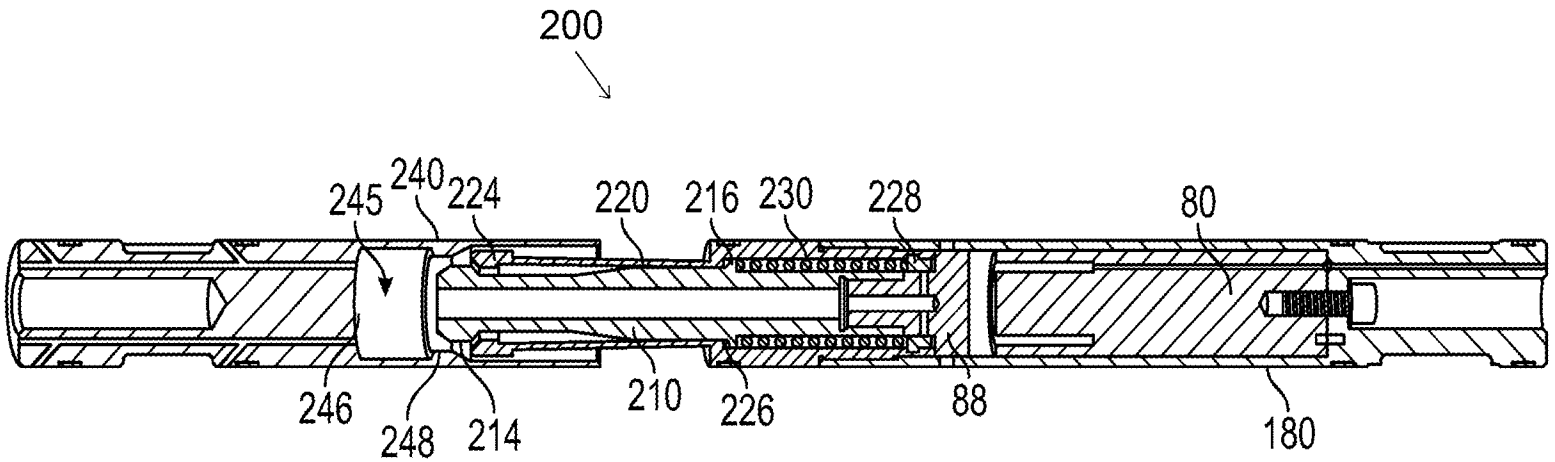
FIG. 18 illustrates an example electro-mechanical coupling.

FIG. 18 illustrates an example electro-mechanical coupling. The coupling includes a latch or collet mechanism 200 configured to provide a mechanical advantage to a device including an electromagnetic disconnect. In some configurations, the device is a safety valve, for example as shown and described herein. However, the electro-mechanical coupling can be used in or with other devices. In the illustrated configuration, the latch mechanism 200 includes an inner collet 210, an outer collet 220, and a spring 230. A base member 240 is coupled to a component of the device. In configurations in which the latch mechanism is included in a safety valve, the base member 240 is coupled to, e.g., operably coupled to, the flow tube or sleeve 74 (e.g., coupled to, e.g., operably coupled to, a flange 75). In the illustrated configuration, the E-magnet(s) 80 is coupled to, e.g., operably coupled to, the shaft or piston 96 of the actuator 26. In the illustrated configuration, the base plate 88 is coupled to the inner collet 210. In other configurations, the base plate 88 can be coupled to, e.g., operably coupled to, the shaft or piston 96 of the actuator 26, and the E-magnet(s) 80 can be coupled to the inner collet 210. The E-magnet 80 can be disposed within a tube 180. The tube 180 can be coupled to, e.g., operably coupled to, the shaft or piston 96 of the actuator 26. The tube 180 is coupled to the outer collet 220. The base plate 88 can be disposed with the tube 180. Portions of the inner 210 and outer 220 collets can extend within the tube 180 as shown.

The base member 240 includes a cavity 245, a base 246 of the cavity, and a projection 248 projecting radially inward into the cavity 245. Distal (relative to the actuator 26) portions of the inner collet 210 and outer collet 220 extend at least partially into the cavity 245. The inner collet 210 includes a projection 214 projecting radially outward from the inner collet 210 at or near the distal end of the inner collet 210. The outer collet 220 includes a projection 224 projecting radially outward from the outer collet 220 at or near the distal end of the outer collet 220. The spring 230 is disposed radially between the inner collet 210 and the outer collet 220 and axially between the base plate 88 and a flange 216 of the inner collet 210. Axial ends of the spring 230 can be coupled to (e.g., operably coupled to) the flange 216 and a component 228 of or coupled to the outer collet 220.

Figure 19A:
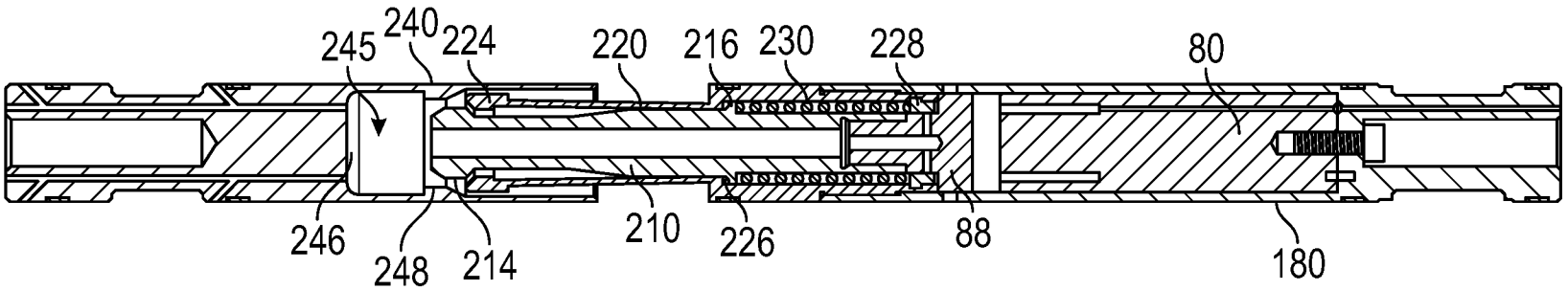
FIG. 19A-19G illustrate operation of the electro-mechanical coupling of FIG. 18.
Figure 19B:
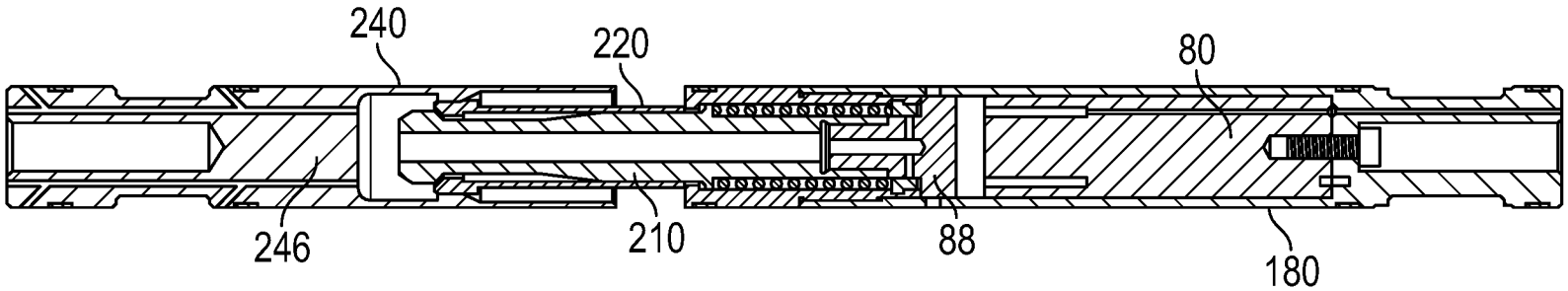
Figure 19C:
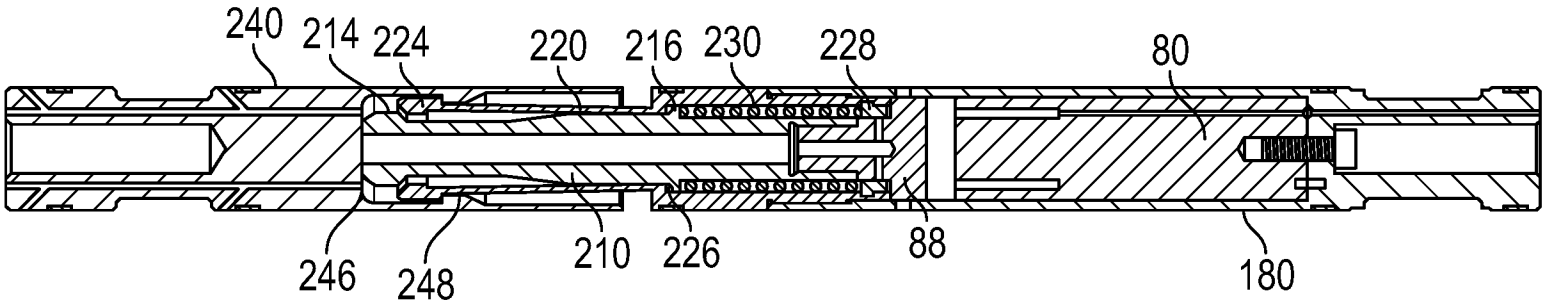
Figure 19D:
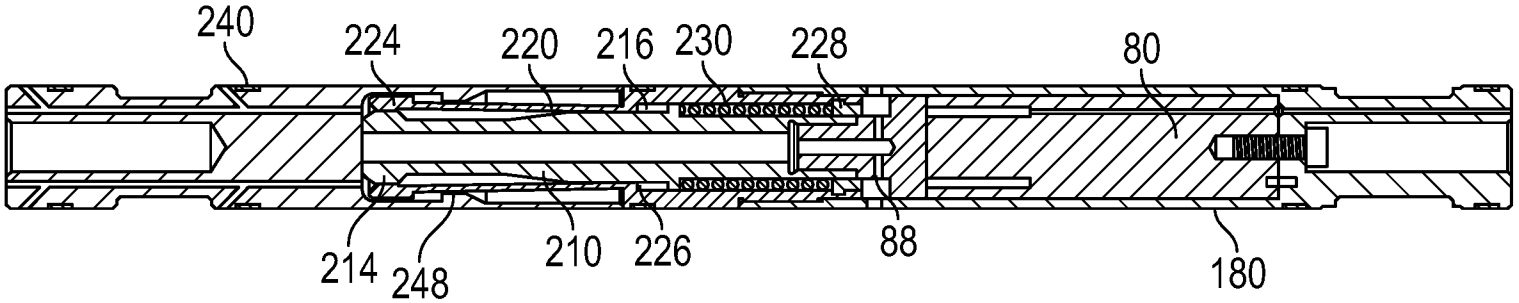

FIGS. 19A-19G illustrate operation of the electromagnetic disconnect and latch or collet mechanism of FIG. 18. FIG. 19A shows the latch mechanism in an initial state. The latch is not engaged and the e-magnet 80 is not powered. To begin operation such as an opening sequence (for example in the case the latch mechanism is included in a safety valve), the actuator 26 piston 96 extends. As the actuator 26 extends, the tube 180, e-magnet 80, inner collet 210, and outer collet 220 move together distally toward the base member 240, as shown in FIG. 19B. The outer collet 220 flexes or collapses radially inwardly toward the inner collet 210 to allow the projection 224 of the outer collet 220 to clear the projection 248 of the base member 240 as the inner 210 and outer 220 collets move within the cavity 245 toward the base 246. Extension continues as the inner collet 210 reaches the base 246 of the cavity 245, as shown in FIG. 19C. As the actuator continues to extend, the tube 180, e-magnet 80, outer collet 220, and component 228 move axially relative to the base plate 88 and inner collet 210 until the outer collet 220 reaches the base 246 of the cavity 245, as shown in FIG. 19D. The spring 230 is compressed as the outer collet 220 and component 228 move distally relative to the inner collet 210 and its flange 216. At this point, the e-magnet 80 is in contact with the base plate 88, and the projection 214 of the inner collet 210 underlies the projection 224 of the outer collet 220.

Figure 19E:
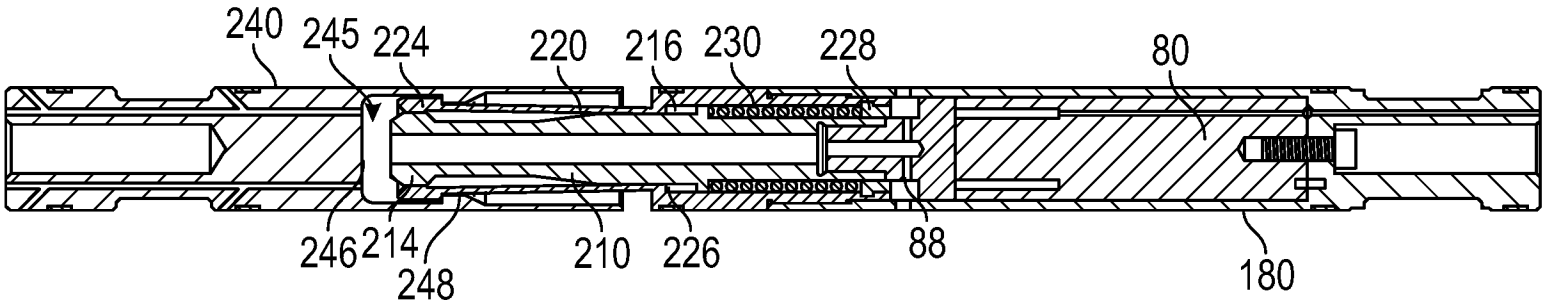

The e-magnet 80 is then powered on, such that the base plate 88 is magnetically coupled to the e-magnet 80. As the actuator begins retracting, the magnetic coupling between the e-magnet 80, which is operably coupled to the actuator, and the base plate 88, which is operably coupled to the inner collet 210, causes the inner collet 210 to retract as well. The projection 224 of the outer collet engages the distal side of the projection 248 of the base member 240, as shown in FIG. 19E. The interaction between the projections 214, 224 of the inner 210 and outer 220 collets and the projection 248 of the base member 240 locks the latch such that the inner collet 210 is operably coupled to the base member 240. Retraction of the actuator therefore causes retraction of the e-magnet 80, base plate 88, inner collet 210, outer collet 220, base member 240, and the component coupled to the base member 240, e.g., the flow tube 74 to open a safety valve.

Figure 19F:
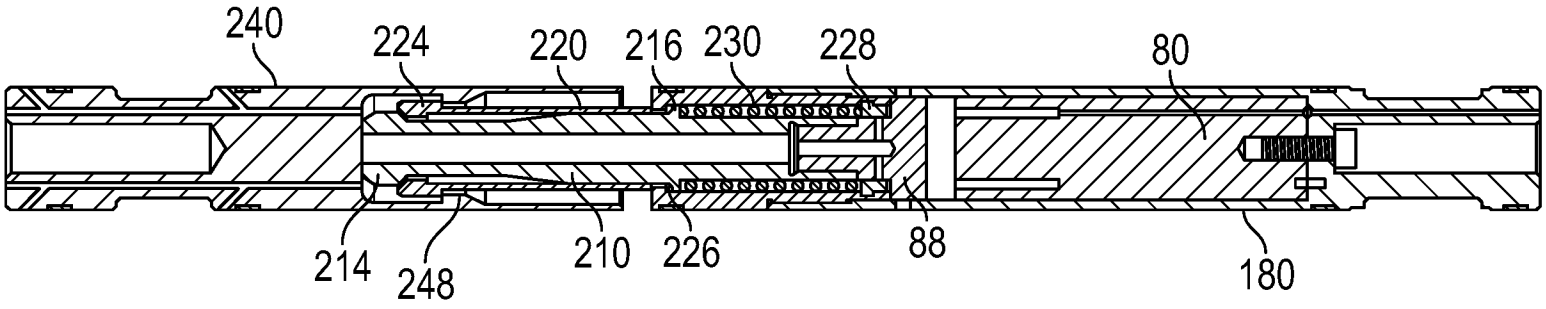
Figure 19G:
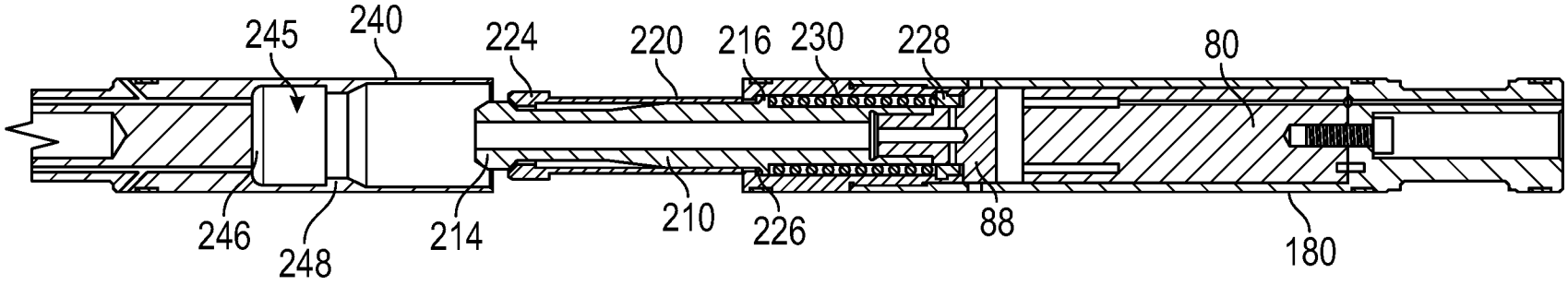

If power to the e-magnet 80 is turned off or lost, for example, in a failsafe situation, the magnetic coupling between the e-magnet 80 and base plate 88 is lost. With the base plate 88 released from the e-magnet 80, the spring 230 expands against the flange 216 of the inner collet 210 to bias the inner collet 210 distally relative to the outer collet 220, as shown in FIG. 19F. The spring 230 therefore biases the latch mechanism toward an unlocked configuration. The projection 214 of the inner collet 210 no longer underlies and supports the projection 224 of the outer collet such that the latch is unlocked. The outer collet 220 can therefore flex or collapse radially inward toward the inner collet 210 so that the projection 224 of the outer collet 220 can clear the projection 248 of the base member 240. The base member 240 is therefore free to release, for example as spring 72 biases the flow tube 74 and base member 240 distally, as shown in FIG. 19G.

Figure 20:
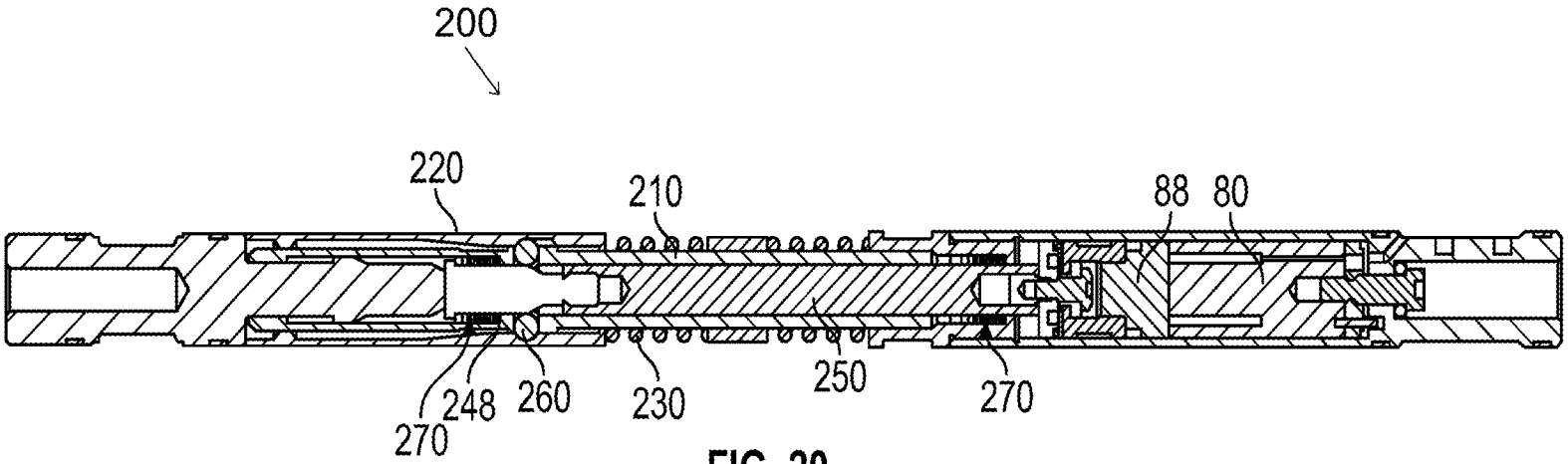
FIG. 20 illustrates another example electro-mechanical coupling.

FIG. 20 illustrates an example configuration of a double latch or collet to provide a mechanical advantage to a device including an electromagnetic disconnect. In some configurations, the device is a safety valve, for example as shown and described herein. In the illustrated configuration, the latch mechanism 200 includes an inner collet 210, an outer collet 220, an inner rod 250, and a spring 230. In some configurations, the spring 230 can include two more segments separated by one or more spacers. The inner rod 250 can include one or more components. At least a portion of the inner collet 210 is disposed circumferentially about at least a portion of the inner rod 250. At least a portion of the outer collet 220 is disposed circumferentially about at least a portion of the inner collet 210. The inner collet 210 includes a radially inwardly extending projection 212 at or near the distal (relative to the actuator) end of the inner collet 210. The outer collet 220 includes a radially inwardly extending projection 222 at or near the distal end of the outer collet 220.

A base member 240 is coupled to, e.g., operably coupled to, a component. For example, in a safety valve, the base member is coupled to, e.g., operably coupled to, the flow tube or sleeve 74 (e.g., coupled to, e.g., operably coupled to, a flange 75). As shown, the base member 240 can include a flange 242 forming a shoulder 244. In the illustrated configuration, the E-magnet(s) 80 is coupled to, e.g., operably coupled to, the shaft or piston 96 of the actuator 26. In the illustrated configuration, the base plate 88 is coupled to the inner rod 250. In other configurations, the E-magnet(s) 80 can be coupled to, e.g., operably coupled to, the inner rod 250, and the base plate 88 can be coupled to, e.g., operably coupled to, the shaft or piston 96 of the actuator 26. The E-magnet 80 can be disposed within and coupled or secured to a tube 180. The tube 180 can be coupled to, e.g., operably coupled to, the shaft or piston 96 of the actuator 26. The base plate 88 can also be disposed with the tube 180.

In the illustrated configuration, a tube shoulder 182 is disposed circumferentially about a portion of the inner rod 250. A first portion of the tube shoulder 182 is positioned circumferentially or radially between the tube 180 and the inner rod 250. A second portion of the tube shoulder 182 is positioned adjacent a distal (relative to the actuator) end of the tube 180. A proximal end (relative to the actuator 26) of the inner collet 210 is disposed circumferentially or radially between the inner rod 250 and the second portion of the tube shoulder 182. The inner collet 210 is operably coupled to the tube shoulder 182, for example, via corresponding engagement features of the inner collet 210 and tube shoulder 182, such that the inner collet 210 moves or slides axially with the tube shoulder 182. In the illustrated configuration, the spring 230 is disposed circumferentially or radially about the inner collet 210 and axially between the tube shoulder 182 and the outer collet 220.

The double latch or collet mechanism of FIG. 20 also includes one or more balls 260 and one or more small springs 270. The illustrated configuration includes two balls 260 and two small springs 270. The small springs 270 are disposed about the inner rod 250. As shown, one small spring 270 can be disposed proximate each axial end of the inner rod 250. The inner rod 250 includes a recessed portion 252. In the illustrated configuration, the recessed portion 252 is disposed axially between the two small springs 270 and proximate the distal small spring 270. The balls 260 are disposed in openings in the inner collet 210. In an initial state of the double latch mechanism, shown in FIG. 21A, the balls 260 rest at least partially in the recessed portion 252.

Figure 21A:
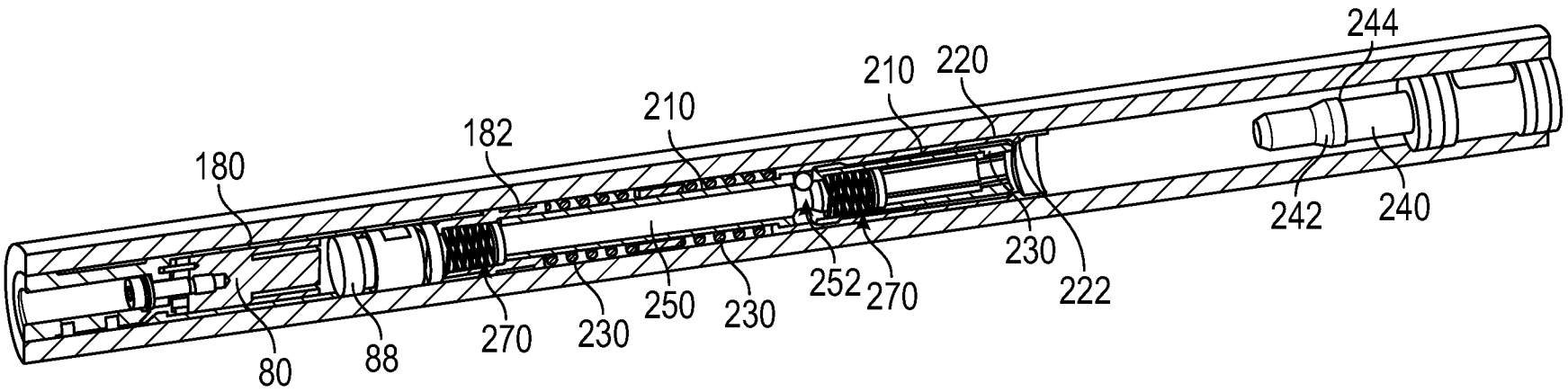
FIGS. 21A-21I illustrate operation of the electro-mechanical coupling of FIG. 20.
Figure 21B:
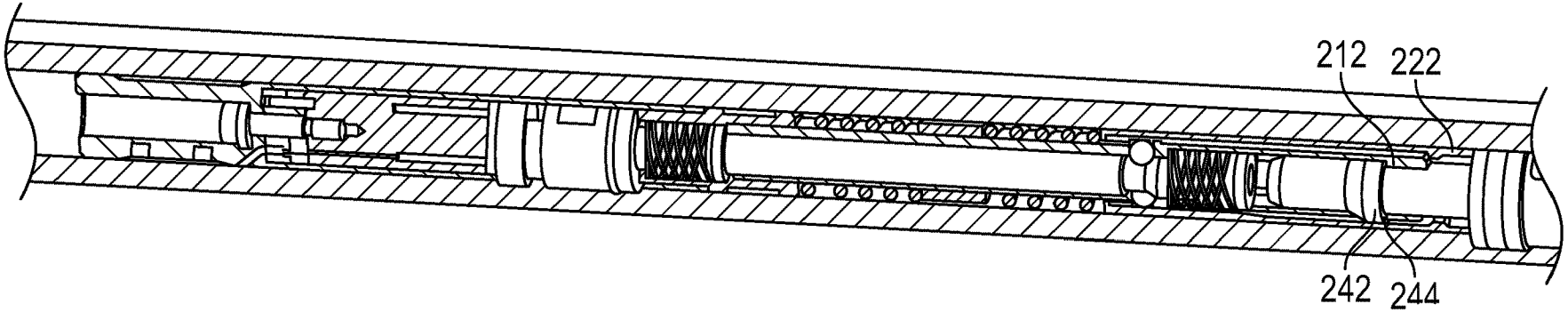
Figure 21C:
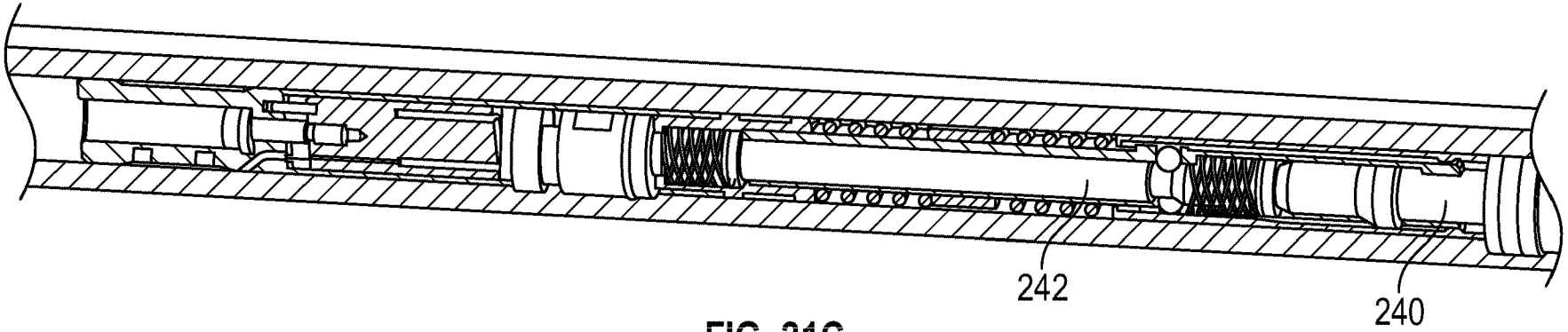
Figure 21D:
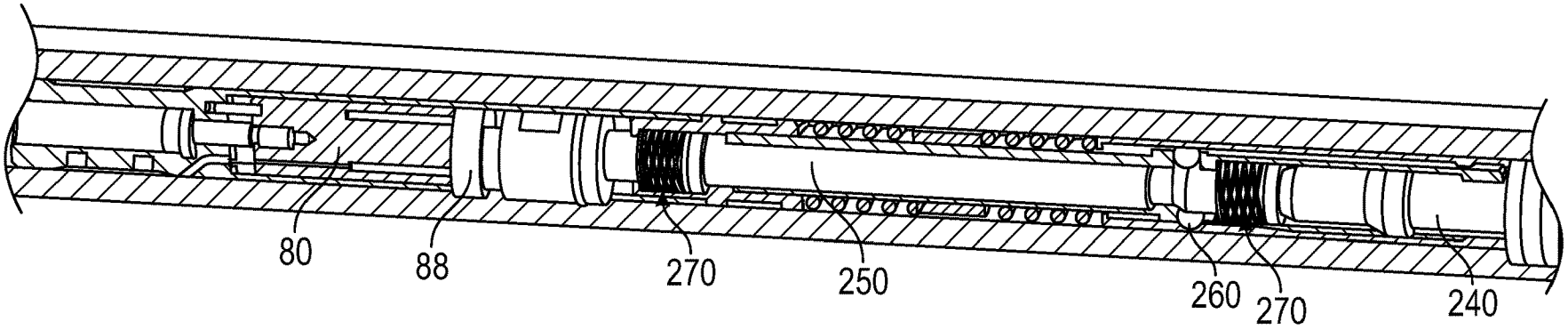

FIGS. 21A-21I illustrate operation of the electromagnetic disconnect and latch or collet mechanism of FIG. 20. FIG. 21A shows the safety valve 22 in a closed state. To begin an opening sequence, the actuator 26 piston 96 extends. As the actuator 26 extends, the tube 180, E-magnet 80, tube shoulder 182, inner collet 210, outer collet 220, and inner rod 250 all move together distally toward the base member 240. At this stage, the distal end of the inner collet 210 is proximal to the projection 222 of the outer collet 220. The inner collet 210 flexes radially outward to allow the inner collet projection 212 to clear the flange 242 of the base member 240, as shown in FIG. 21B. As the actuator 26 continues extending, the outer collet 220 bottoms out against a base of the base member 240, as also shown in FIG. 21B. The tube 180, E-magnet 80, tube shoulder 182, inner collet 210, and inner rod 250 continue moving toward the base member 240, relative to the now stationary outer collet 220, compressing the spring 230. The inner rod 250 then bottoms out against the base member 240, as shown in FIG. 21C. As the actuator 26 continues extending, the E-magnet 80, tube 180, tube shoulder 182, and inner collet 210 continue moving relative to the outer collet 220 and inner rod 250 until the inner collet 210 bottoms out against the base member 240, as shown in FIG. 21D. This compresses small spring 270 (e.g., via inwardly projecting flanges on tube shoulder 182 and inner collet 210 as shown). Movement of the inner collet 210 relative to the inner rod 250 forces the balls 260 outwardly and distally out of the recessed portion 252 along the inner rod 250. The balls 260 can then contact the inner diameter of the outer collet 220, operably coupling the inner collet 210 and the outer collet 220 and maintaining the spring 230 in a compressed state. At this point, the e-magnet 80 is in contact with the base plate 88.

Figure 21E:
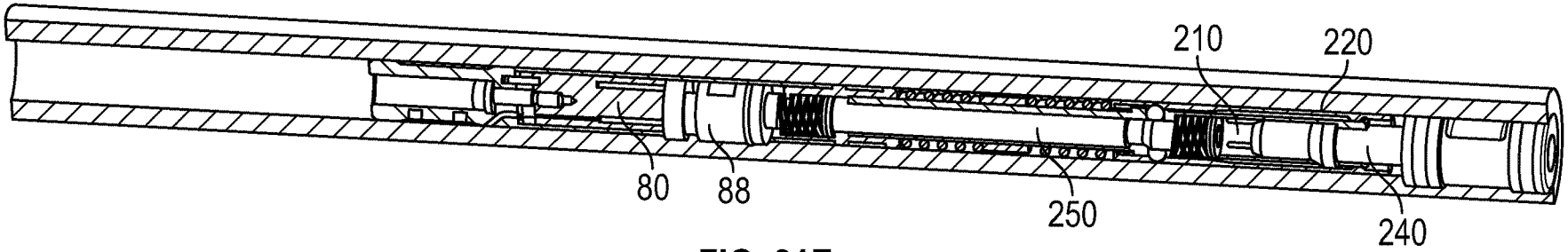

The e-magnet 80 is then powered on, such that the base plate 88 is magnetically coupled to the e-magnet 80. As the actuator begins retracting, the magnetic coupling between the e-magnet 80, which is operably coupled to the actuator, and the base plate 88, which is operably coupled to the inner rod 250, causes the inner rod 250 and inner collet 210 to retract as well. The inner collet 210 retracts until the projection 212 catches on the shoulder 244 of the base member 240, as shown in FIG. 21E. The position of the balls 260 causes the outer collet 220 to retract with the inner collet 210. In some configurations, when the projection 212 contacts the shoulder 244, the inner collet 210 and outer collet 220 can be positioned such that the projection 212 helps support projection 212 and lock the inner collet 210 against the base member 240 as shown.

Figure 21F:
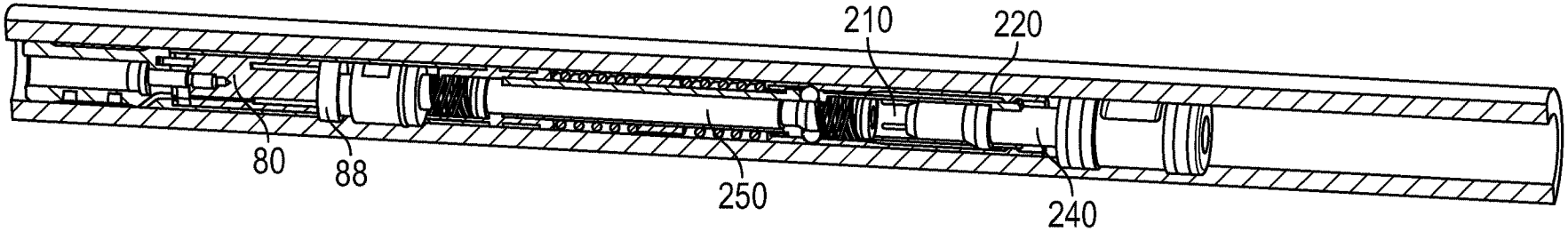

As shown in FIG. 21F, continued retraction of the actuator causes retraction or proximal axial movement of the base member 240, for example, due to interaction between the projection 212 and the shoulder 244. In configurations in which the double latch mechanism is used in a safety valve, for example as shown and described herein, the retraction of the base member 240 causes proximal axial movement of the component, for example, flow tube 74, thereby opening the safety valve. The coupling between the e-magnet 80 and the base plate 88 maintains the small springs 270 in compression.

Figure 21G:
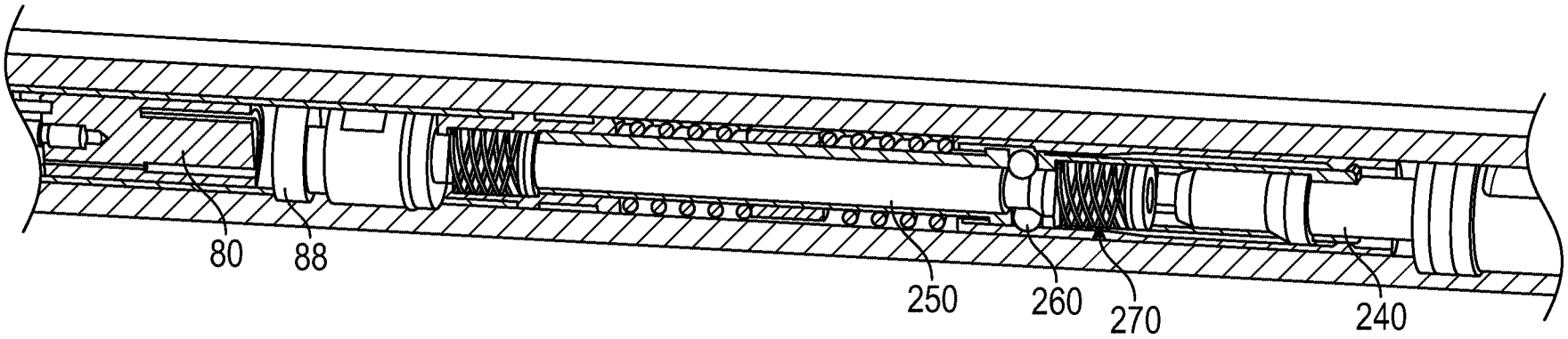
Figure 21H:
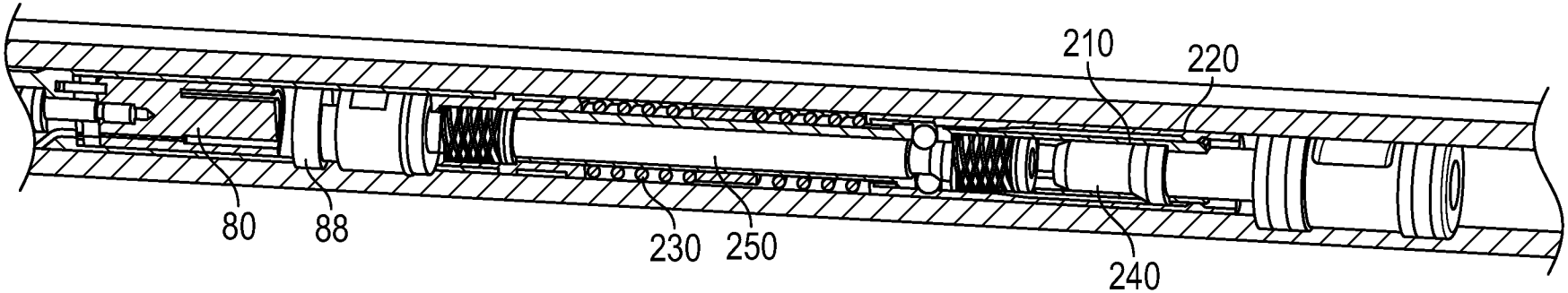
Figure 21I:
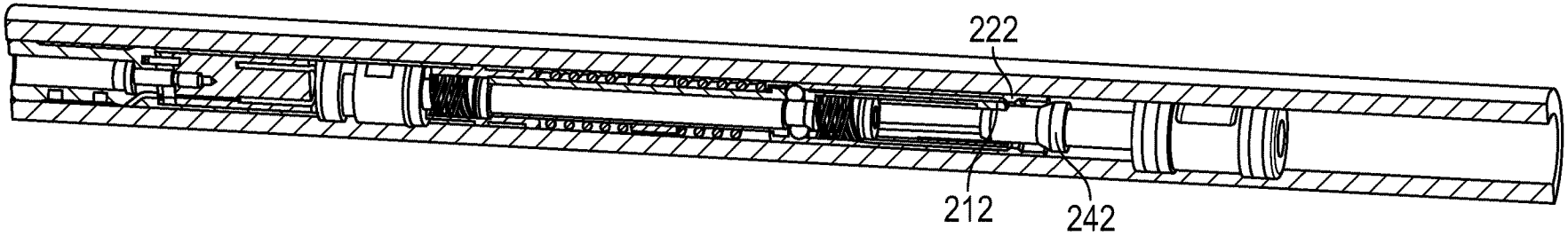

If power to the e-magnet 80 is turned off or lost, for example, in a failsafe situation, the magnetic coupling between the e-magnet 80 and base plate 88 is lost. The small springs 270 expand and bias the inner rod 250 away from the e-magnet 80, as shown in FIG. 21G. As the inner rod 250 moves axially and distally relative to the inner collet 210, the balls 260 drop back into the recess portion 252, releasing the outer collet 220 from the inner collet 210. With the outer collet 220 released, the spring 230 can expand and bias the outer collet 220 distally, as shown in FIG. 21H. The small springs 270 and balls 260 therefore act as a first stage of the double latch mechanism, and once released, the spring 230 acts as a second stage of the double latch mechanism. With projection 222 no longer supporting projection 212, inner collet 210 can flex outward to allow the shoulder 244 to clear the projection 212, for example as spring 72 biases the flow tube 74 and base member 240 distally, as shown in FIG. 21I. The latch mechanism then returns to the initial state shown in FIG. 21A.

The double latch design of FIGS. 20-21I advantageously allows for use of a stronger spring 230, without requiring stronger or bigger magnetic components 80, 88 or higher power. As the spring 230 must be selected to be strong enough to overcome the friction between the inner 210 and outer 220 collets, a stronger spring 230 can allow for a higher friction force between the collet or latch components. However, if the spring 230 is acting on the magnetic component(s), the e-magnet 80 must be strong enough to overcome the spring 230. The double latch allows for a stronger spring 230 as the spring 230 acts on the balls 260 rather than the magnet, and the small springs 270 instead act on the magnet. The magnet therefore only must overcome the force of the small springs 270, and the magnet can be made smaller or weaker for a given spring 230, or the spring 230 can be made stronger for a given magnet, which can advantageously improve design margins, reduce power consumption, and/or lower cost. A smaller magnet can allow for an overall smaller coupling, which enables the coupling to be used in a greater range of design dimensions. A smaller volume of oil in the design can result in lower pressure/temperature compensation requirements. Reducing the holding force requirement of the e-magnet 80 can also advantageously make the coupling more robust in high temperature, pressure, and vibration conditions.

In some valves according to the present disclosure, there is a magnetic coupling, for example, instead of a fixed mechanical link, between the actuator 26 and the internal tubing sleeve 74, which advantageously prevents or reduces the likelihood of damage to the actuator 26 during a slam closure. In some configurations, the e-magnet 80 is activated prior to extension or retraction (depending on the configuration of the valve) of the actuator 26 to compress the spring 72, and the e-magnet 80 and actuator 26 are both activated to open the valve and compress the return spring 72. The e-magnet 80 can remain activated to maintain the valve in an open position. The e-magnet 80 can be released or powered off for valve shut-in to ensure failsafe operating mode. The e-magnet 80 can be strong enough to keep the spring 72 compressed. In some configurations, several magnets can be combined to achieve the desired or required strength. The e-magnet 80 retaining force (e.g., on the internal tubing sleeve 74 and/or spring 72) can be combined with additional mechanical advantage, friction, or holding force if needed to compress the return spring 72, for example, via corresponding teeth 60 and/or shoulders 61. The actuator 26 can be monitored in continuous (open) mode and the sleeve position can be automatically adjusted if required (e.g., push/pull modes). In some configurations, the e-magnet 80 is disposed on the shaft or piston 96 of the actuator 26 or a part that moves in use. In some configurations, valve shut-in is not under control of the actuator 26, but instead advantageously under control of e-magnet 80 power release and/or collet holding force. In some configurations, the actuator is inverted to be in a pulling configuration (output shaft in tension). The present disclosure advantageously provides a low cost, electric fail-safe mechanism for a downhole safety valve. The present disclosure advantageously does not require a large volume of oil and therefore has less pressure and/or temperature compensation requirements.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electro-mechanical coupling, comprising:

an actuator comprising a piston, wherein the piston is extendable and retractable;

a base member;

an electric magnet;

a magnet, wherein one of the electric magnet and the magnet is operably coupled to the piston, and the other of the electric magnet and the magnet is selectively operably couplable to the base member; and a mechanical advantage mechanism configured to enhance a holding force of the electric magnet with the magnet when the electric magnet is activated, wherein activation of the electric magnet is configured to operably couple the electric magnet and the magnet such that axial movement of the piston causes axial movement of the base member, wherein subsequent deactivation of the electric magnet is configured to operably de-couple the electric magnet and the magnet to allow movement of the base member relative to the actuator, wherein the mechanical advantage mechanism comprises a latch mechanism, wherein the latch mechanism comprises:

an outer collet;

an inner collet disposed at least partially within the outer collet; and a spring, wherein when the electric magnet is activated, the outer collet is locked relative to the inner collet against a force of the spring, and wherein when the electric magnet is deactivated, the spring unlocks the outer collet and the inner collet.

2. The electro-mechanical coupling of claim 1, wherein the actuator is an electro-mechanical actuator.

3. An electric safety valve comprising the electro-mechanical coupling of claim 1, wherein the electric safety valve is fully electric.

4. The electric safety valve of claim 3, wherein the base member is operably coupled to a flow tube of the electric safety valve.

5. An electric safety valve assembly, comprising:

a flapper;

a return spring;

an internal tubing sleeve;

an actuator comprising a piston, wherein the piston is extendable and retractable; and an electro-mechanical coupling configured to selectively operably connect the piston and the internal tubing sleeve, wherein the electro-mechanical coupling comprises:

an electric magnet operably coupled to the piston;

a magnet selectively operably couplable to the internal tubing sleeve; and a latch mechanism configured to provide a mechanical advantage to enhance a holding force of the electric magnet with the magnet when the electric magnet is activated, and wherein the latch mechanism comprises an inner collet, an outer collet, and a latch spring.

6. The electric safety valve assembly of claim 5, wherein the electric magnet is configured to have sufficient holding force to compress the latch spring, and insufficient holding force to compress the return spring without the mechanical advantage of the latch mechanism.

7. The electric safety valve assembly of claim 5, wherein the actuator is an electro-mechanical actuator.

8. An electro-mechanical coupling, comprising:

an actuator comprising a piston, wherein the piston is extendable and retractable;

a base member;

an electric magnet;

a magnet, wherein one of the electric magnet and the magnet is operably coupled to the piston, and the other of the electric magnet and the magnet is selectively operably couplable to the base member; and a mechanical advantage mechanism configured to enhance a holding force of the electric magnet with the magnet when the electric magnet is activated, wherein activation of the electric magnet is configured to operably couple the electric magnet and the magnet such that axial movement of the piston causes axial movement of the base member, wherein subsequent deactivation of the electric magnet is configured to operably de-couple the electric magnet and the magnet to allow movement of the base member relative to the actuator, wherein the mechanical advantage mechanism comprises a double latch mechanism, wherein the double latch mechanism comprises:

an outer collet;

an inner collet disposed at least partially within the outer collet;

an inner rod disposed at least partially within the inner collet;

an outer spring disposed about the inner collet;

at least one inner spring disposed about the inner rod; and at least one ball disposed on an outer diameter of the inner rod, wherein when the electric magnet is activated, the outer collet is locked relative to the inner collet against a force of the outer spring, and wherein when the electric magnet is deactivated, the double latch mechanism unlocks in a two stage release.

9. The electro-mechanical coupling of claim 8, wherein the actuator is an electro-mechanical actuator.

10. The electro-mechanical coupling of claim 8, wherein the at least one inner spring and the at least one ball act as a first stage of the two stage release, and the outer spring acts as a second stage of the two stage release.

* * * * *